US005562059A

United States Patent [19]

Yamauchi et al.

[11] Patent Number: 5,562,059

[45] Date of Patent: Oct. 8, 1996

[54] APPARATUS AND METHOD FOR CONTROLLING SEWING MACHINE

[75] Inventors: Satomi Yamauchi; Hisaaki Tsukahara; Hiroshi Yamada; Osamu Gouta, all of Aichi, Japan

[73] Assignee: Mitsubishi Denki Kabushiki Kaisha, Tokyo, Japan

[21] Appl. No.: 479,749

[22] Filed: Jun. 7, 1995

Related U.S. Application Data

[62] Division of Ser. No. 141,353, Oct. 26, 1993.

[30] Foreign Application Priority Data

Oct. 27, 1992 [JP] Japan ..... 4-288707
Sep. 16, 1993 [JP] Japan ..... 5-230246

[51] Int. Cl.[6] ..... D05B 69/22; D05B 69/18

[52] U.S. Cl. ..... 112/275; 112/300

[58] Field of Search ..... 112/275, 277, 112/300, 316, 317, 470.01, 470.04

[56] References Cited

U.S. PATENT DOCUMENTS 4,754,721 7/1988 Skogward ..... 112/275
4,807,548 2/1989 Rohr et al. ..... 112/275 X
4,955,306 9/1990 Sato et al. ..... 112/300 X
5,018,466 5/1991 Hasegawa ..... 112/275
5,088,429 2/1992 Kanegae ..... 112/275
5,133,272 7/1992 Hayashi ..... 112/300 X

FOREIGN PATENT DOCUMENTS 0366140 5/1990 European Pat. Off. .
0910023 5/1953 Germany .
1438338 3/1969 Germany .
2919681 11/1980 Germany .
4000633 7/1990 Germany .
62-207492 9/1987 Japan .
0314479 2/1991 Japan .

*Primary Examiner*—Peter Nerbun
*Attorney, Agent, or Firm*—Sughrue, Mion, Zinn, Macpeak & Seas

[57] ABSTRACT

A sewing machine having a motor drive operating in response to a controller to rotate in forward and reverse rotation directions. A jogging angle may be set and the drive operated automatically for rotation in forward and/or reverse directions as a function of various operating conditions so that the needle is stopped in an optimum position for piercing a material.

3 Claims, 64 Drawing Sheets

START
S40
S41
S4 ONF = 1 ?
Y
N
S42
S4 OFF→ON ?
N
S43
SRT = OFF
Y
S60
RFLAG = 1 ?
Y
N
R = OFF
S61
R = ON
S62
S44
BRAKE TIMER ON ?
Y
N
S45
S4 ONF = 1
SRT = ON
S50
BRAKE TIMER COUNT-UP
S46
ANGLE ?
N
Y
S51
BRAKE TIME ELAPSED ?
Y
N
SRT = OFF
S47
S52
BK = ON
BK = OFF
S53
BK = ON
S48
S4 ONF = 0
S54
BRAKE TIMER START
S49
RFLAG = RFLAG⊕1
S63
END
S55

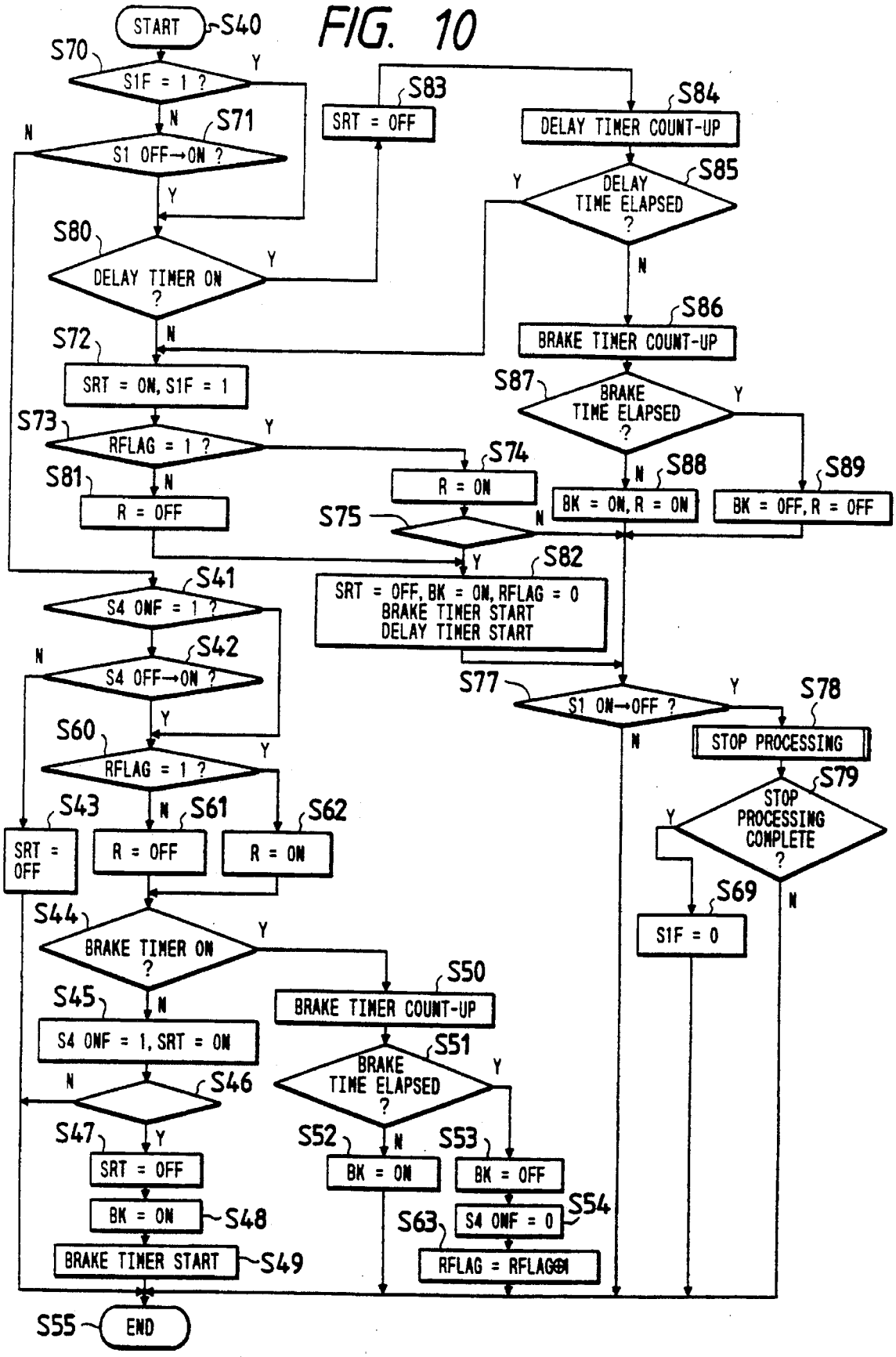
FIG. 10
START
S40
S70
S1F = 1 ?
S71
S1 OFF→ON ?
S80
DELAY TIMER ON ?
S72
SRT = ON, S1F = 1
S73
RFLAG = 1 ?
S81
R = OFF
S74
R = ON
S75
S82
SRT = OFF, BK = ON, RFLAG = 0
BRAKE TIMER START
DELAY TIMER START
S83
SRT = OFF
S84
DELAY TIMER COUNT-UP
S85
DELAY TIME ELAPSED ?
S86
BRAKE TIMER COUNT-UP
S87
BRAKE TIME ELAPSED ?
S88
BK = ON, R = ON
S89
BK = OFF, R = OFF
S41
S4 ONF = 1 ?
S42
S4 OFF→ON ?
S60
RFLAG = 1 ?
S43
SRT = OFF
S61
R = OFF
S62
R = ON
S44
BRAKE TIMER ON ?
S45
S4 ONF = 1, SRT = ON
S46
S47
SRT = OFF
BK = ON
S48
BRAKE TIMER START
S49
S50
BRAKE TIMER COUNT-UP
S51
BRAKE TIME ELAPSED ?
S52
BK = ON
S53
BK = OFF
S54
S4 ONF = 0
S63
RFLAG = RFLAG
S77
S1 ON→OFF ?
S78
STOP PROCESSING
S79
STOP PROCESSING COMPLETE ?
S69
S1F = 0
S55
END
Y
N FORWARD ROTATION
SPEED +
HIGH
MIDDLE
0
-
REVERSE ROTATION
MACHINE SPEED
NEEDLE DOWN POSITION
NEEDLE UP POSITION
FORWARD ROTATION
REVERSE ROTATION
STITCHING START SIGNAL S1
REVERSE ROTATION SIGNAL S5
THREAD TRIMMER START SIGNAL S2
RUN SIGNAL SRT
BRAKE SIGNAL BK
REVERSE ROTATION SIGNAL R
ON

APPARATUS AND METHOD FOR CONTROLLING SEWING MACHINE

This is a divisional of application Ser. No. 08/141,353 filed Oct. 26, 1993.

BACKGROUND OF THE INVENTION

1. Field of the Invention

The present invention relates to an apparatus and a method for controlling a sewing machine driven by a drive such as a motor.

2. Description of the Background Art

FIG. 62 is an arrangement diagram showing a conventional sewing machine controlling apparatus disclosed in Japanese Laid-Open Patent Publication No. HEI3-14479, for example. In this drawing, the numeral 1 indicates a sewing machine, 2 denotes a motor, 3 designates a needle position detector acting as needle position detection means to detect the needle position of the sewing machine 1, 4 represents a machine pulley, 5 indicates a motor pulley, and 6 represents a belt fitted over the machine pulley 4 and the motor pulley 5 to transmit the rotation of the motor 2 to the sewing machine 1. 7 designates a stator of the motor 2, 8 denotes a rotor of the motor 2, and 9 indicates a brake for stopping the motor 2. 10 denotes a foot pedal used to operate the sewing machine 1, 11 represents a lever unit which detects the operation of the foot pedal 10, 12 designates a sewing machine control circuit serving as machine control means to control the orientation, automatic thread trimming, backtacking, etc., of a machine needle, and 13 indicates a motor speed control circuit acting as motor speed control means to control the motor 2 and the brake 9, thereby providing desired stitching speed under the operation command of the foot pedal 10 and others.

S1 indicates a stitching start signal, S2 designates a thread trimmer start signal, S3 represents a needle UP signal, VC denotes a speed command signal, SRT indicates a run signal, BK represents a brake signal, LLKO denotes a low-speed command signal, IMCO designates a middle-speed command signal, and R indicates a reverse rotation signal. It is to be understood that the stitching start signal S1 and the thread trimmer start signal S2 are input signals from the lever unit 11 to the sewing machine control circuit 12, the speed command signal VC is an input signal from the lever unit 11 to the motor speed control circuit 13, and the run signal SRT, the brake signal BK, the low-speed command signal LLKO, the middle-speed command signal IMCO and the reverse rotation signal R are command signals from the sewing machine control circuit 12 to the motor speed control circuit 13.

The operation of the conventional apparatus arranged as described above will now be described. An operation timing chart is shown in FIG. 63. Toeing down the foot pedal 10 switches the stitching start signal S1 on, outputs the run signal SRT from the sewing machine control circuit 12 to the motor speed control circuit 13, excites the stator 7 of the motor 2, and rotates the rotor 8 to drive the sewing machine 1 via the motor pulley 5, the belt 6 and the machine pulley 4.

Then, by changing the toe-down amount of the foot pedal 10, the voltage, current and frequency applied by the motor speed control circuit 13 to the stator 7 of the motor 2 are under the control of the speed command signal VC of the lever unit 11 and the position detection signal FG of the needle position detector 3 fitted to the sewing machine 1 to control the speed of the sewing machine 1 to a desired value according to the toe-down amount of the foot pedal 10.

When the foot pedal 10 is returned to a neutral position, the low-speed command signal LLKO for positioning is output by the sewing machine control circuit 12, and simultaneously, the needle UP or DOWN of the sewing machine 1 is detected under the control of the position detection signal (UP or DOWN) of the needle position detector 3, and the magnetic brake 9 is excited to stop the sewing machine 1.

Further, when the foot pedal 10 is heeled, i.e., is turned in the direction opposite to the tow-down direction, the thread trimmer start signal S2 is switched on, the machine control circuit 12 outputs the run signal SRT and the middle-speed command signal IMCO to carry out end backtacking. After the end backtacking is finished, the middle-speed command signal IMCO is switched off, the low-speed command signal LLKO is switched on, and a thread trimmer output is provided to trim the machine threads.

The needle position detector 3 outputs the needle UP position signal UP and needle DOWN position signal DN which represent the positions of the machine needle. The outputs of this needle position detector 3 and the lever unit 11 are provided to the sewing machine control circuit 12 which exercises the speed control of the motor 2 and the control of various solenoids (not shown) of the sewing machine 1.

The motor speed control circuit 13, which contains an inverter, switches between phases to reverse the motor 2 for the following reason. In the automatic thread trimmer mechanism of the sewing machine 1, since the machine threads are typically trimmed using the rotation of the machine spindle after the machine needle has moved away from a material to be sewn, risen, and reached the highest position or a top dead center, the position where the sewing machine is braked to a stop after machine thread trimming and needle position detection is considerably lower than said top dead center. Hence, when the machine needle stops at this low position if the sewing machine rotates in a forward direction only, the material moved in/out, for example, is caught by the machine needle. To prevent this, the pedal 10 is operated to perform thread trimmer operation to cut the machine threads, the needle position is then detected, and the sewing machine is braked to a stop, whereby if the machine needle stops at the low position, the motor 2 is further reversed to return the machine needle nearer to the top dead center and stop there, and therefore, even a heavy material to be stitched is not caught by the machine needle. It is to be understood that when the machine needle is not at the UP position, the needle UP signal S3 is given to run the sewing machine forward to rotate the machine needle to the UP position. When the machine needle is not at the UP position at power-on, the sewing machine is run forward to rotate the machine needle to the UP position if the needle UP signal S3 is not provided.

The operation of the sewing machine control circuit 12 will now be described in accordance with FIG. 64. The sewing machine control circuit 12 consists of microprocessor circuits (not shown) such as a CPU, ROM, RAM and I/O ports, and is under the control of software. When the pedal 10 is toed down to provide the stitching start signal S1 to a run signal input circuit 301, the run signal SRT is output from a rotation/stop command circuit 305 to the motor speed control circuit 13 via a run control circuit 300 to start the motor 2 running.

Subsequently, when the pedal 10 is returned to the neutral position, the run control circuit 300 outputs the low-speed command signal LLKO to the motor speed control circuit 13 via a speed command circuit 304, whereby the motor 2 is controlled to run at low speed.

Detecting that the sewing machine 1 has reached or exceeded a predetermined speed via a needle UP/DOWN position input circuit 302 according to the pulse width of the needle DOWN position signal DN and that the needle DOWN position signal DN has entered, the run control circuit 300 switches the run signal SRT off and switches the brake signal BK on for a given period of time via the rotation/stop command circuit 305.

Then, when the pedal 10 is heeled to switch on the thread trimmer start signal S2, the middle-speed command signal IMCO is output via the run control circuit 300 and the speed command circuit 304, whereby the motor 2 runs at middle speed, backtacking is performed, the middle-speed command signal IMCO is then switched off, and further the low-speed command signal LLKO is switched on, causing the motor 2 to run at low speed. When the needle DOWN position signal DN is switched on, the thread trimmer output T is provided by a solenoid control circuit 303 to conduct automatic thread trimming of the sewing machine 1. When the needle UP position signal UP is detected, the run signal SRT is switched off, and the brake signal BK is switched on for a given length of time via the rotation/stop command circuit 305, the solenoid control circuit 303 switches the thread trimmer output T off and a wiper output W on for a given period of time, stopping the sewing machine at a thread take-up lever top dead center. It is to be understood that the thread take-up lever top dead center indicates that the thread take-up lever (not shown), which feeds the needle thread of the sewing machine 1, is at the top position, where the thread has been fed the most and cannot be removed from the machine needle at the start of next stitching.

After the brake signal BK has been excited for a given length of time, the reverse rotation signal R is switched on and the run signal SRT is switched on to reverse the motor 2. When the needle top dead center is detected using the needle UP position signal UP, the run signal SRT is switched off and the brake signal BK is switched on for a given period of time to stop the sewing machine at the needle top dead center, and the brake signal BK is switched off. Subsequently, when the thread trimmer start signal S2 is on, the solenoid control circuit 303 outputs a presser foot UP output FU to raise the presser foot (not shown).

FIG. 65 shows an example of needle bar motion, wherein a vertical axis represents the height of the machine needle with respect to a throat plate surface (0 mm) and a horizontal axis represents the rotary angle of an arm shaft (not shown) of the sewing machine 1. As the arm shaft of the sewing machine 1 rotates, the height of the machine needle changes.

At the position of 0 degrees in FIG. 65, for example, the machine needle is at the top dead center and is out of the material, whereby the material can be removed. At the position of 180 degrees, the machine needle is at the bottom dead center. When it is desired to change the direction of the material to change the stitching direction, the machine needle stopping at this position allows the material to be turned without being offset.

At the position of 90 degrees, the machine needle sticks in the material. At the position of 100 degrees, the machine needle is located at the position of the throat plate (not shown) where the material is placed. The machine needle comes out of the throat plate surface at the position of 260 degrees and comes out of the material at the position of 270 degrees.

The UP position signal UP of the machine needle is switched on slightly in front of the thread take-up lever top dead center (at 40 degrees) and the DOWN position signal DN of the machine needle is switched on slightly in front of the needle DOWN position (at 160 degrees). The machine needle is oriented to a stop at the needle UP or DOWN position under the control of these two signals.

SUMMARY OF THE INVENTION

In the conventional sewing machine controlling apparatus arranged as described above, when the sewing machine is started with the machine needle stopping at the UP position after thread trimming or the like, the sewing machine 1 is not high in speed and does not have the force of inertia when the machine needle pierces the material as compared to the start of operation with the machine needle at the DOWN position, whereby the machine needle does not pierce a heavy material, a leather product or the like.

For this reason, the machine pulley is reversed by hand and brought near to the needle DOWN position before operation is started, whereby the material must be held by one hand at the start of stitching, workability is low, and it is dangerous to touch the machine pulley.

When the material to be sewn is a leather product, for example, in which large holes are made in seams, the holes, if positioned inaccurately from the edges of the leather, will result in unneat seams and low quality. To avoid this, the machine pulley is turned by hand to move the machine needle to a position immediately before the material, the positions of holes made by the machine needle in the leather product are determined, and operation is then started, whereby the material must be held by one hand, resulting in poor workability. In addition, if the pedal is accidentally depressed by foot during the hand-turning of the machine pulley, the sewing machine may rotate and the operator hand will be caught between the machine pulley and the belt, etc., involving danger of injury.

Also, if the machine needle is moved to the position immediately before the material once, the position where the machine needle should stick in the material cannot always be reached at one time and the machine pulley must be hand-rotated in the forward or reverse direction several times to set the position, further reducing workability.

Also, when a switch is turned on by hand to start stitching, the hand holding the material is used to turn the switch on, whereby the material moves and stitching start must be repeated many times.

Also, in jogging angle setting, a jogging angle is set by angle setting means, a jogging signal is entered to rotate the sewing machine by the jogging angle, a distance between the material and the machine needle is checked, and if the distance is too short or too long, the angle setting must be repeated many times.

Also, when the material to be stitched has been changed, the angle is re-set, the jogging signal is entered to make a rotation of the jogging angle, the distance between the material and the machine needle is checked, and if the distance is too short or too long, the angle setting must be repeated many times.

It is accordingly a first object of the present invention to overcome the above enumerated difficulties by providing a safe sewing machine controlling apparatus and method which allow the machine needle to be stopped immediately before a material by the rotation of a drive, such as a motor, to permit pre-microadjustment of the position where the machine needle sticks in the material and which allow the sewing machine to be reversed to return the machine needle to pierce even a heavy material.

A second object is to provide a sewing machine controlling apparatus and method which permit reverse-rotation needle UP for use with a blind stitching machine and which also permit reverse-rotation needle UP after backtacking when it is desired to do backtacking.

A third object is to provide a sewing machine controlling apparatus and method which keep any excess stitches from being put in a material or a finger from being stuck during needle UP operation.

A fourth object is to provide a sewing machine controlling apparatus and method which allow a next thread trimmer signal to be entered when the machine needle has stopped at the UP position and the force of piercing a material to be increased at the start of operation to pierce even a heavy material without requiring the machine pulley to be rotated by hand.

A fifth object is to provide a sewing machine controlling apparatus and method which allow a next thread trimmer start signal to be entered after thread trimming and the force of piercing a material to be increased at the start of operation to pierce even a heavy material without requiring the machine pulley to be rotated by hand.

A sixth object is to provide a sewing machine controlling apparatus and method which offer ease of determining the position of sticking the machine needle without the machine pulley being rotated by hand after thread trimming, whereby excellent workability is increased, stitching time is reduced, and the machine pulley need not be touched by hand.

A seventh object is to provide a sewing machine controlling apparatus and method which keep a material from being offset in pressing a switch by hand to avoid stitching start from being repeated many times, whereby workability is increased and stitching time is reduced.

An eighth object is to provide a sewing machine controlling apparatus and method which facilitate jogging angle setting which must be made to change the stopping position of the machine needle immediately before a new material different in thickness from the old one.

As described herein, according to the first feature of the invention, the jogging angle can be set and the machine needle can be stopped immediately before the material by the sewing machine drive so that the machine pulley need not be hand-turned, whereby safety is ensured and working efficiency is improved.

Also, according to a second feature of the invention, the application of the jogging signal allows the machine needle to be rotated in the reverse direction to a position away from the material, whereby the stitching start speed of piercing the next material is increased and the force of inertia is large enough to prevent the needle from being stopped, without piercing the material, and working efficiency is improved. Also, the torque of the sewing machine drive may be small, resulting in a low-priced apparatus.

Also, according to a third feature of the invention, the application of the jogging signal alternates forward rotation and reverse rotation, whereby the position where the material is pierced with the machine needle can be re-adjusted easily.

Also, according to the fourth embodiment of the invention, the application of the stitching start signal after the forward rotation of the jogging angle automatically rotates the sewing machine in the reverse direction once, then in the forward direction, whereby the force of piercing the material can be provided and the jogging signal need not be applied to improve working efficiency.

Also, according to the fifth embodiment of the invention, the stitching start signal causes the sewing machine to rotate in the reverse direction, come to a stop once, then rotate in the forward direction, whereby skip stitches or the like caused by the unevenly fed thread when the reverse rotation shifts directly to the forward direction can be prevented because the sewing machine rotates forward after the thread is fed evenly.

Also, according to the sixth embodiment of the invention, if the sewing machine does not rotate forward by the jogging angle when the jogging signal has been applied, the stitching start signal causes the sewing machine to start with forward rotation, not with reverse rotation, whereby working efficiency is improved.

Also, according to the seventh embodiment of the invention, after operating under the control of the stitching start signal, the sewing machine is always rotated forward by the jogging angle in the forward direction under the control of the jogging signal, whereby working efficiency is improved.

Also, according to the eighth embodiment of the invention, reverse-rotation needle UP can be achieved when the direction of the material is changed on the blind stitching machine, whereby the machine pulley need not be hand-rotated to improve working efficiency.

Also, according to the ninth embodiment of the invention, the reverse rotation signal permits reverse-rotation needle UP and the thread trimmer start signal allows end backtacking and reverse-rotation needle UP, whereby working efficiency is improved.

Also, according to the tenth embodiment of the invention, reverse-rotation needle UP is performed before the material is pierced with the machine needle and forward-rotation needle UP is done after the material has been pierced, whereby the material is not seamed or bored unlike the conventional sewing machine which always rotated forward. Also, since the machine needle always moves upward, there is no danger that the hand is pierced with the machine needle if it is under the machine needle, ensuring safety.

According to the eleventh embodiment of the invention, the material is not seamed or bored unlike the conventional sewing machine which automatically raised the needle in the forward direction at power-on. Also, the finger is not pierced.

Also, according to the twelfth embodiment of the invention, since the sewing machine is designed to rotate the jogging angle only after thread trimmer operation is performed, the needle is usually at a stop at the DOWN position before thread trimming, and if the jogging signal switch is accidentally touched, the sewing machine does not rotate when the needle need not stop immediately before the material, and if the sewing machine is jogged carelessly, for example, the machine needle is kept from coming out of the DOWN position and stopping at a position outside the material, the material does not offset when its direction is changed, neat seams are provided, and unnecessary motion is not made, whereby time can be reduced and working efficiency is improved.

Also according to the thirteenth to the fifteenth embodiments, the application of the stitching start signal at the needle UP position stop time or after thread trimming causes the machine needle to rotate in the reverse direction by the reverse rotation angle set to the reverse rotation angle setting means, then to rotate in the forward direction, whereby the speed at the time of piercing the material is increased enough to provide the force of inertia, thereby preventing the needle from stopping without piercing the material. Also, the motor torque may be small, resulting in a low-priced apparatus.

Also, according to the sixteenth embodiment, the jogging angle can be set and the machine needle can be stopped immediately before the material by the sewing machine drive, whereby the machine pulley need not be hand-turned to ensure safety and improve working efficiency.

Also, according to the seventeenth embodiment of the invention, when it is desired to change the material position or the material after the machine needle has been lowered to the position immediately before the material once, merely entering the jogging signal causes the machine needle to rotate reversely to return to the top, whereby it is easy to shift the material position or change the material.

Also, according to the eighteenth embodiment of the invention, the wiper, if any, makes contact with the machine needle when the thread is wiped by the wiper after the machine needle has stopped immediately before the material, and to prevent this, the sewing machine is stopped once at the needle UP position, the wiper is operated, and the sewing machine is rotated the jogging angle again to stop the machine needle at the position immediately before the material, whereby the wiper does not come into contact with the machine needle and the needle fall position for the next material can be adjusted easily.

Also, according to the nineteenth embodiment of the invention, the machine pulley is hand-turned until it actually reaches the stop position immediately before the material and that position is stored, whereby angle setting need not be repeated many times.

Also, according to the twentieth embodiment of the invention, the number of times when the reverse rotation signal switch is pressed is decreased to reduce working time.

Also, according to the twenty first embodiment of the invention, the reverse rotation signal switch can be omitted, resulting in a low-priced apparatus.

Also, according to the twenty second embodiment of the invention, the sewing machine is actually rotated under the control of the ultra-low speed signal, with the machine pulley untouched, to match the point of the machine needle with the position immediately before the material, whereby safety is ensured, adjustment need not be made many times, and working time is reduced.

Also, according to the twenty third embodiment of the invention, the sewing machine running at ultra-low speed can be returned under the control of the angle storage signal if it has gone beyond the destination, whereby the time for setting the position immediately before the material is reduced.

Also, according to the twenty fourth embodiment of the invention, once the angle between the material and the machine needle has been set, the stop position immediately before the material need not be re-adjusted if the thickness of the material changes, whereby working time can be reduced.

Also, according to the twenty fifth embodiment of the invention, the torque which peaks within the position where the material is pierced with the machine needle is removed as noise, whereby the material surface position can be detected reliably.

BRIEF DESCRIPTION OF THE DRAWINGS

FIG. 10 is a flowchart illustrating the operation of a fifth embodiment of the invention.

DESCRIPTION OF THE PREFERRED EMBODIMENTS

Figure 1:
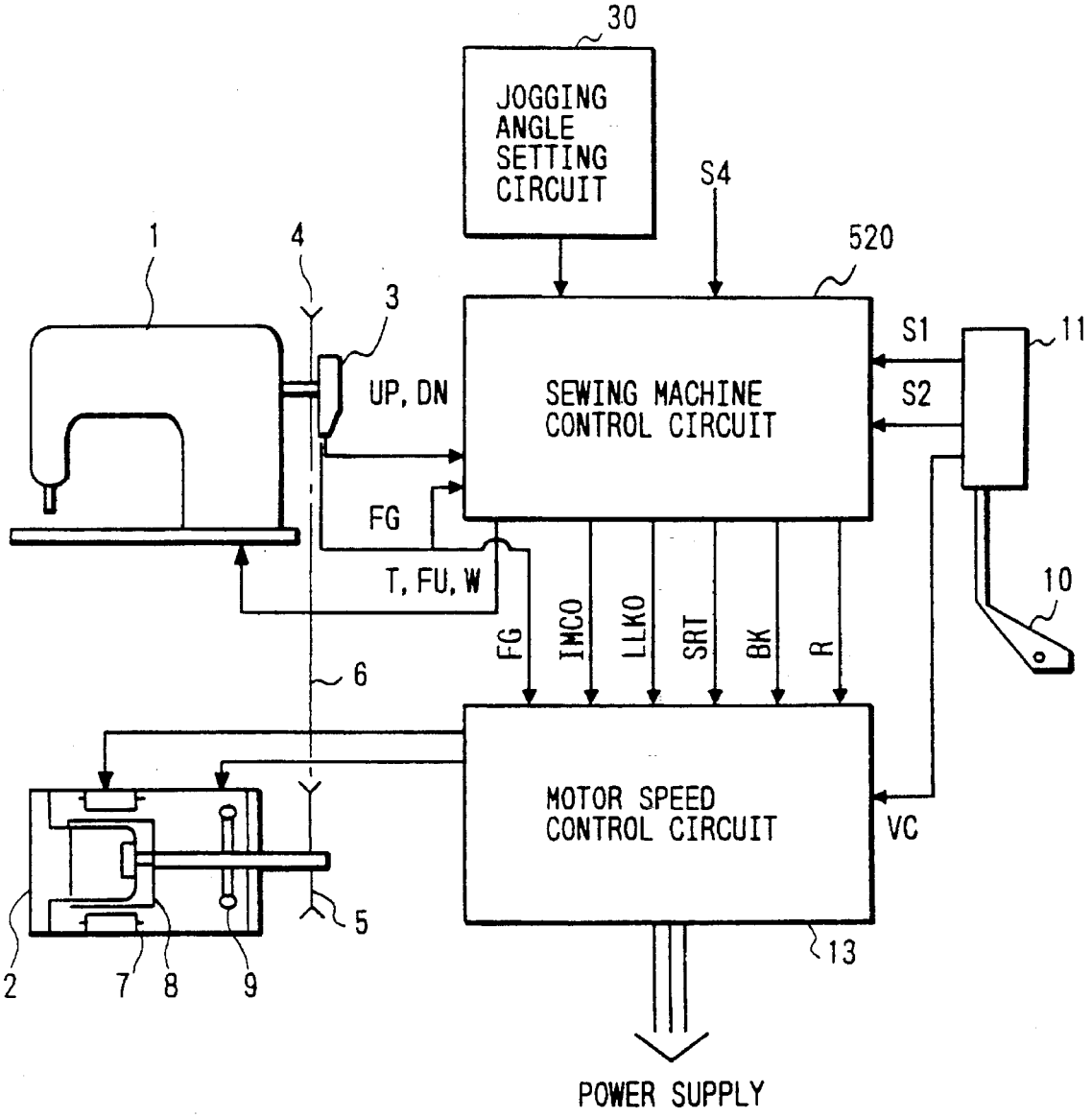
FIG. 1 is an arrangement diagram of a sewing machine controlling apparatus illustrating an embodiment of a first embodiment of the invention.
Figure 62:
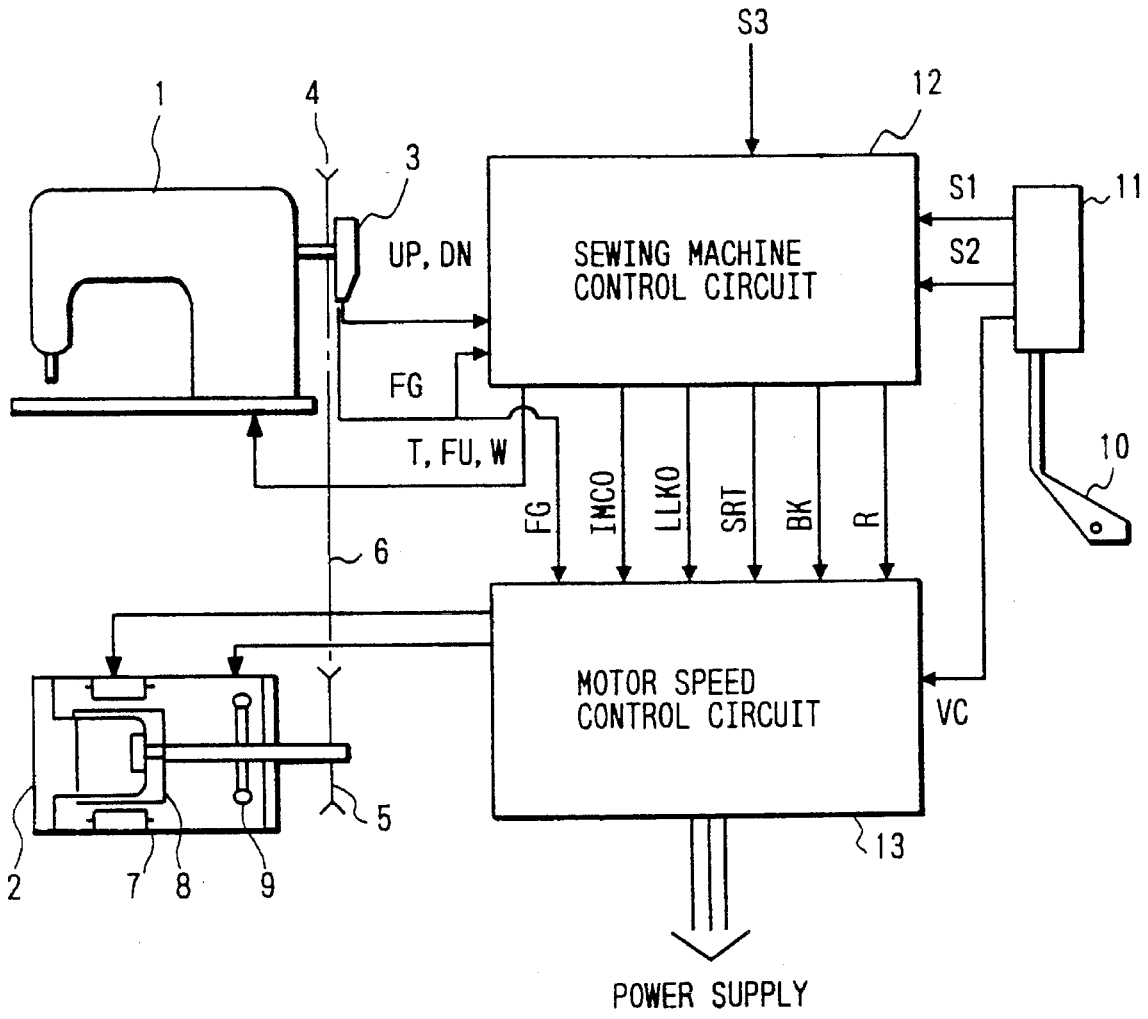
FIG. 62 is an arrangement diagram of a conventional sewing machine controlling apparatus.
Figure 63:
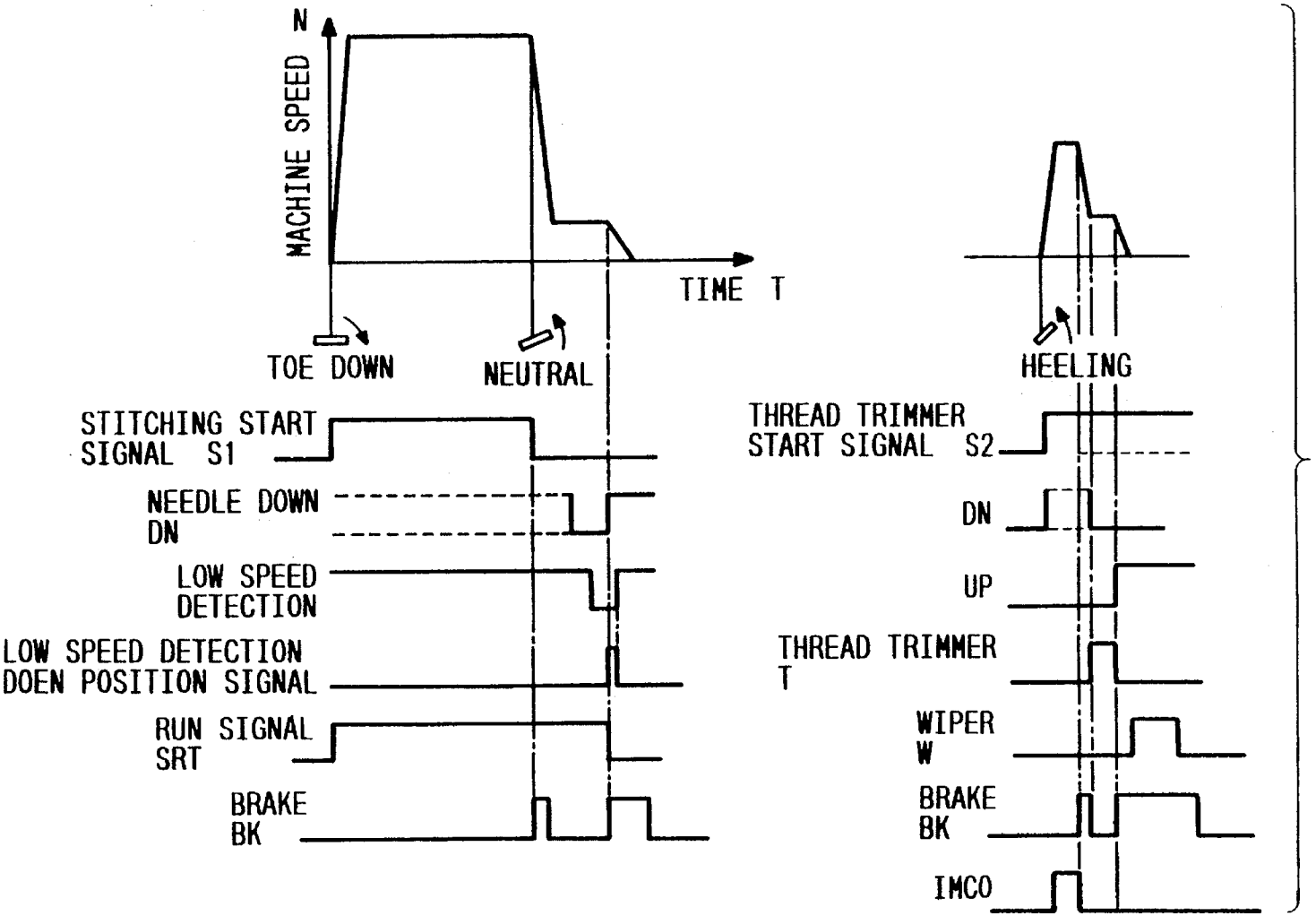
FIG. 63 is a timing chart of conventional operation.

A first embodiment of the invention will now be described with reference to the appended drawings. FIG. 1 is an arrangement diagram of a sewing machine controlling apparatus concerned with the present embodiment, wherein the numeral 30 indicates a jogging angle setting circuit acting as jogging angle setting means, 520 represents a sewing machine control circuit detailed in FIG. 2, and S4 designates a jogging signal entered into the sewing machine control circuit 520. A position detection signal FG from the needle position detector 3 is designed to be entered into the motor speed control circuit 13 and also into the sewing machine control circuit 520. It is to be noted that the other parts are identical to those of the conventional example in FIG. 62 and will not be described.

The operation of the apparatus according to the present embodiment will now be described. When the jogging angle is set to 90 degrees, for example, by the jogging angle setting circuit 30 and the jogging signal S4 is applied to the sewing machine control circuit 520, the sewing machine 1 runs in the forward direction by the set jogging angle and the machine needle stops immediately before the material.

Figure 2:
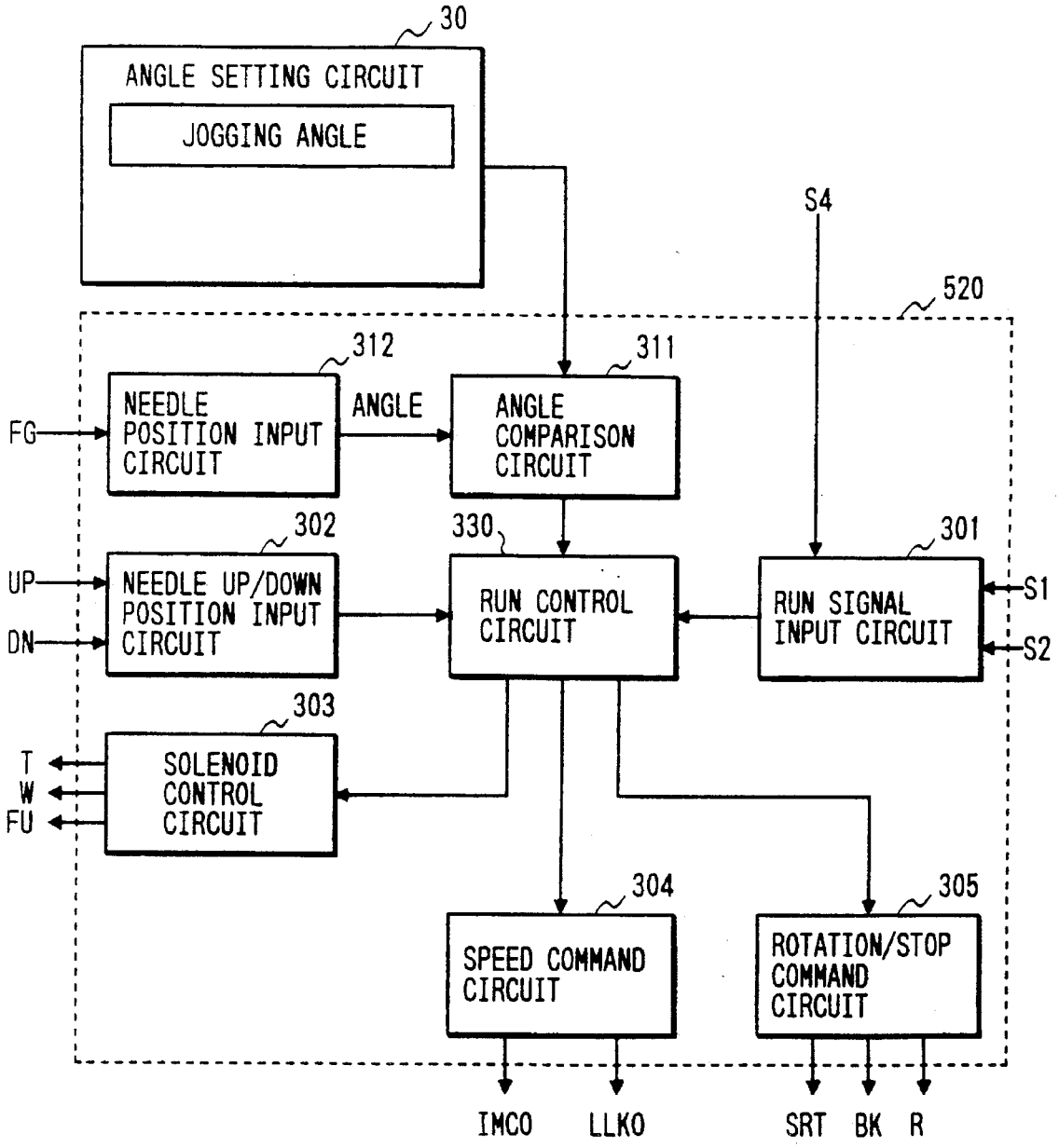
FIG. 2 is a detail drawing of a sewing machine control circuit shown in FIG. 1.

When the jogging signal S4 is switched on, the run signal SRT is switched on via the run signal input circuit 301 in FIG. 2, then via the run control circuit 330 and the rotation/stop command circuit 305 to start the motor 2 running forward. At this time, the jogging angle set in the angle setting circuit 30 is compared by an angle comparison circuit 311 with the rotary angle of the sewing machine 1 entered to the needle position input circuit 312 from the position detection signal FG given by the needle position detector 3. If the rotary angle has reached or exceeded the set jogging angle, the run control circuit 330 causes the rotation/stop command circuit 305 to switch the run signal SRT off and the brake signal BK on, stopping the sewing machine 1 at the rotary position of the set jogging angle.

Figure 3:
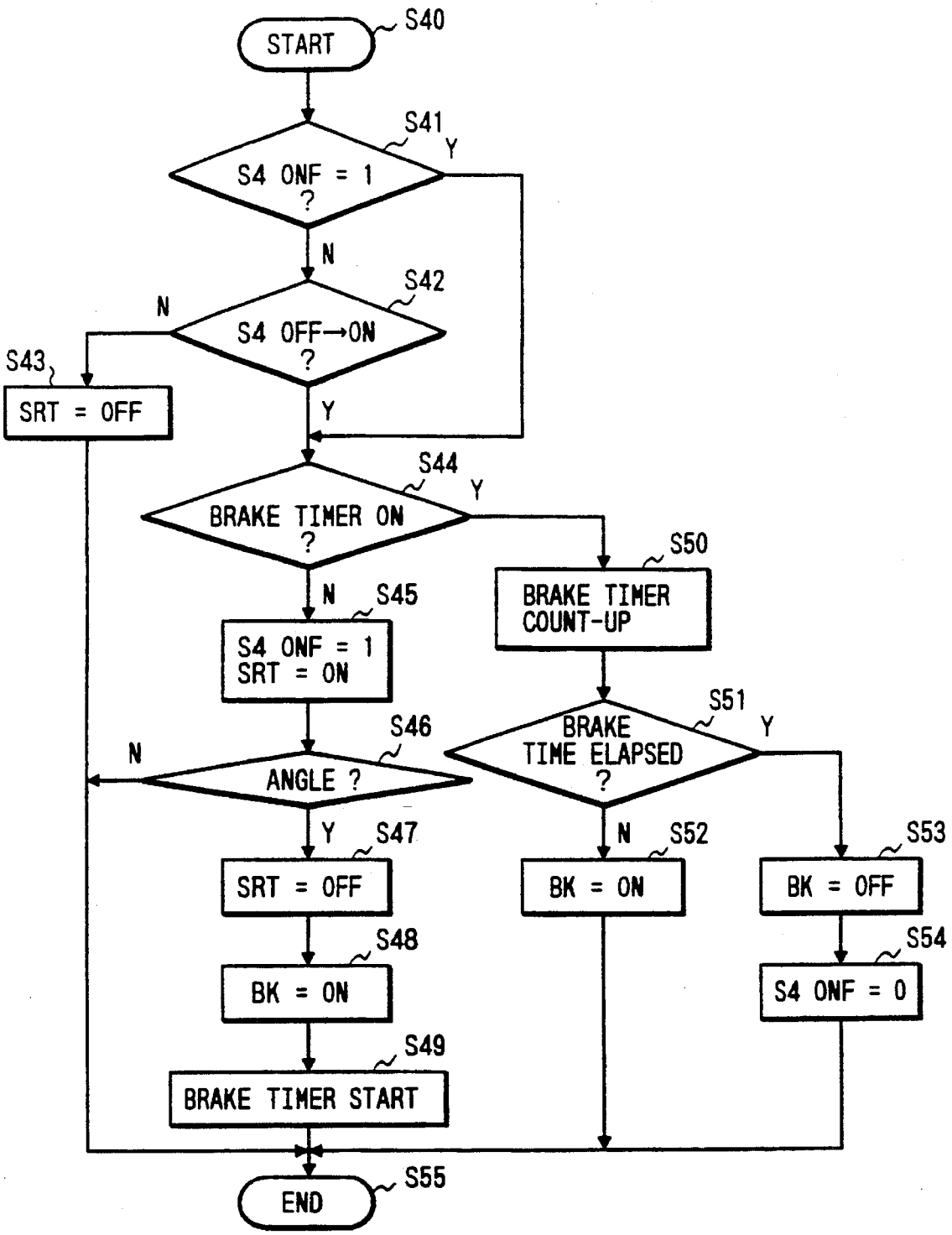
FIG. 3 is a flowchart illustrating the operation of the first embodiment of the invention.

The above operation will be described in accordance with a flowchart in FIG. 3. At power-on or after thread trimming, a flag S4ONF for storing the ON of the jogging signal S4 has been cleared to 0, the run signal SRT to OFF, and the brake signal BK to OFF.

Starting at step 40, the processing advances from step 41 to step 42 because the flag S4ONF is still 0 at step 41. Until the jogging signal S4 turns from OFF to ON at step 42, the run signal SRT remains OFF at step 43 and the sewing machine is kept stopped. When the jogging signal S4 has turned from OFF to ON at step 42, the sequence progresses to step 44, then to step 45 since a brake timer is not on. Here, the flag S4ONF for storing the ON of the jogging signal S4 is set to 1. Also, since operation is started, the run signal SRT is switched on. At step 46, it is judged whether the jogging angle has been reached or not. If it has not been reached, the process ends and the sewing machine 1 continues rotating, awaiting the next cycle through the step 40 START (not shown).

Figure 4:
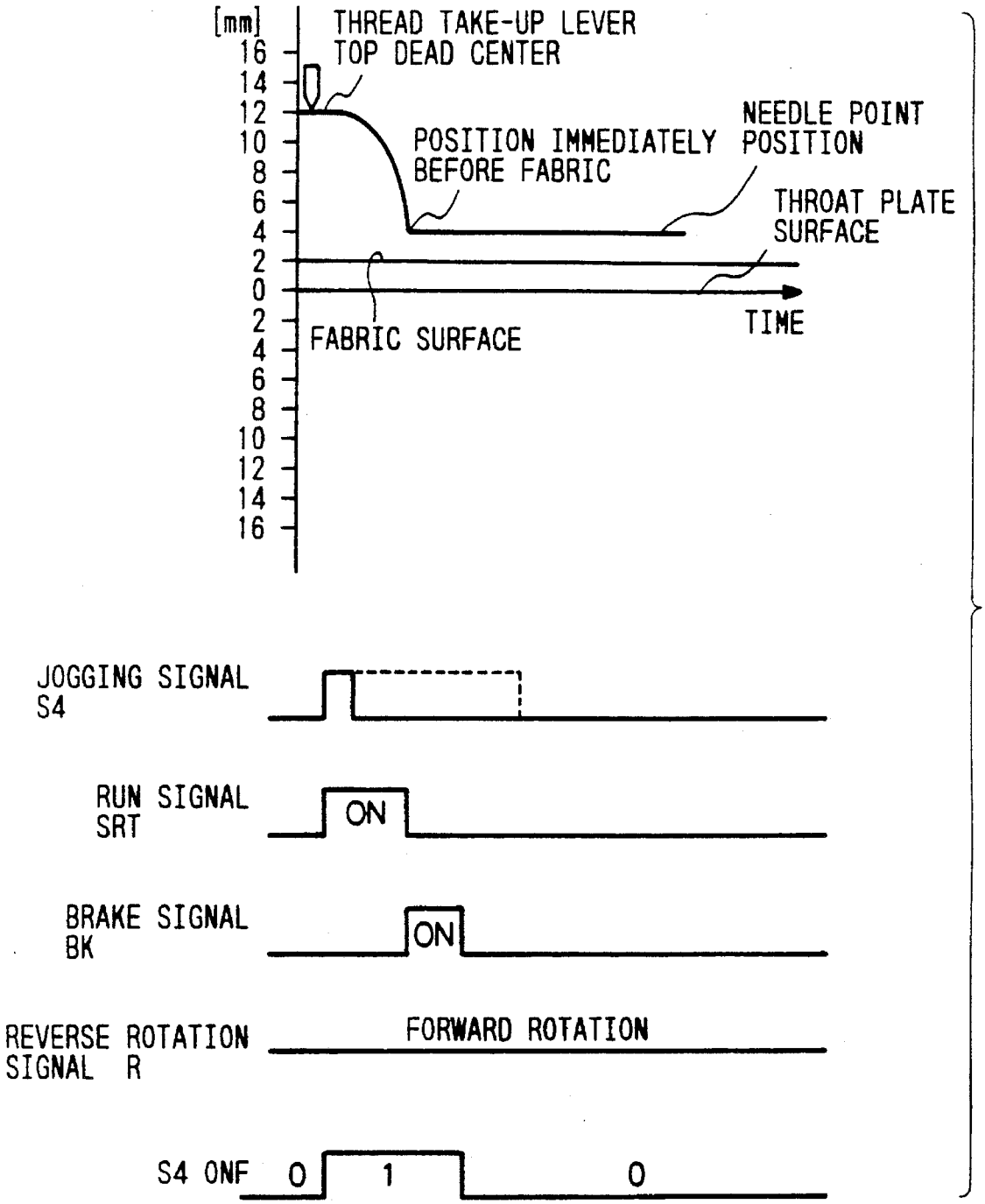
FIG. 4 is a timing chart of the first embodiment of the invention.

If it has been judged at step 46 that the sewing machine 1 has rotated the jogging angle, the run signal SRT is switched off at step 47, the brake signal BK is switched on at step 48, and the brake timer is set for the brake output time at step 49. The processing returns from the END at step 55 to the START at step 40. Since the flag S4ONF is now 1, the processing shifts to step 44. As the brake timer is on at step 44, the sequence moves to step 50 where the brake timer is counted up. At step 51, it is judged whether the brake timer has exceeded a given time or not. If the brake timer has not expired, the brake signal BK is switched on at step 52. If the brake timer has expired, the brake signal BK is switched off at step 53 and the flag S4ONF is cleared to 0 at step 54. The timing chart of this operation is shown in FIG. 4.

When the jogging signal S4 is switched on, the run signal SRT is switched on and the sewing machine 1 starts rotating forward because the reverse rotation signal R is 0. It is detected that the sewing machine 1 has rotated the set jogging angle (e.g., 90 degrees) using the position detection signal FG of the needle position detector 30, the run signal SRT is switched off, and the brake signal BK is switched on to stop the machine needle at a position immediately before the material. The brake signal BK is switched off in a given time. An operator moves the material at this position to determine the position of the material to be pierced with the machine needle. When the position of the material to be pierced with the machine needle has been confirmed, the operator toes down the foot pedal 10 to enter the stitching start signal S1 into the sewing machine control circuit 520, whereby the run signal SRT is output to the motor speed control circuit 13 to cause the sewing machine 1 to perform predetermined operations as in the aforementioned conventional example. When thread trimmer operation is required, the foot pedal 10 is heeled to cause the sewing machine 1 to carry out operations as in the above-mentioned conventional example to cut the machine threads. It is to be noted that the apparatus in the present embodiment, which allows the jogging angle to be set and the needle to be stopped immediately before a fabric by the motor 2, whereby the machine pulley 4 need not be rotated by hand, safety is ensured, and working efficiency is improved.

Figure 5:
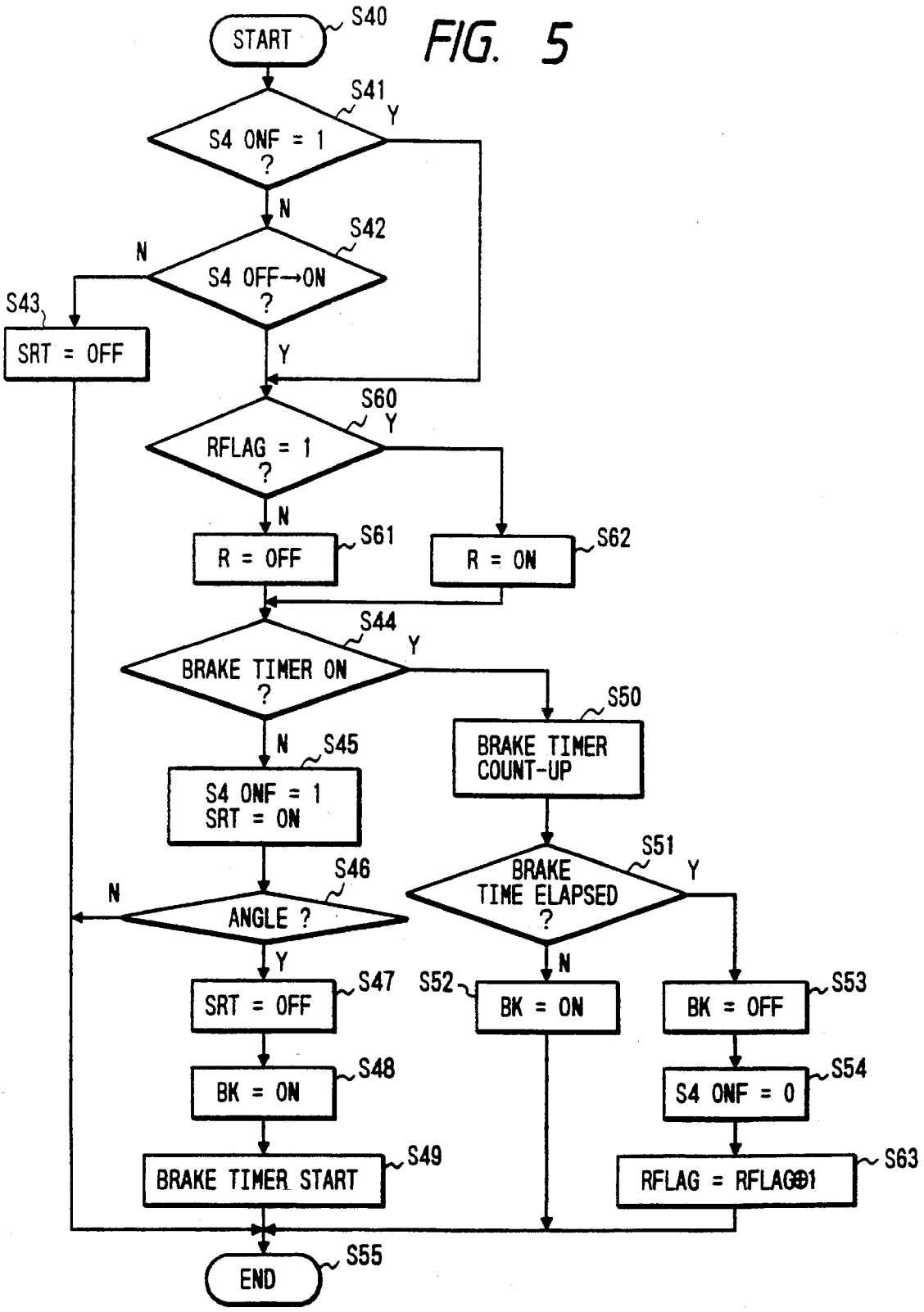
FIG. 5 is a flowchart illustrating the operation of a second embodiment of the invention.

A second embodiment of the invention will now be described. The operation of the sewing machine control circuit 520, which achieves the operation of the apparatus in the present embodiment, will be described in accordance with a flowchart shown in FIG. 5. It is to be understood that the arrangement and operation of the machine controlling apparatus are identical to those of the first embodiment (Embodiment 1) with the exception of the operation of this sewing machine control circuit and will not be described.

At power-on or after thread trimming, the flag S4ONF for storing the ON of the jogging signal S4 has been cleared to 0, a reverse rotation flag RFLAG to 0, the run signal SRT to OFF, the brake signal BK to OFF, and the reverse rotation signal R to OFF.

Starting at step 40, the processing advances from step 41 to step 42 because the flag S4ONF is still 0 at step 41. Until the jogging signal S4 turns from OFF to ON at step 42, the run signal SRT remains OFF at step 43 and the sewing machine is kept stopped. When the jogging signal S4 has turned from OFF to ON at step 42, the sequence progresses to step 60. When the reverse rotation flag RFLAG is 0, the processing proceeds to step 61, where the reverse rotation signal R is set to OFF and the sewing machine rotates forward. When the reverse rotation flag RFLAG is 1 at step 60, the sequence advances to step 62, where the reverse rotation signal R is set to ON and the sewing machine rotates reversely.

Next, the processing progresses to step 44, then to step 45 since the brake timer is not on. At step 45, the flag S4ONF is set to 1. Once the jogging signal S4 is entered, it is held until the sewing machine rotates the jogging angle.

Also, since the run signal SRT is switched on at step 45, the sewing machine 1 starts rotating. At step 46, it is judged whether the sewing machine 1 has rotated the set jogging angle or not using the position detection signal FG of the needle position detector 3 of the sewing machine 1. If it has not rotated the set angle, the sewing machine 1 continues rotating. If it has rotated the set jogging angle, the run signal SRT is switched off at step 47, the brake signal BK is switched on, and the brake timer is started. Subsequently, in a next processing beginning at step 40, since the brake timer is on at step 44, the brake timer is counted up at step 50, and it is judged at step 51 whether or not the brake time has elapsed a given time. If not, the brake signal BK is kept on at step 52. If the brake time has elapsed, the brake signal BK is switched off at step 53, the flag S4ONF is set to 0 at step 54, and the sewing machine 1 comes to a stop. At this time, the reverse rotation flag RFLAG is EXCLUSIVE ORed with 1 at step 63 to invert the value. After the first forward rotation is finished, the reverse rotation flag RFLAG is set to 1.

Accordingly, when the jogging signal S4 is then entered, the reverse rotation signal R is switched on at step 62 to rotate the sewing machine 1 reversely because the reverse rotation flag RFLAG is 1 at step 60. When sewing machine has rotated the jogging angle reversely, the run signal SRT is switched off and the brake signal BK is switched on to stop the sewing machine 1. At this time, the reverse rotation flag RFLAG is set to 0.

Figure 6:
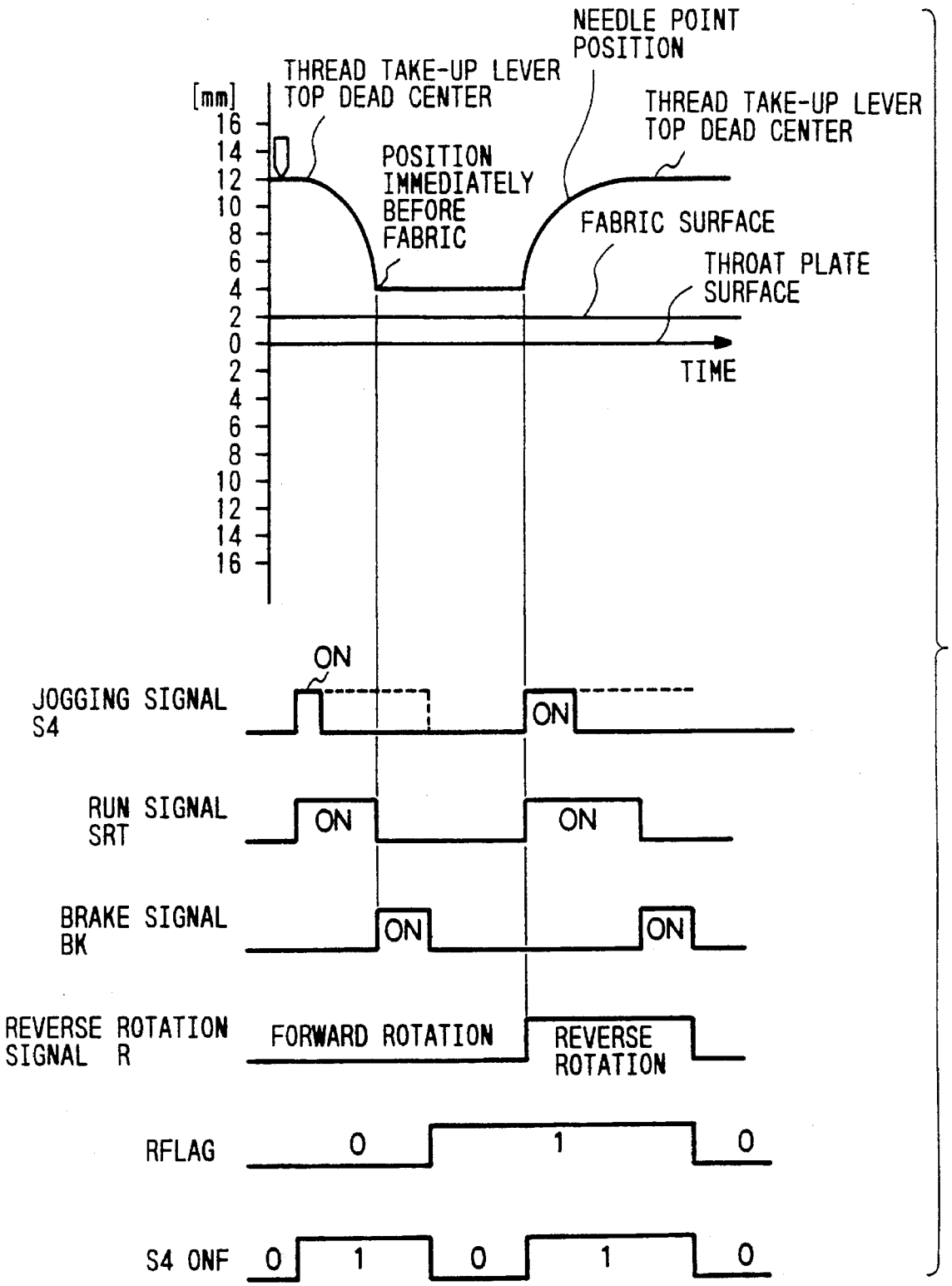
FIG. 6 is a timing chart of the second embodiment of the invention.

This operation is as detailed in FIG. 6 and will not be described. It is to be noted that when the run signal SRT is used for stitching in the forward direction with the machine needle stopping immediately before the material, the distance of piercing the material is short, the speed is not high enough when the material is pierced, and the force of inertia is small, whereby torque required to pierce the material is not provided and the sewing machine stops. However, the apparatus in the present embodiment allows the sewing machine to rotate by the jogging angle once to move the machine needle away from the material under the control of the jogging signal entered again and subsequently to rotate forward under the control of the run signal SRT, whereby the distance of piercing the material is large, the speed of piercing the material is high, and the force of inertia is therefore large to facilitate the piercing of the material.

Figure 7:
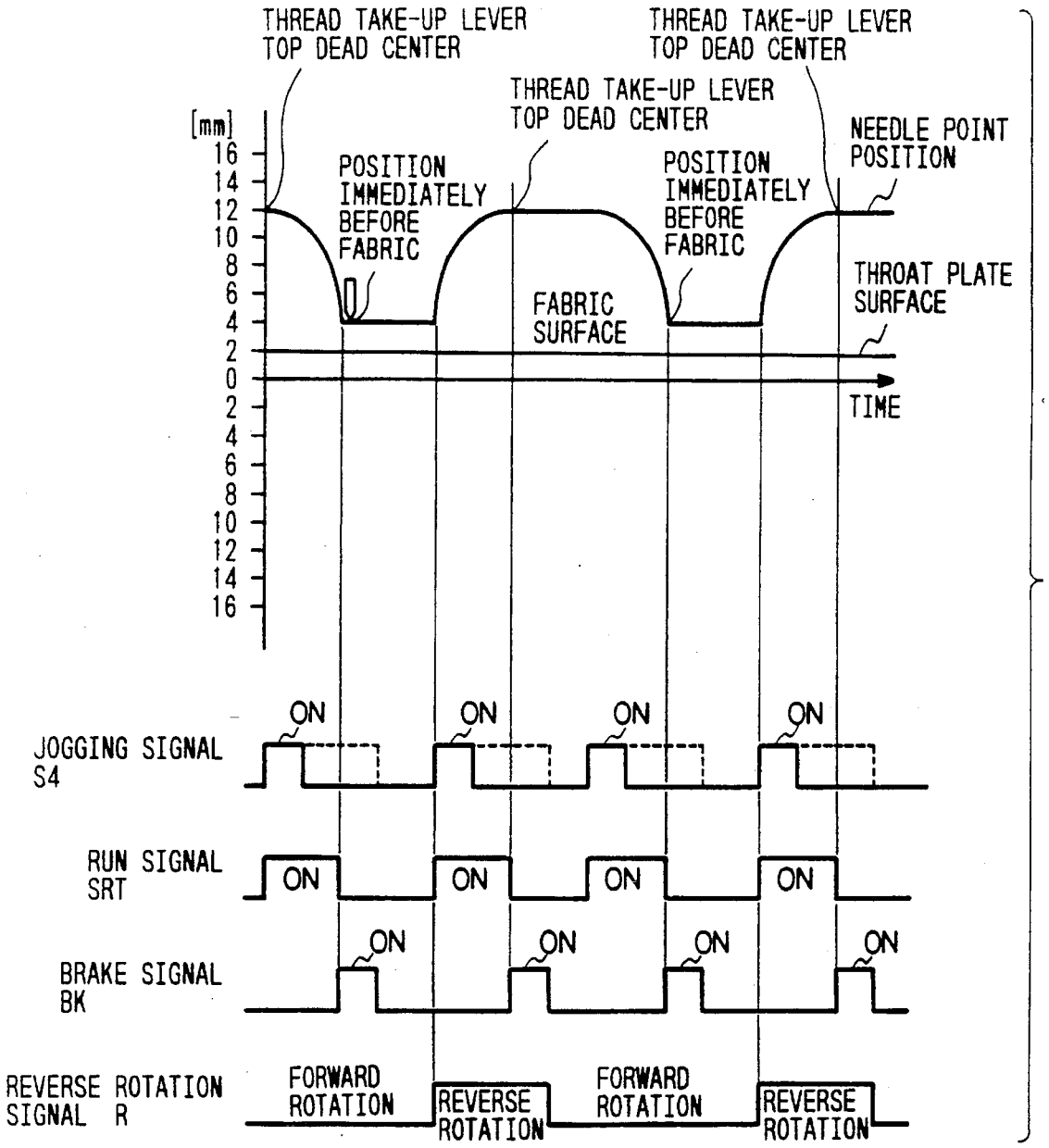
FIG. 7 is a timing chart of a third embodiment of the invention.

A third embodiment of the invention will now be described. In the sewing machine controlling apparatus described in Embodiment 2, further entry of the jogging signal S4 causes the sewing machine 1 to rotate forward since the reverse rotation flag RFLAG is 0. After the sewing machine 1 has stopped, the reverse rotation flag RFLAG is inverted to 1. When the jogging signal S4 is further entered, the sewing machine 1 rotates reversely because the RFLAG is 1. Accordingly, every time the jogging signal S4 is entered, the sewing machine 1 alternates between forward rotation and reverse rotation. The timing chart of this operation is shown in FIG. 7. It is to be noted that the present embodiment allows the position where the material is pierced with the machine needle to be re-adjusted to improve working efficiency.

Figure 8:
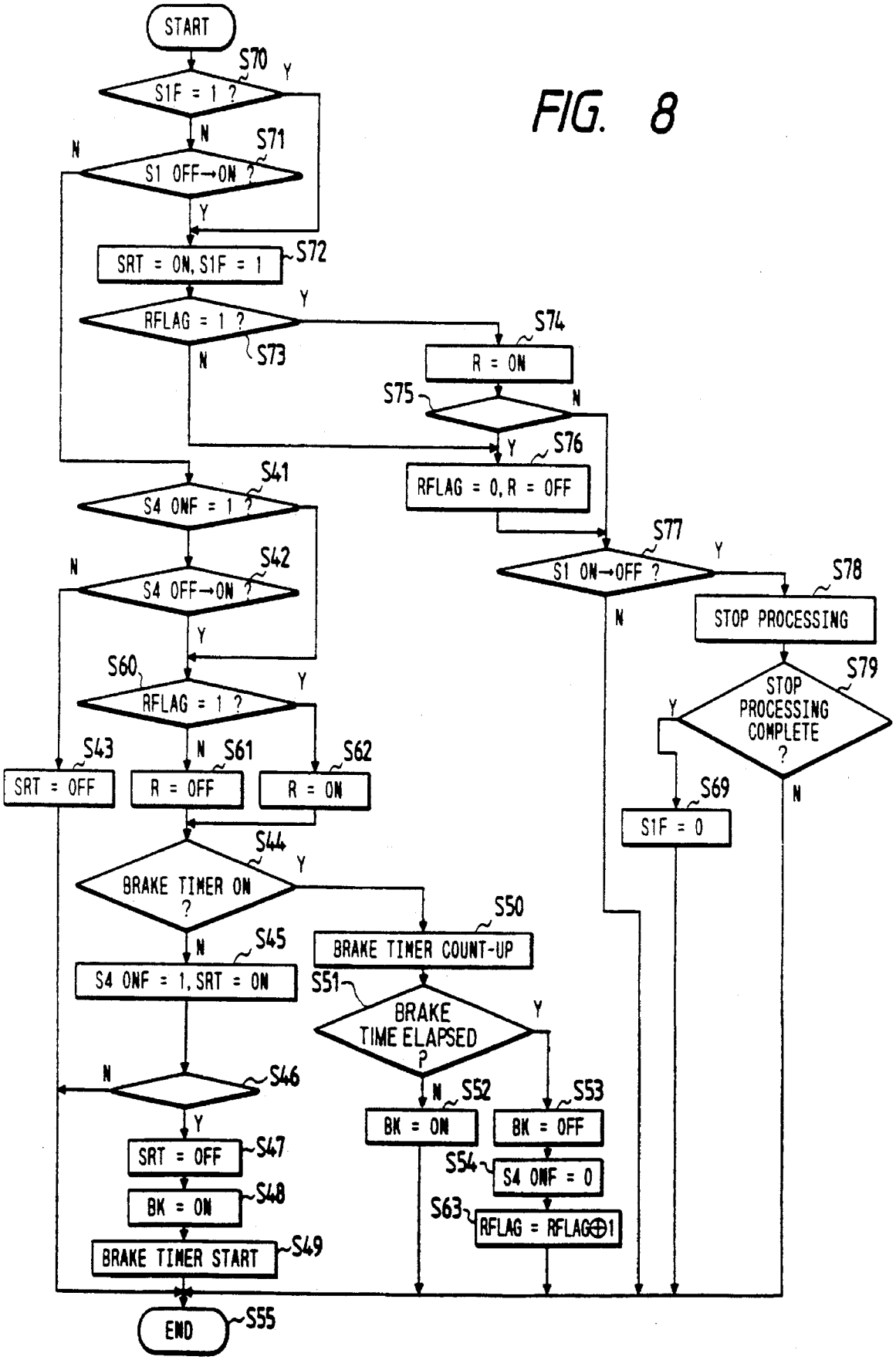
FIG. 8 is a flowchart illustrating the operation of a fourth embodiment of the invention.

A fourth embodiment of the invention will now be described. Operation performed at the application of the stitching start signal S1 will be described with reference to FIG. 8. When a flag S1F, which stores the ON of the stitching start signal S1, is 0 at step 70, the processing moves on to step 71 once. If the stitching start signal S1 is off at step 71, the processing advances to step 41, where the operation as in Embodiment 3 shown in FIG. 7 is performed. When the stitching start signal S1 has turned from OFF to ON at step 71, the sequence progresses to step 72, where the run signal SRT is switched on and the flag S1F is set to 1. At step 73, it is judged whether the reverse rotation flag RFLAG is 1 or not. If it is 1, the reverse rotation signal R is set to ON at step 74 and the sewing machine 1 rotates reversely. If the reverse rotation flag RFLAG is 0 at step 73, the sewing machine 1 rotates forward, not reversely. At step 75, it is judged whether the sewing machine 1 has rotated the set jogging angle in the reverse direction. If the jogging angle has not been reached, the sequence advances to step 77. If the set jogging angle has been reached, the reverse rotation flag RFLAG is set to 0 and the reverse rotation signal R is switched off to run the sewing machine 1 forward. At step 77, it is monitored whether or not the stitching start signal S1 has turned from ON to OFF. If it has changed from ON to OFF, stop processing is performed at step 78. If it has been judged at step 79 that the stop processing is complete, the flag S1F is set to 0 at step 69.

Accordingly, when the stitching start signal S1 is switched on with the sewing machine 1 stopping at the position of 90 degrees after rotating by the jogging angle forward under the control of the jogging signal S4, the sewing machine 1 is rotated reversely by the jogging angle, then rotates forward and stitches the material. Therefore, when the stitching start signal S1 is applied with the needle stopping immediately before the material, the sewing machine 1 rotates reversely once and then operates, thereby eliminating a problem that the sewing machine 1 stops without piercing the material.

Figure 9:
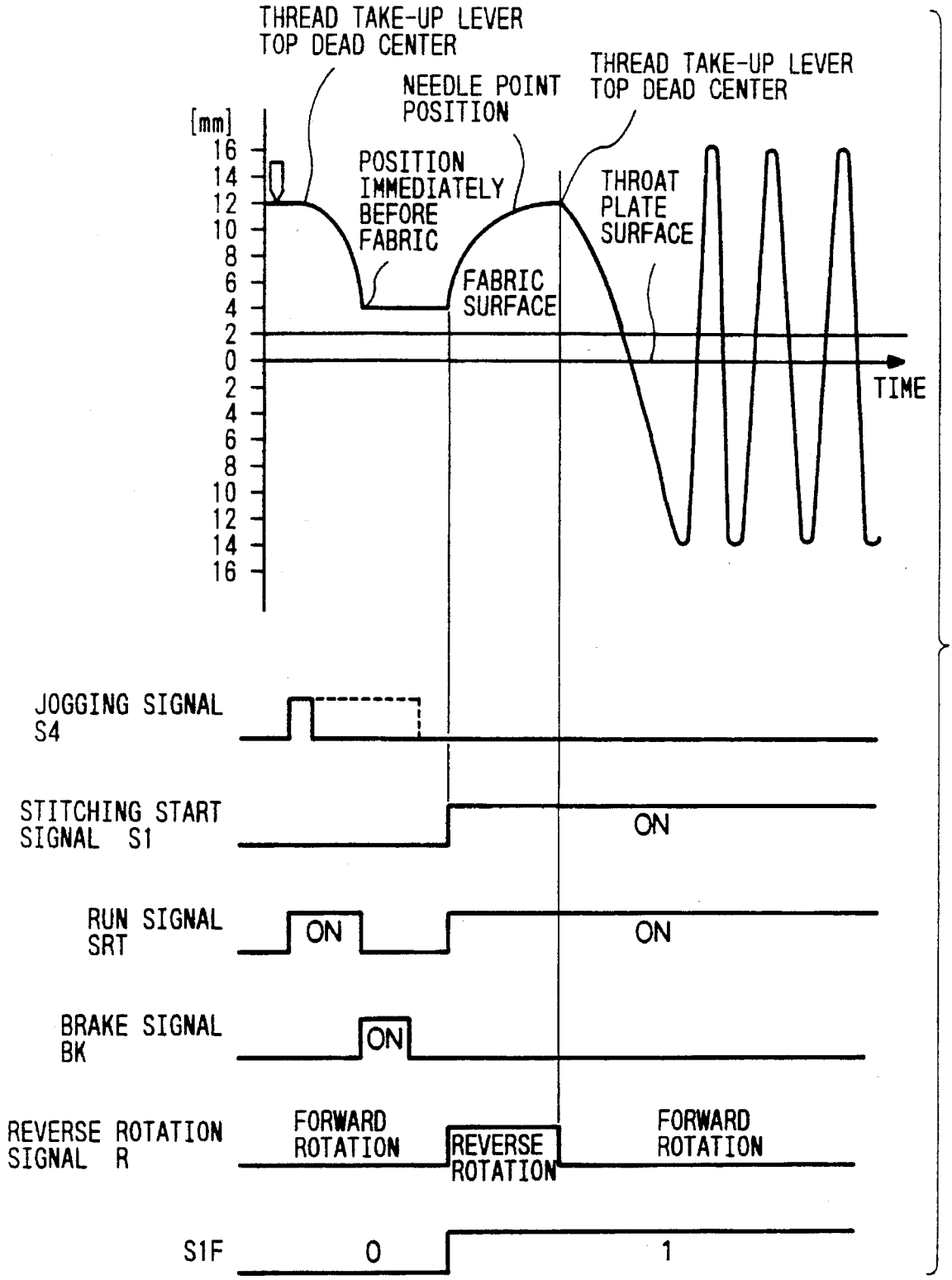
FIG. 9 is a timing chart of the fourth embodiment of the invention.

When the machine needle is at a stop at the needle UP position, i.e., 0 degrees, because the jogging signal S4 has not been provided or an even number of jogging signals S4 have been entered, the sewing machine 1 does not rotate reversely but rotates forward once since the reverse rotation flag RFLAG is 0, whereby extra reverse rotation is not made and working efficiency is high. The timing chart of this operation is shown in FIG. 9.

A fifth embodiment of the invention will now be described. The operation of the sewing machine control circuit 520 concerned with the present embodiment will be described with reference to a flowchart in FIG. 10. When the flag S1F, which stores the ON of the stitching start signal S1, is 0 at step 70, the processing proceeds to step 71. It is judged at step 71 whether or not the stitching start signal S1 has turned from OFF to ON. If it has turned from OFF to ON, the processing advances to step 80. When a delay timer is not on, the sequence progresses to step 72, where the run signal SRT is switched on and the flag S1F is set to 1.

At step 73, it is judged whether the reverse rotation flag RFLAG is 1 or not. If it is 1, the processing moves on to step 74, where the reverse rotation signal R is switched on to rotate the sewing machine reversely. If the reverse rotation flag RFLAG is 0, the reverse rotation flag R is switched off to run the sewing machine 1 forward. At step 75, it is judged whether the sewing machine 1 has rotated the set jogging angle. If the jogging angle has not been reached, the sewing machine continues reverse rotation. If the sewing machine has made the reverse rotation of the set jogging angle, the run signal SRT is switched off, the brake signal BK is switched on, the reverse rotation flag RFLAG is cleared to 0, and the brake timer and the delay timer, which sets a short stop time, are started.

Next, since the delay timer is on at step 80, the run signal SRT is switched off at step 83 and the delay timer is counted up at step 84. At step 85, it is judged whether or not the delay timer has been counted up. If not, the processing advances to step 86. If the delay time has elapsed, the sequence progresses to step 72, where operation is started. Since the reverse rotation flag RFLAG is 0 at step 73, the sequence moves on to step 81, where the reverse rotation signal R is switched off to make a forward rotation. The brake timer is counted up at step 86 and it is judged at step 87 whether the brake time has elapsed or not. If not, the brake signal BK is switched on and the reverse rotation signal R is also switched on at step 88 and the sewing machine is at a stop. After the brake time has elapsed, the brake signal BK is switched off and the reverse rotation signal R is also switched off at step 89. Then, since the delay timer has expired, the processing advances from step 80 to step 72, where the sewing machine 1 performs forward rotation.

Figure 11:
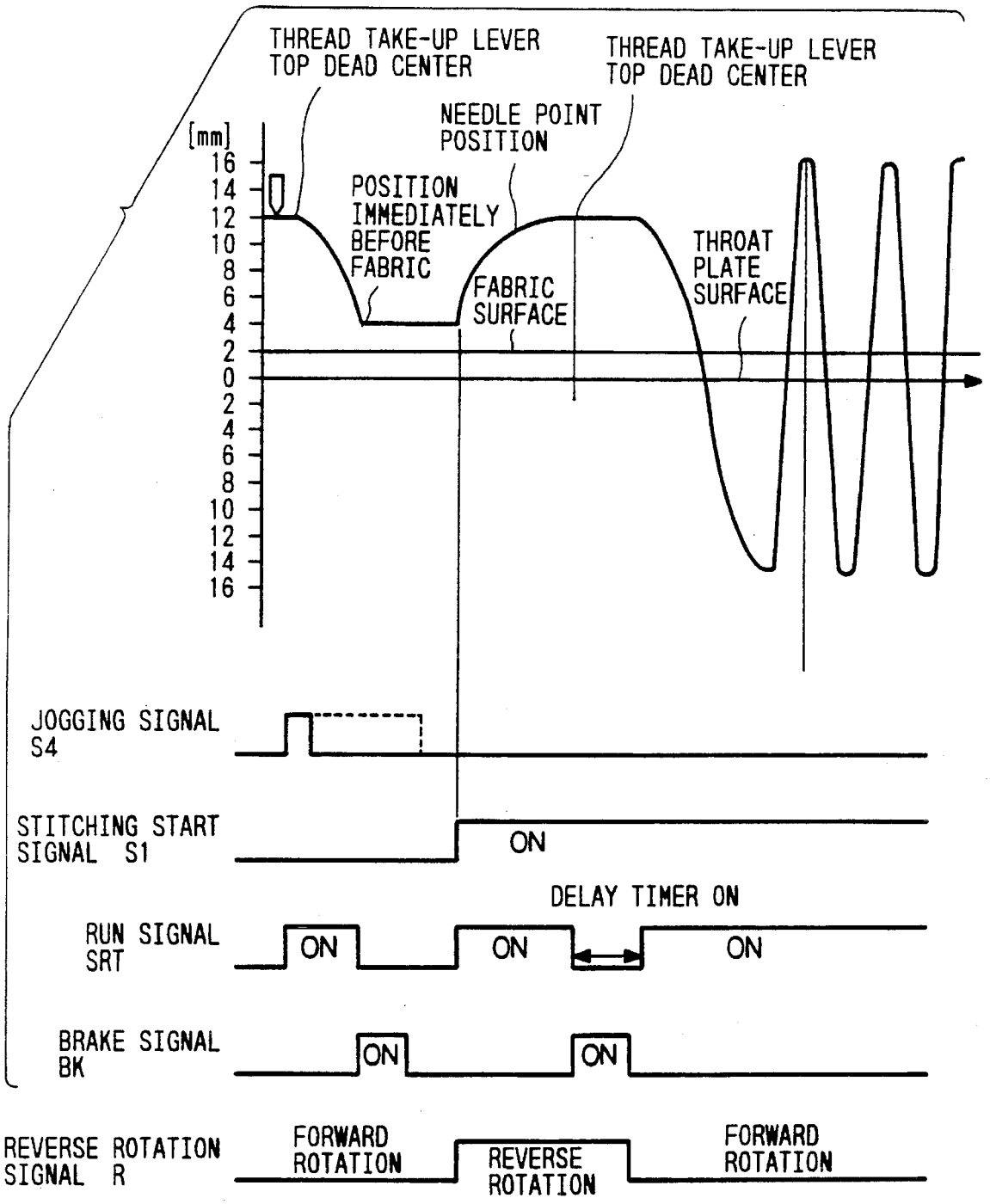
FIG. 11 is a timing chart of the fifth embodiment of the invention.

Accordingly, after making reverse rotation under the control of the stitching start signal S1, the sewing machine stops once, then rotates forward. The timing chart of this operation is shown in FIG. 11. According to the present embodiment, the sewing machine does not shift directly from reverse rotation to forward rotation, preventing the occurrence of skip stitches, etc., due to the unevenly fed machine thread.

Figure 12:
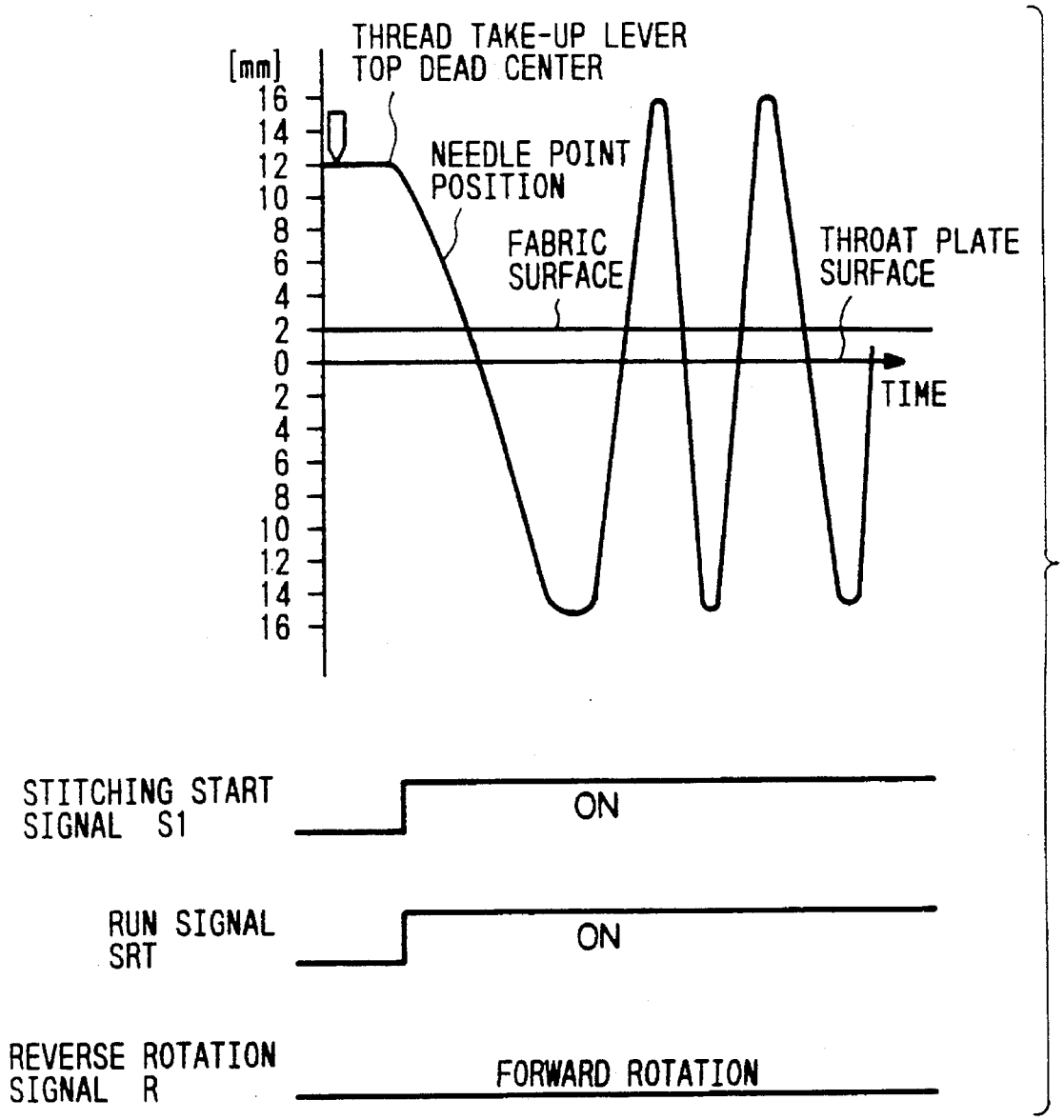
FIG. 12 is a timing chart of a sixth embodiment of the invention.

A sixth embodiment of the invention will now be described. FIG. 12 shows operation wherein the jogging signal S4 has not been provided in the sewing machine controlling method described in Embodiment 5. When the stitching start signal S1 is entered, the run signal SRT is switched on and forward rotation is performed because the reverse rotation signal R is off. The reason is that since the inversion of the reverse rotation flag RFLAG at step 63 in FIG. 10 is not made when the jogging signal S4 is not given, the reverse rotation signal RFLAG is 0, whereby the reverse rotation flag RFLAG is judged to be 0 at step 73 and the reverse rotation signal R is switched off at step 81 to start the sewing machine running in the forward direction and therefore working efficiency is improved.

Figure 13:
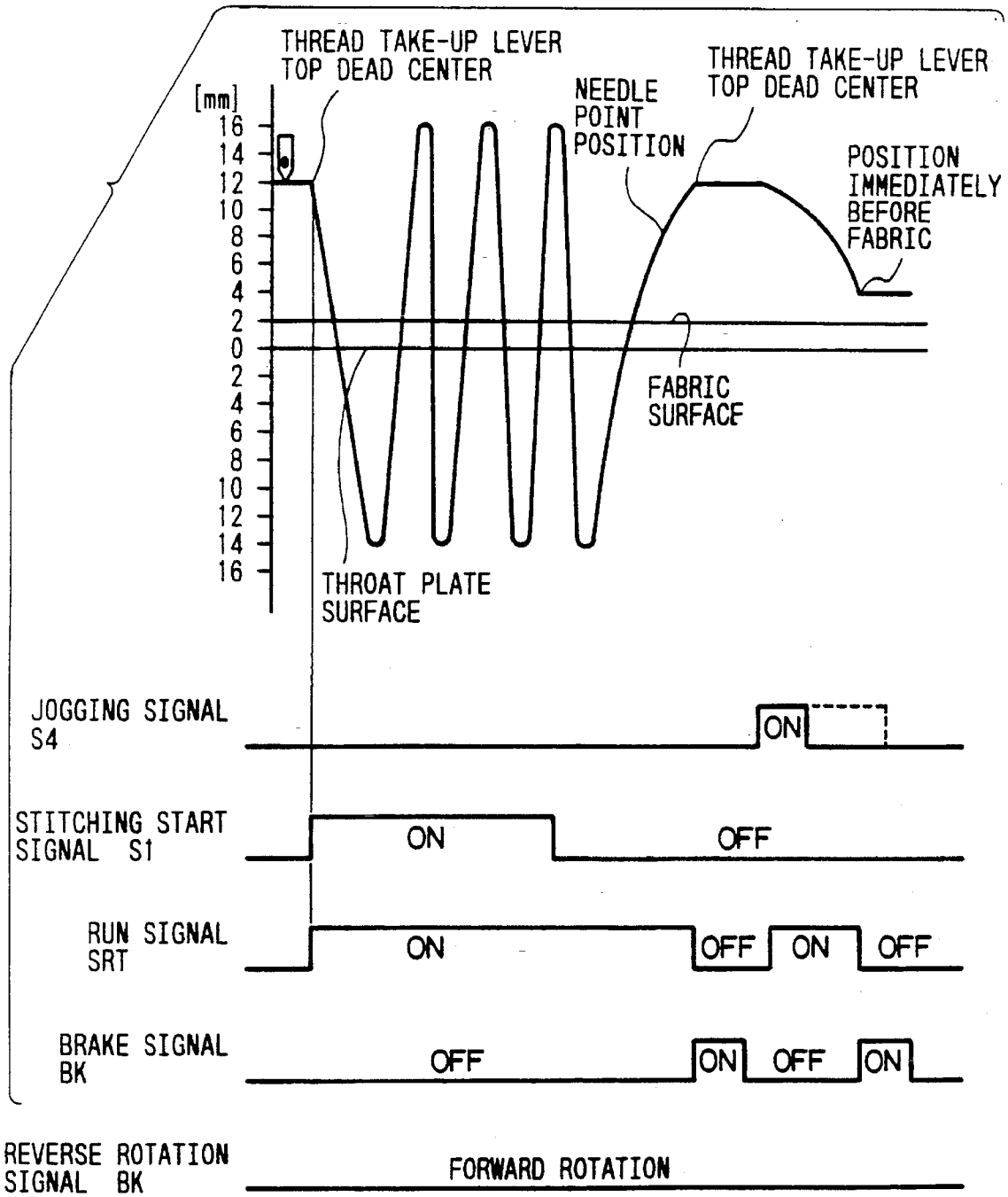
FIG. 13 is a timing chart of a seventh embodiment of the invention.

A seventh embodiment of the invention will now be described. FIG. 13 shows that operation starts with forward rotation whenever the jogging signal S4 is entered after the sewing machine 1 has run under the control of the stitching start signal S1 in the sewing machine controlling method described in Embodiment 5. Switching on the jogging signal S4 rotates the sewing machine in the forward direction, independently of whether the sewing machine 1 has jogged in the forward direction or in the reverse direction before the stitching start signal S1 was entered. The reason is that since the reverse rotation flag RFLAG is cleared at step 82 at the input time of the stitching start signal S1, the reverse rotation flag RFLAG is 0 at step 60 when the next jogging signal S4 is switched on, and therefore the reverse rotation signal R is switched off at step 61.

When the jogging signal S4 is entered, the apparatus according to this embodiment always rotates the jogging angle in the forward direction, improving working efficiency.

Figure 14:
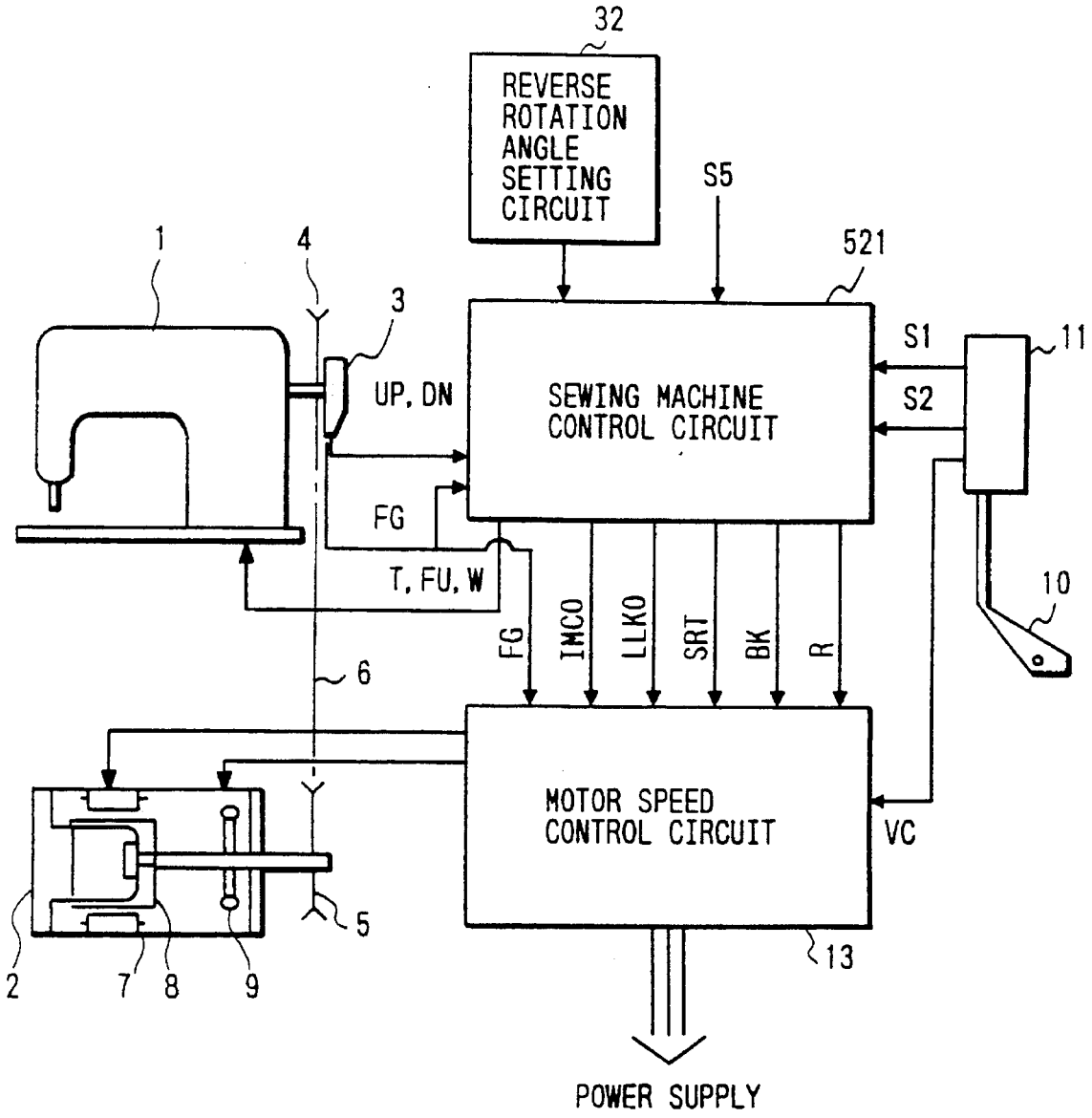
FIG. 14 is an arrangement diagram of a sewing machine controlling apparatus illustrating an eighth embodiment of the invention.
Figure 15:
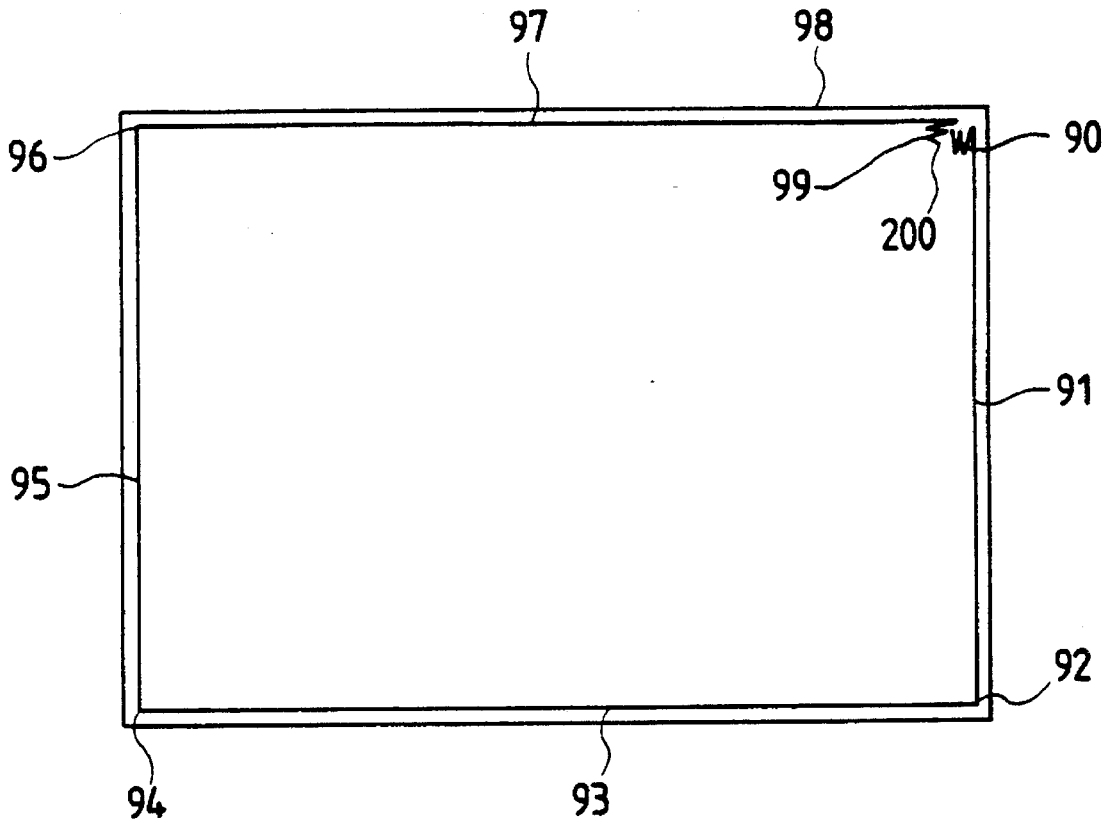
FIG. 15 is a diagram showing a stitching pattern of the eighth embodiment of the invention.

An eighth embodiment of the invention will now be described. FIG. 14 is an arrangement diagram of a sewing machine controlling apparatus concerned with the present embodiment, wherein 32 indicates a reverse rotation angle setting circuit serving as reverse rotation angle setting means, S5 designates a reverse rotation signal, and 521 represents a sewing machine control circuit detailed in FIG. 16. When a material 98 as shown in FIG. 15 is to be stitched by a blind stitching machine, for example, start backtacking is done at portion 90 and first straight stitching is made at portion 91 under the control of the stitching start signal S1. When the stitching start signal S1 is switched off, the sewing machine stops at the needle DOWN position once at portion 92, but the blind stitching machine does not allow the direction of the material to be changed unless reverse-rotation needle UP is carried out. Accordingly, the reverse rotation signal S5 is switched on at portion 92 to perform reverse-rotation needle UP. It is to be understood that reverse-rotation needle UP indicates that the machine needle is raised in the reverse rotation.

Likewise, second, third and fourth straight stitchings are done at portions 93, 95 and 97, respectively. As at portion 92, the reverse-rotation needle UP is performed at portions 94 and 96 to change the direction of the material. Under the control of the thread trimmer start signal S2, end backtacking is carried out at portion 99, which is followed by reverse-rotation needle UP at portion 200 because the material 98 cannot be removed from the sewing machine 1 without doing the reverse-rotation needle UP. Therefore, reverse-rotation needle UP is performed by the reverse rotation signal S5, and end backtacking and reverse-rotation needle UP are done by the jogging signal.

Figure 16:
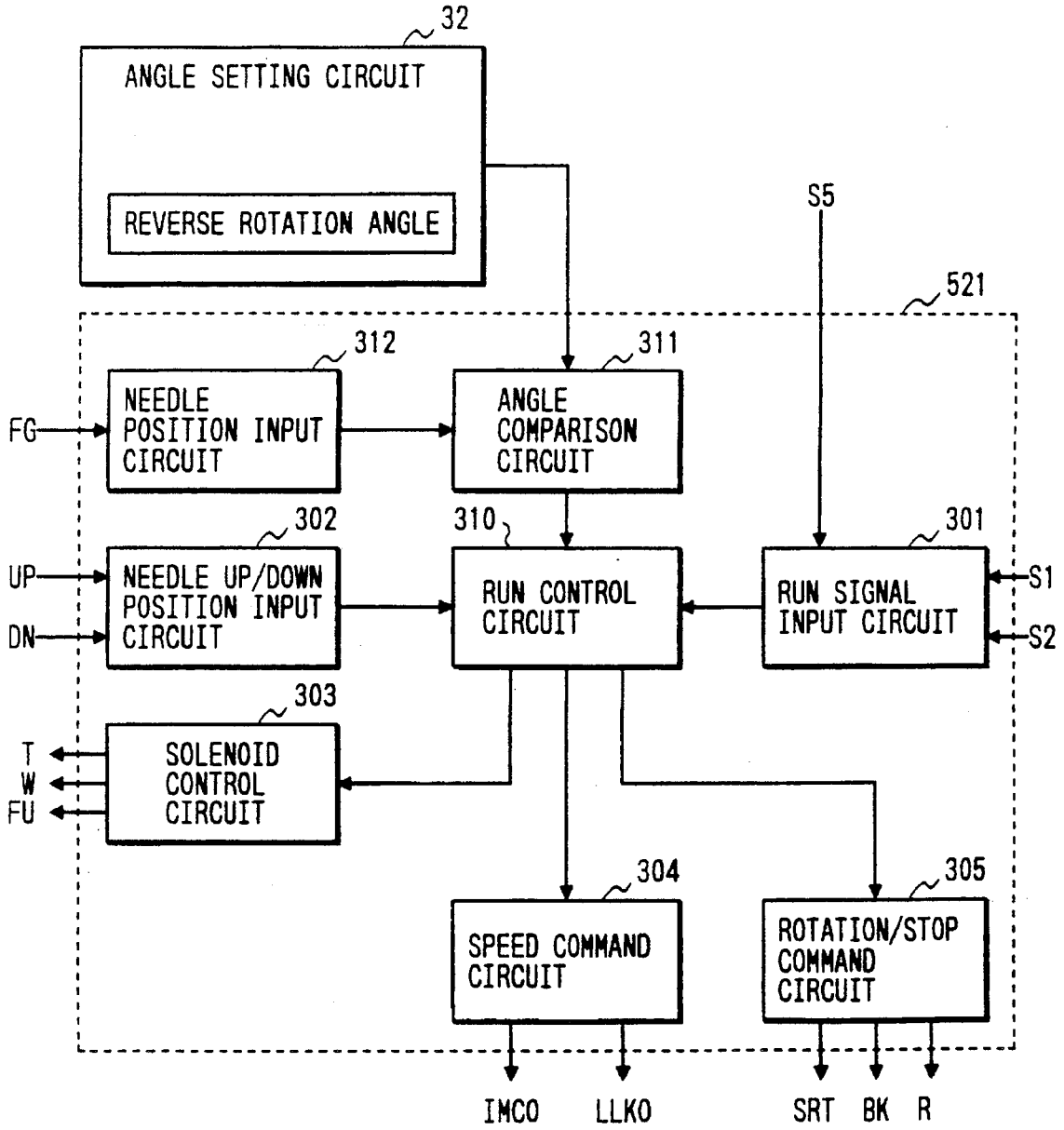
FIG. 16 is a detail drawing of a sewing machine control circuit shown in FIG. 14.

The operation of the sewing machine control circuit 521 will now be described in accordance with a block diagram in FIG. 16. When the reverse rotation signal S5 is switched on, the run control circuit 310 switches the run signal SRT on and the reverse rotation signal R on via the run signal input circuit 301 to start the motor 1 reversing.

At this time, the reverse rotation angle set to the reverse rotation angle setting circuit 32 is compared by the angle comparison circuit 311 with the rotary angle of the sewing machine 1 entered into the needle position input circuit 312 from the needle position detection signal FG given by the needle position detector 3. When the sewing machine 1 has rotated the set reverse rotation angle or more in the reverse direction, the run control circuit 310 causes the rotation/stop command circuit 305 to switch the run signal SRT off and the brake signal BK on to stop the sewing machine 1.

Figure 17:
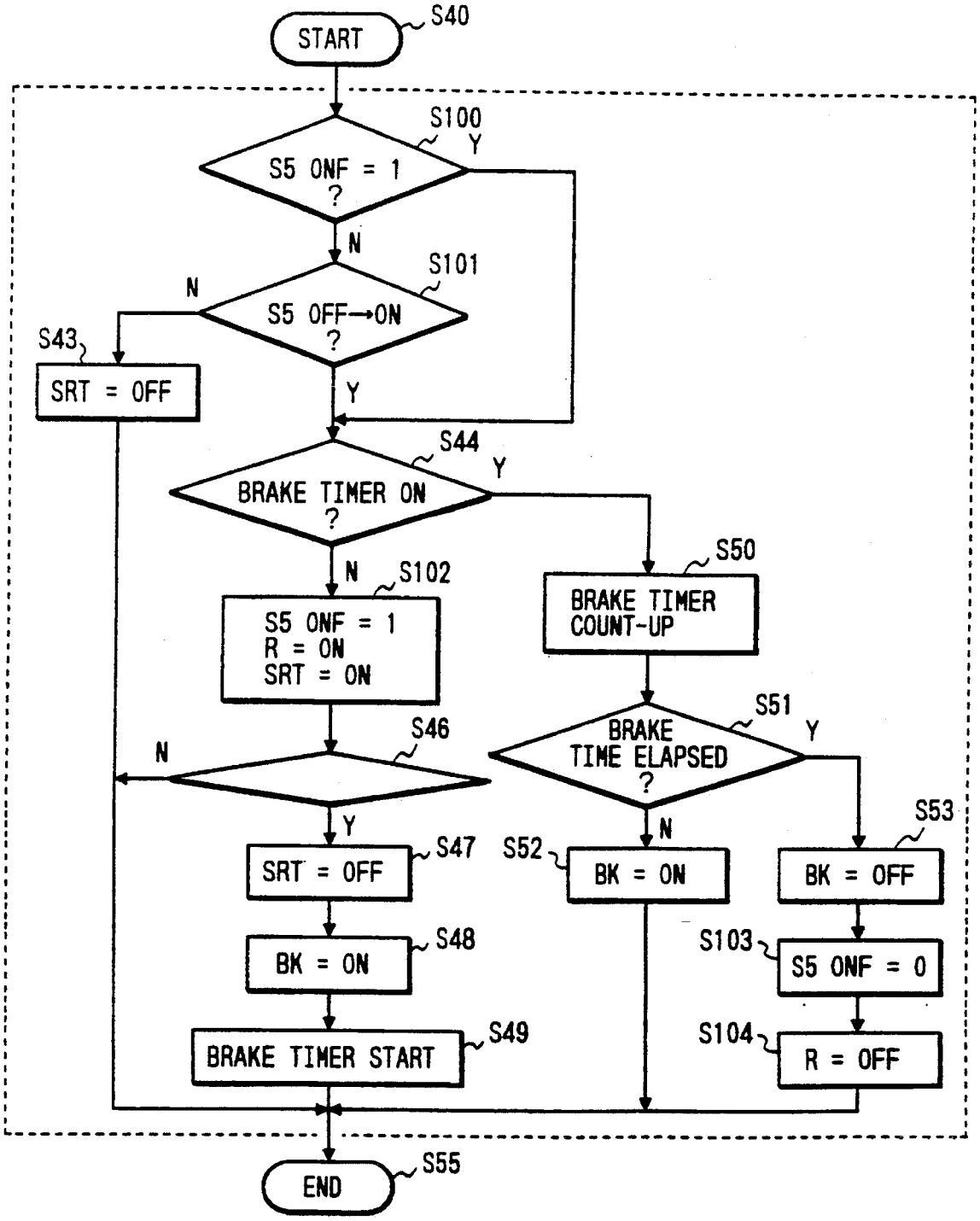
FIG. 17 is a flowchart illustrating the operation of the eighth embodiment of the invention.

FIG. 17 is a software flowchart for said reverse rotation needle UP. In FIG. 17, S5ONF indicates a flag which stores that the reverse rotation signal S5 has been switched on once. At step 100, it is judged whether the flag S5ONF is 1 or 0. If it is 0, the processing goes forward to step 101. If the reverse rotation signal S5 does not turn from OFF to ON, the run signal SRT is switched off at step 43 to stop the sewing machine 1. When the reverse rotation signal S5 has turned from OFF to ON at step 101, the sequence advances to step 44. When the brake timer is not on, the sequence proceeds to step 102, where the flag S5ONF is set to 1, the reverse rotation signal R is switched on and the run signal SRT is switched on to rotate the sewing machine 1 reversely. At step 46, it is judged whether or not the sewing machine 1 has reversed the set reverse rotation angle. If not, the sewing machine 1 performs reverse rotation. If the sewing machine 1 has reversed the set reverse rotation angle, the processing progresses to step 47, where the run SRT signal is switched off and the brake signal BK is switched on. At step 49, the brake timer is started.

Figure 18:
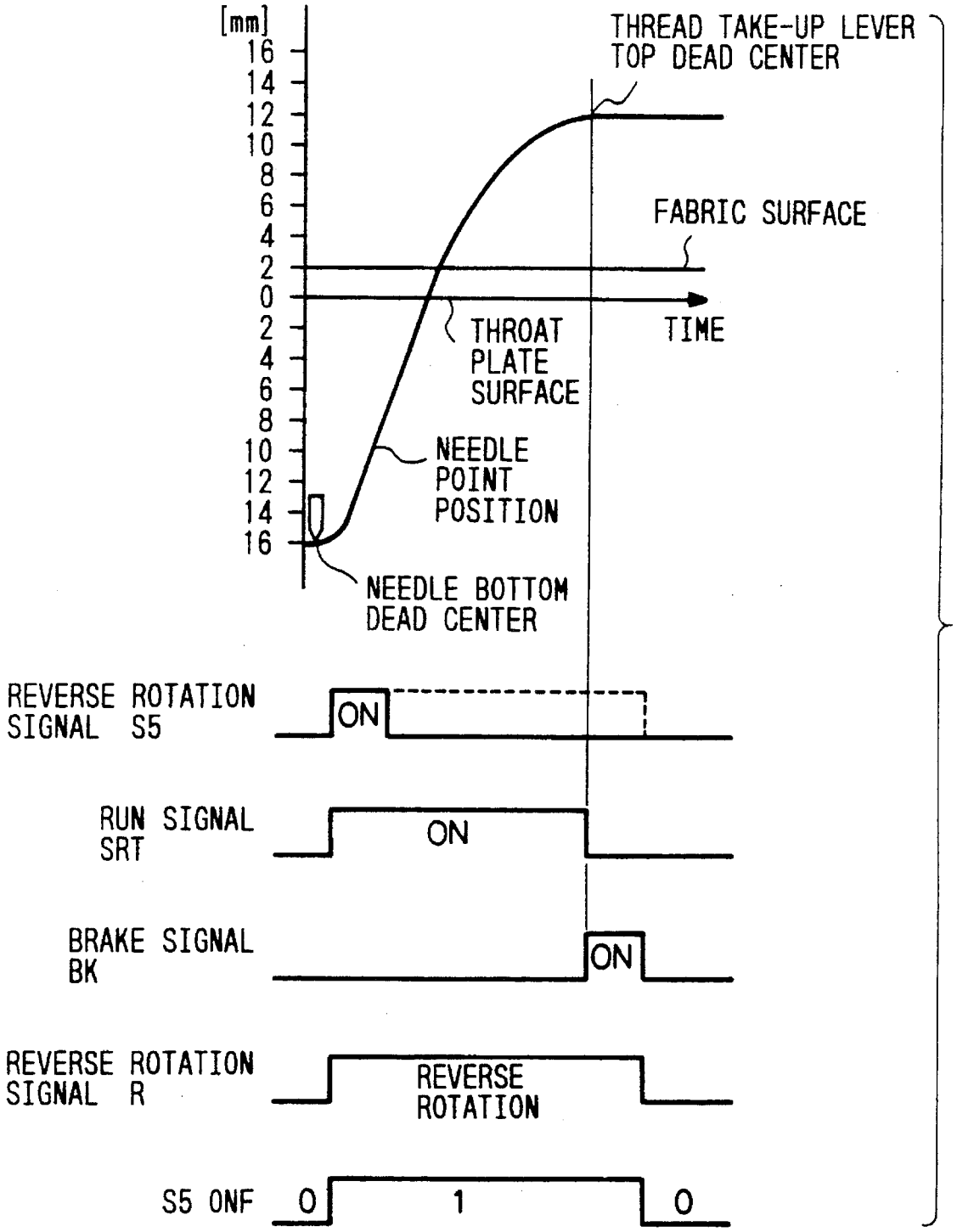
FIG. 18 is a timing chart of the eighth embodiment of the invention.

Since the brake timer is on at step 44, the sequence moves on to step 50, where the brake timer is counted up. At step 51, it is judged whether or not the brake time has elapsed. If not, the brake signal BK is switched on at step 52. If the brake time has elapsed, the brake signal BK is switched off at step 53, the flag S5ONF is set to 0 at step 103, and the reverse rotation signal R is switched off at step 104. As a result, the reverse rotation signal S5 causes the sewing machine 1 to reverse the set reverse rotation angle and come to a stop. This timing chart is shown in FIG. 18. After the sewing machine 1 has reversed the reverse rotation angle set to the reverse rotation angle setting circuit 32, the operator toes down the foot pedal 10 to enter the stitching start signal S1 into the sewing machine control circuit 520, and as in said conventional example, the run signal SRT is output to the motor speed control circuit 13 and the sewing machine 1 performs predetermined operation. When thread trimmer operation is required, heeling the foot pedal 10 causes the sewing machine 1 to perform the operation as in said conventional example to cut the machine threads. The apparatus in the present embodiment allows the reverse-rotation needle UP operation to be performed when the direction of the material is changed on the blind stitching machine, improving working efficiency.

Figure 19:
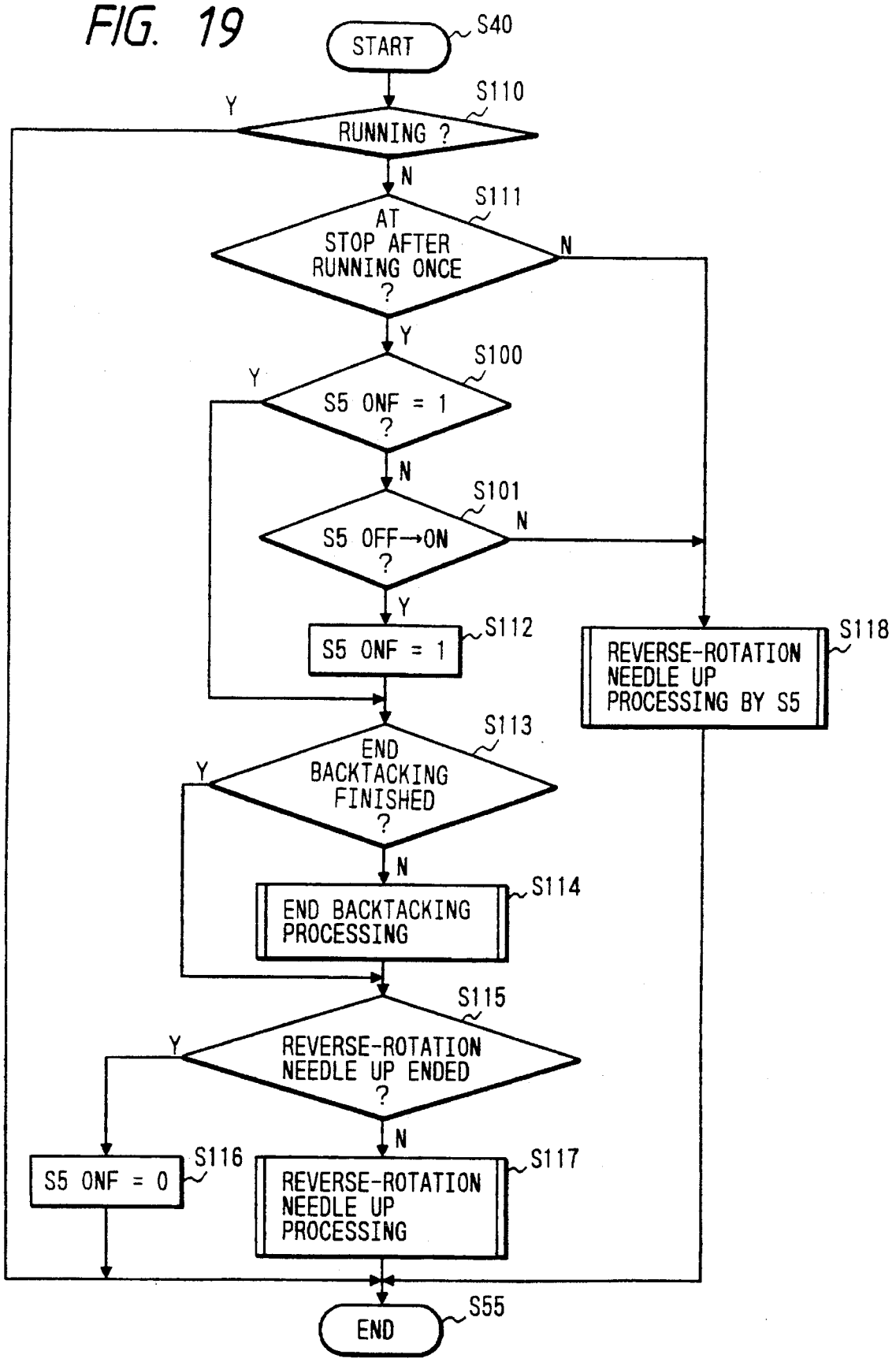
FIG. 19 is a flowchart illustrating the operation of a ninth embodiment of the invention.

A ninth embodiment of the invention will now be described. FIG. 19 is a software flowchart of the sewing machine control circuit 521 concerned with Embodiment 9. This mainly represents the processing performed at portions 99 and 200 in FIG. 15. At step 110, it is judged whether the sewing machine 1 is being run or not. If the sewing machine 1 is being run, operation by the reverse rotation signal S5 is not performed. If the sewing machine 1 is at a stop, the processing proceeds to step 111, where it is judged whether or not the sewing machine 1 is at a stop after it has run once. If not, the sequence advances to step 118, where reverse rotation needle UP processing is performed when the reverse rotation signal S2 is entered. If the sewing machine 1 is at a stop after it has run once, the processing progresses to step 100. If the flag S2ONF, which stores that the reverse rotation signal S5 has switched on once, is 1, the processing moves on to step 113. If the flag S2ONF is 0, the sequence moves forward to step 101. When the reverse rotation signal S5 has not turned from OFF to ON, the processing advances to step 118. When the reverse rotation signal S5 has turned from OFF to ON, the flag S2ONF is set to 1 at step 112. At step 113, it is judged whether or not end backtacking has finished. If not, the sequence proceeds to step 114, where end backtacking processing is done. If end backtacking has ended at step 113, the sequence advances to step 115, where it is judged whether or not reverse rotation needle UP has ended. If not, reverse rotation needle UP is performed. It reverse rotation needle UP has finished, the flag S2ONF is set to 0.

Figure 20:
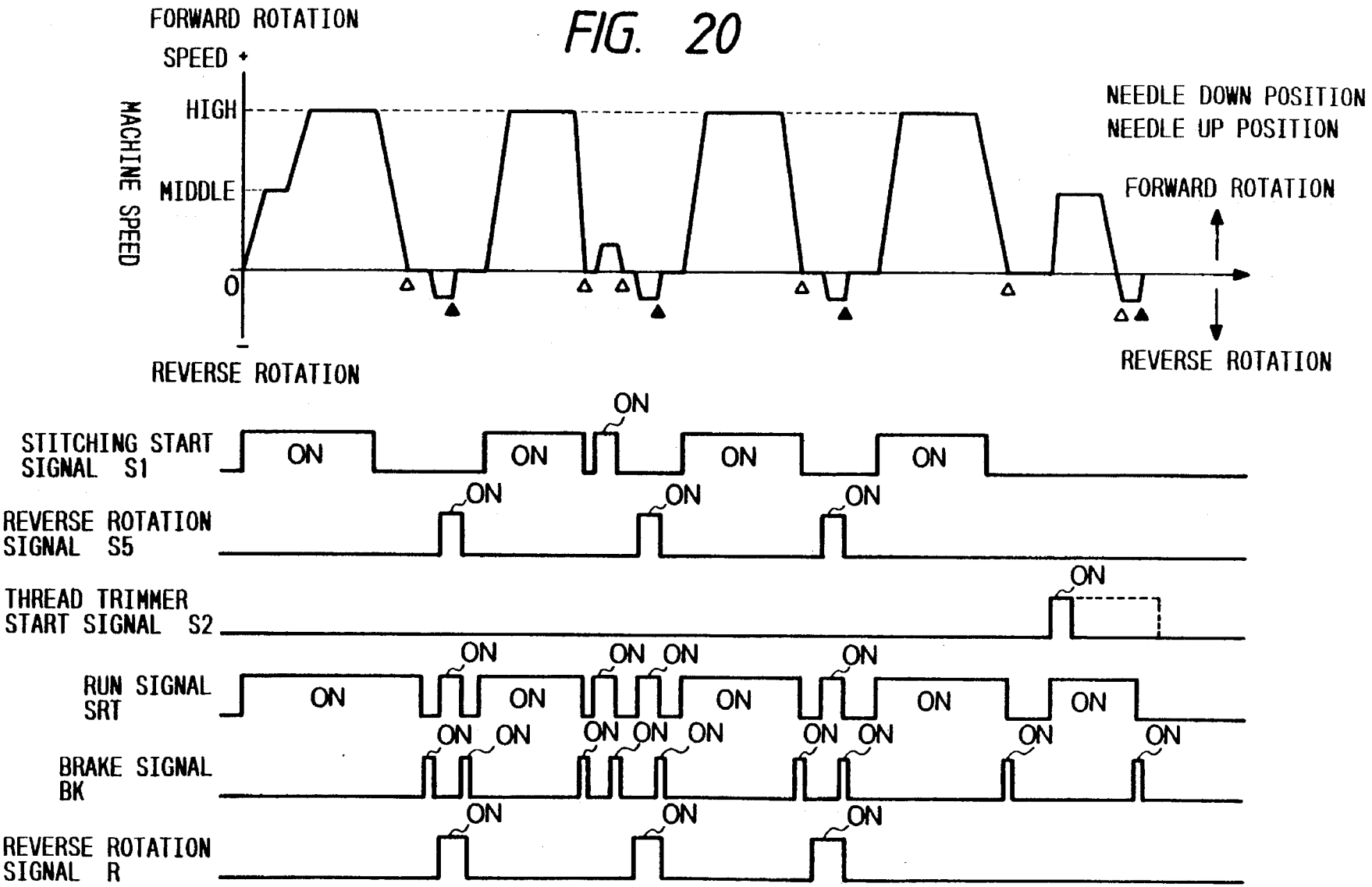
FIG. 20 is a timing chart of the ninth embodiment of the invention.

As described above, when the reverse rotation signal S5 is on, end backtacking is done, reverse rotation needle UP follows, and after a stop, the material can be removed. FIG. 20 shows the timing chart of the above operation. The apparatus in the present embodiment allows either the reverse-rotation needle UP or the end backtacking and reverse-rotation needle UP to be done, improving working efficiency.

Figure 21:
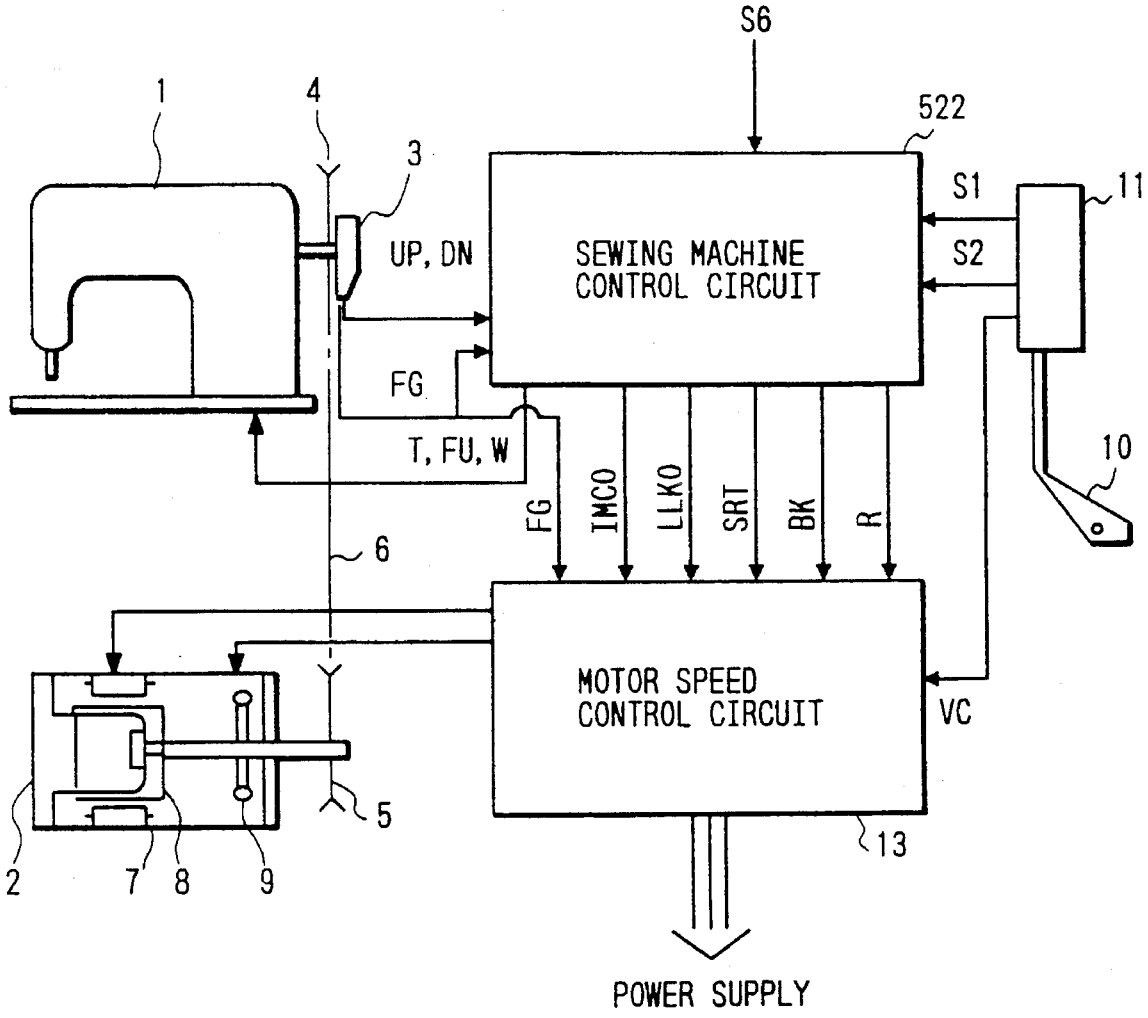
FIG. 21 is an arrangement diagram of a sewing machine controlling apparatus illustrating an embodiment of a tenth embodiment of the invention.
Figure 22:
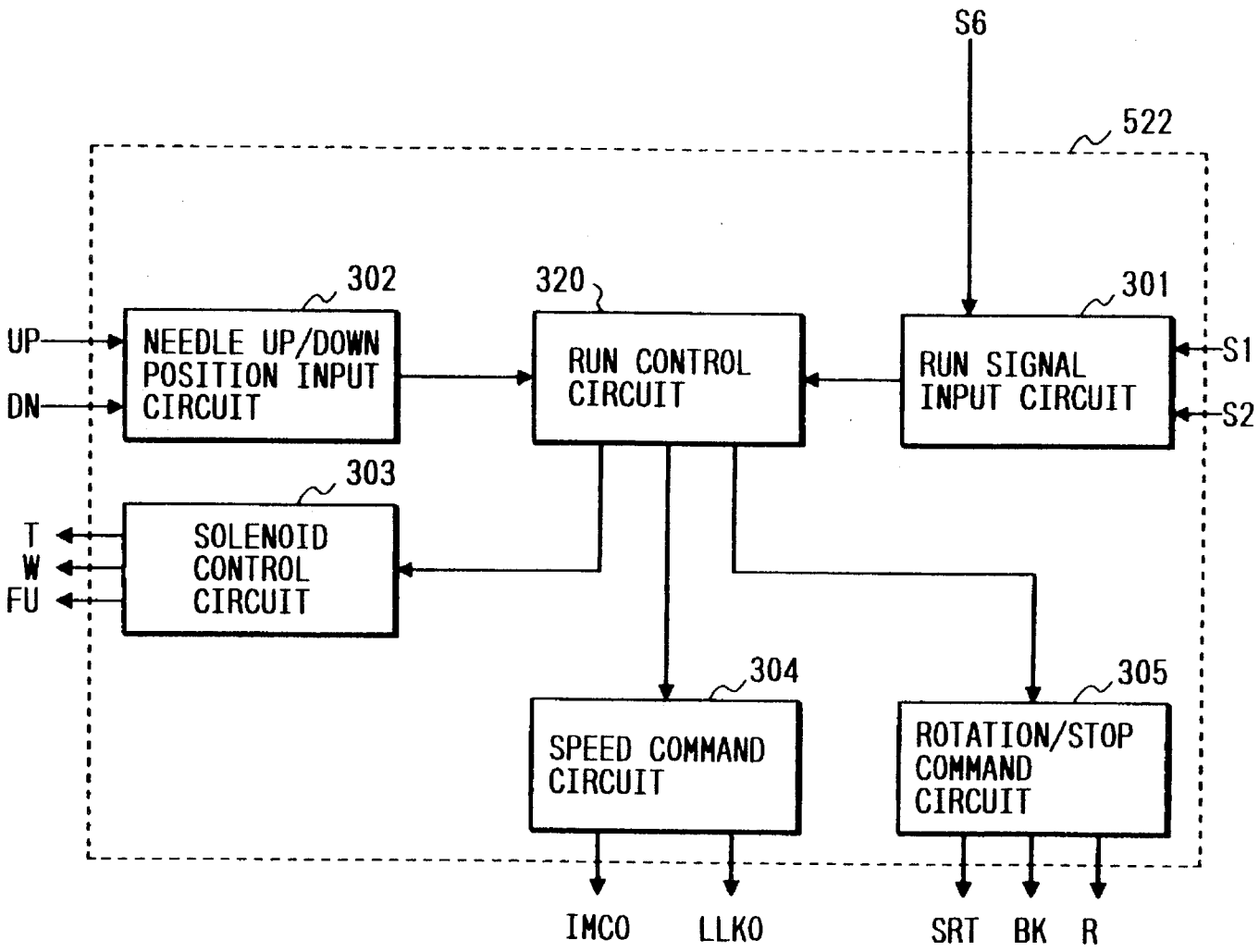
FIG. 22 is a detail drawing of a sewing machine control circuit shown in FIG. 21.
Figure 64:
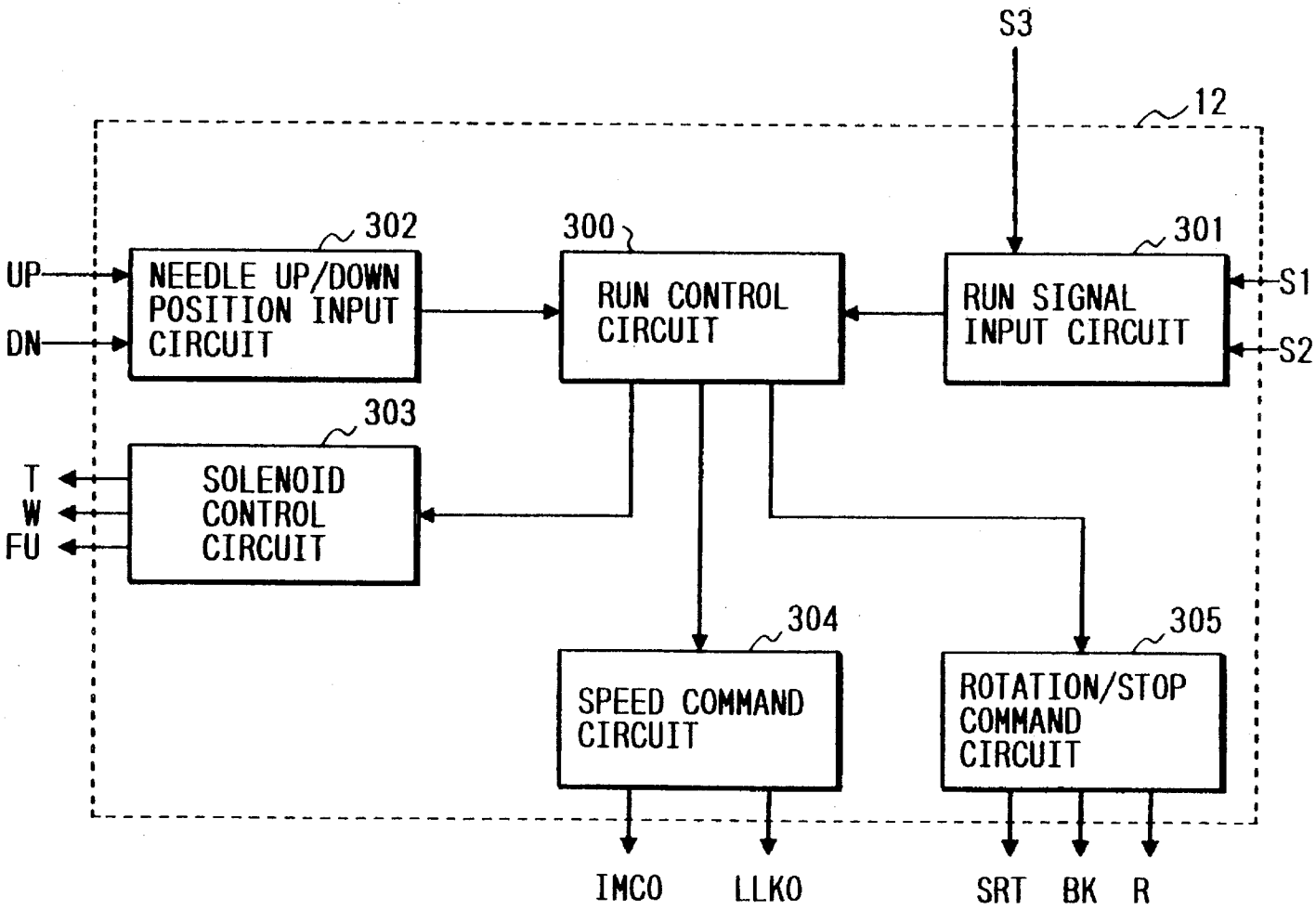
FIG. 64 is a detail drawing of a sewing machine control circuit shown in FIG. 62.
Figure 65:
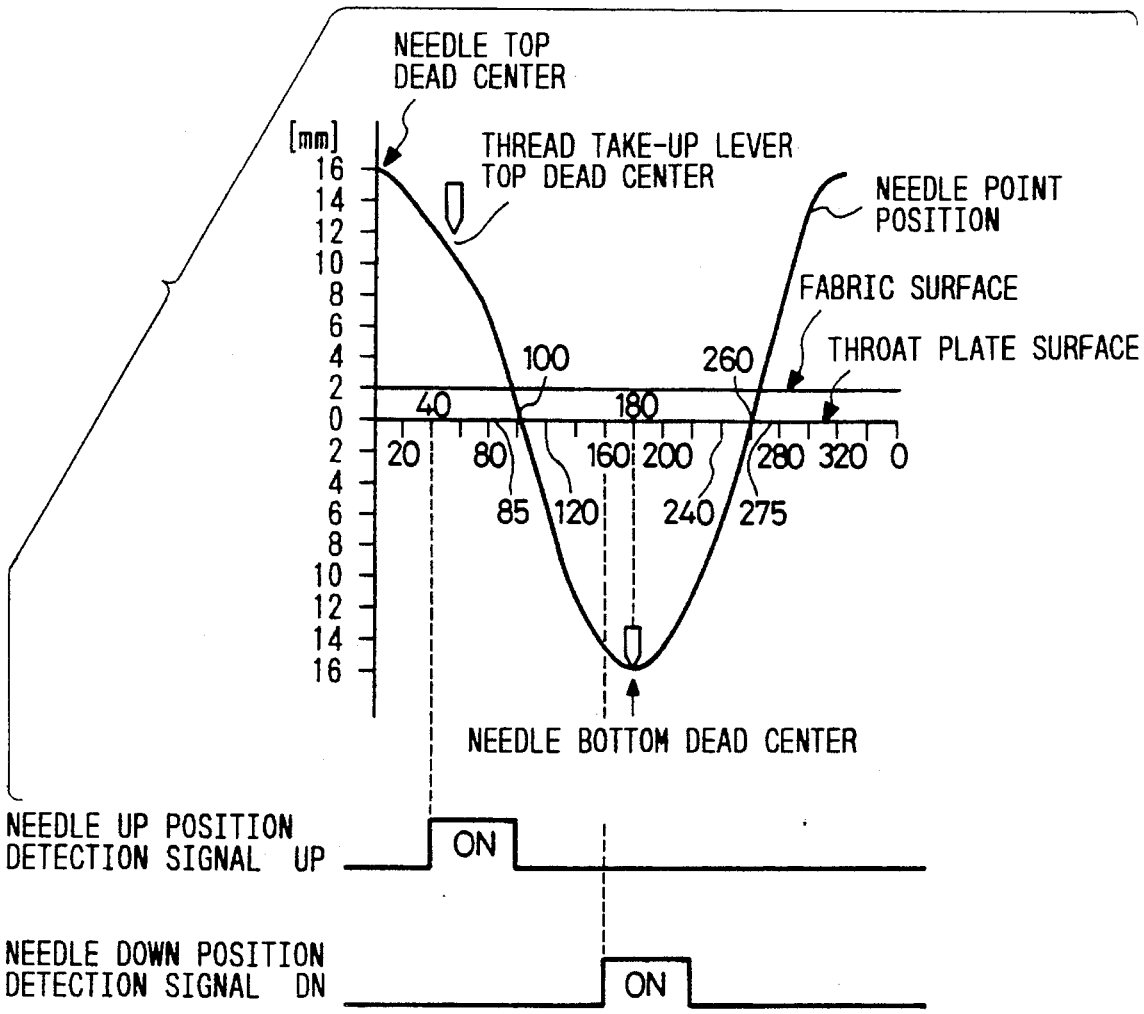
FIG. 65 is a diagram showing an example of the needle bar motion of the sewing machine.

A tenth embodiment of the invention will now be described. FIG. 21 shows a sewing machine controlling apparatus concerned with the present embodiment which operates under the control of a second needle UP signal. Unlike the needle UP signal S3 in said conventional apparatus, this second needle UP signal raises the machine needle from its then position independently of the rotation direction of the machine needle and will be described later in detail. In this drawing, 522 indicates a sewing machine control circuit detailed in FIG. 22 and S6 is a second needle UP signal. The other parts are identical to those in the conventional apparatus shown in FIG. 64 and will not be described. It is to be noted that the sewing machine control circuit 522 is different in operation sequence of the run control circuit 320 from the one in the conventional example in FIG. 64.

Figure 23:
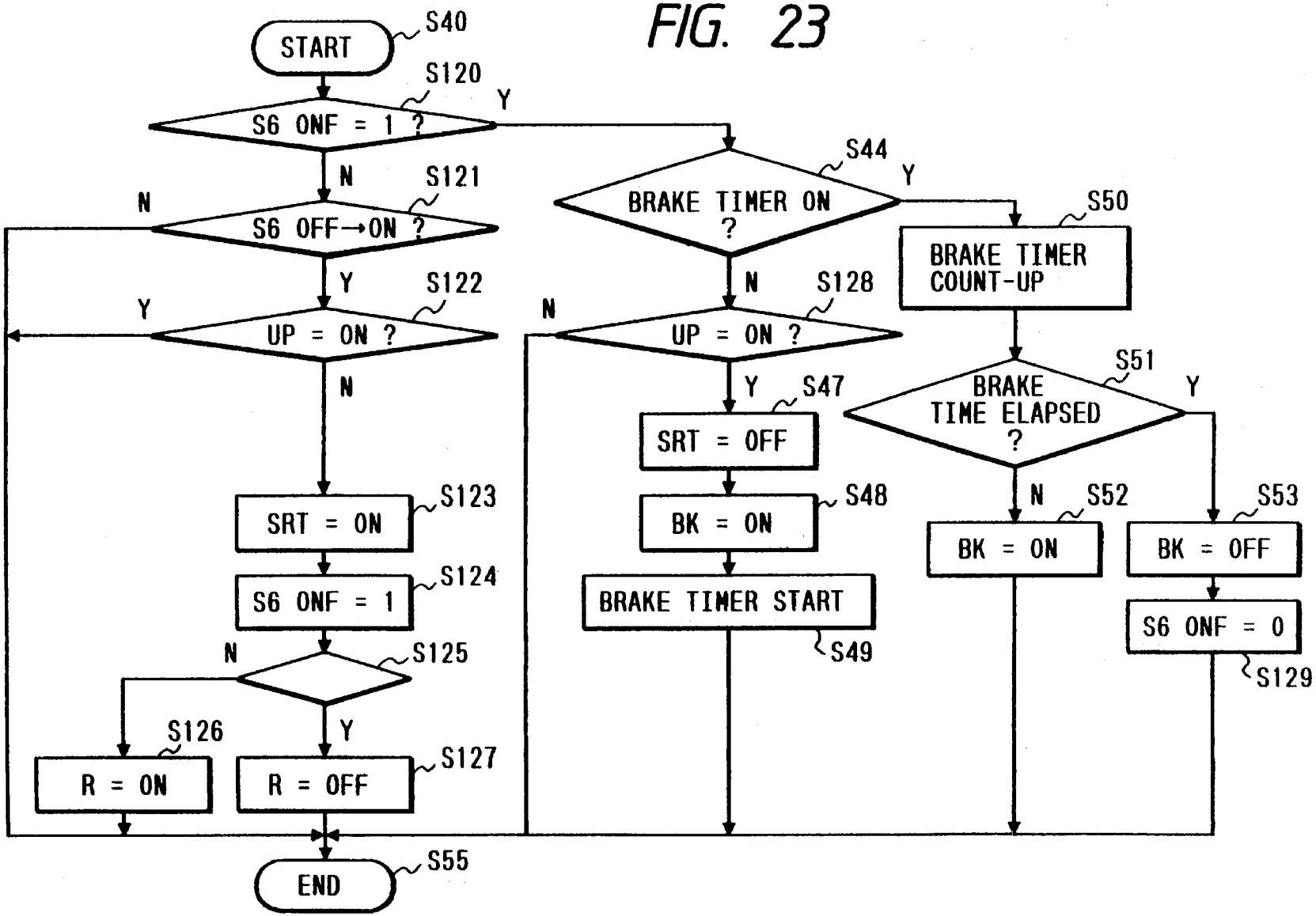
FIG. 23 is a flowchart illustrating the operation of the tenth embodiment of the invention.
Figure 24:
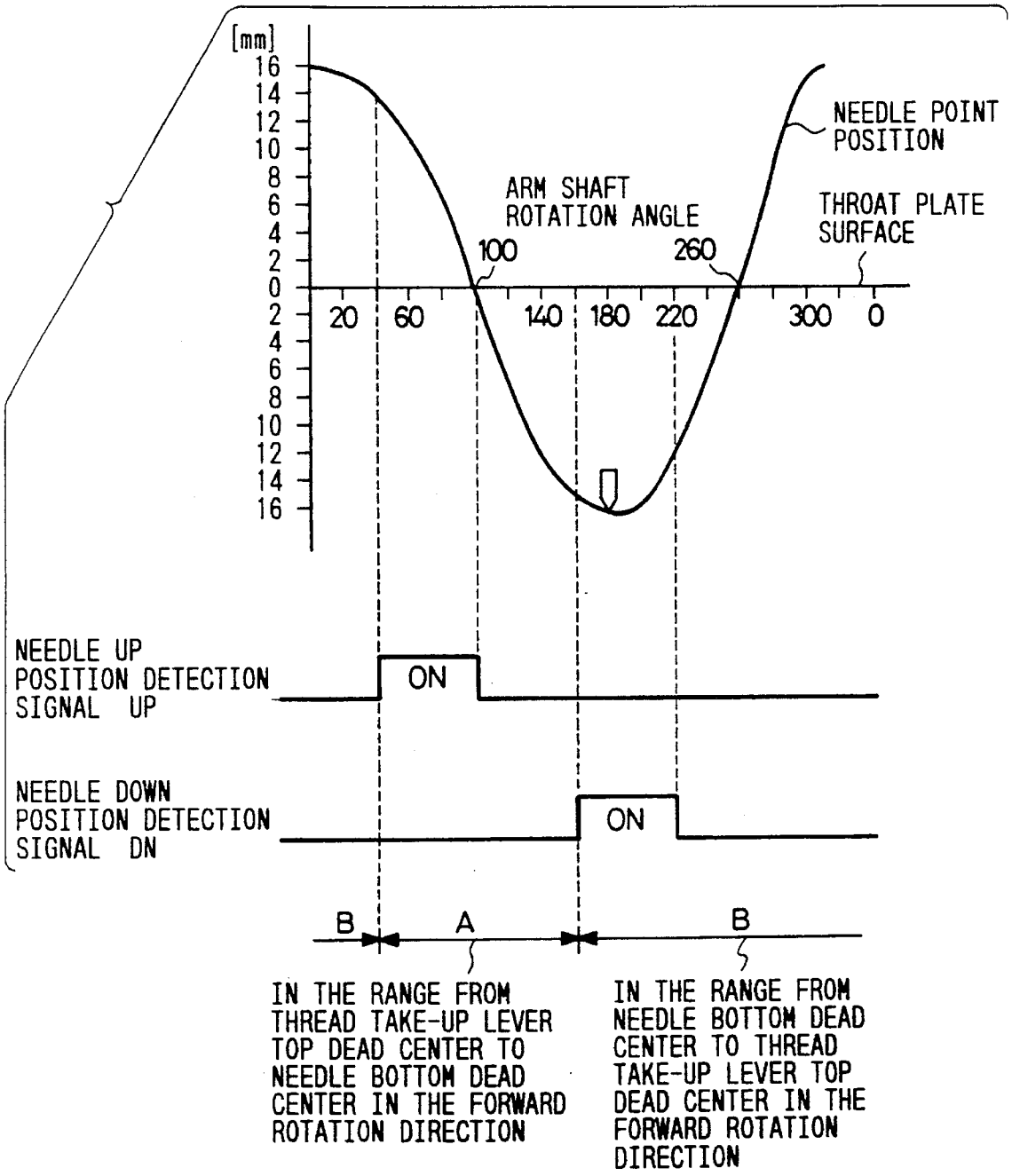
FIG. 24 is a needle bar motion diagram of the tenth embodiment of the invention.

FIG. 23 is a software flowchart of the sewing machine control circuit 522, wherein S6ONF is a flag which stores whether or not the second needle UP signal S6 has turned on once. If the flag S6ONF is 0 at step 120, the processing advances to step 121. When the second needle UP signal S6 has turned from OFF to ON, the sequence proceeds to step 122, where it is judged whether or not the needle UP signal UP is on. If not on, the run signal SRT is switched on at step 123 and the flag S6ONF is set to 1 at step 124. When the machine needle is in a range from the UP position to the DOWN position in the forward rotation direction, i.e., in area A in FIG. 24, at step 125, the reverse rotation signal R is switched on at step 126. When the machine needle is in a range from the DOWN position to the UP position in the forward rotation direction, i.e., in area B in FIG. 24, the reverse rotation signal R is switched off at step 127. Since the flag S6ONF is 1 at step 124, the sequence then moves to step 44 at step 120. Since the brake timer is not on, the processing progresses to step 128, where the sewing machine rotates under the control of the reverse rotation signal R set at step 126 or 127 until the UP position signal UP is switched on.

Figure 25:
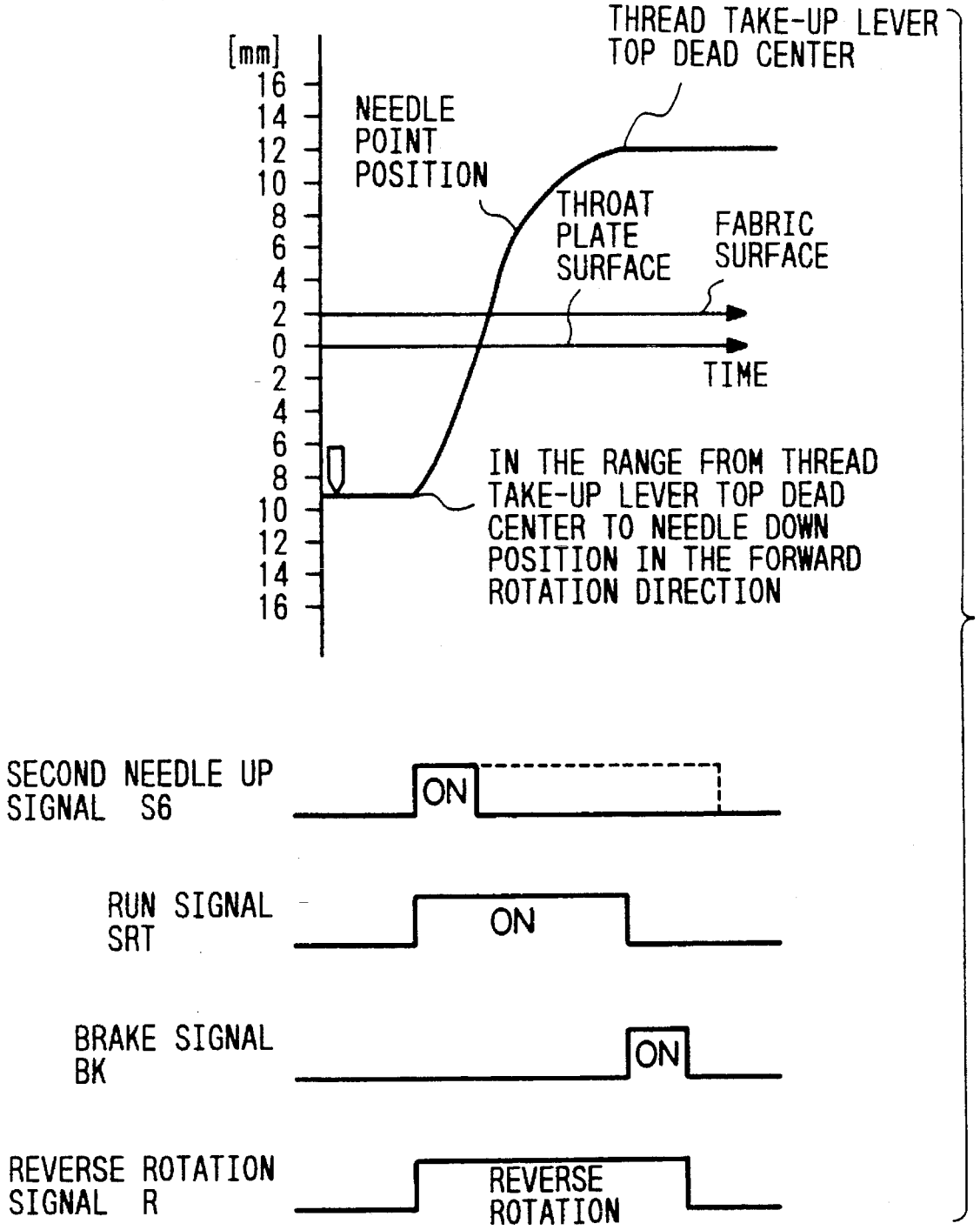
FIG. 25 is a timing chart at the time of reverse-rotation needle UP in the tenth embodiment of the invention.
Figure 26:
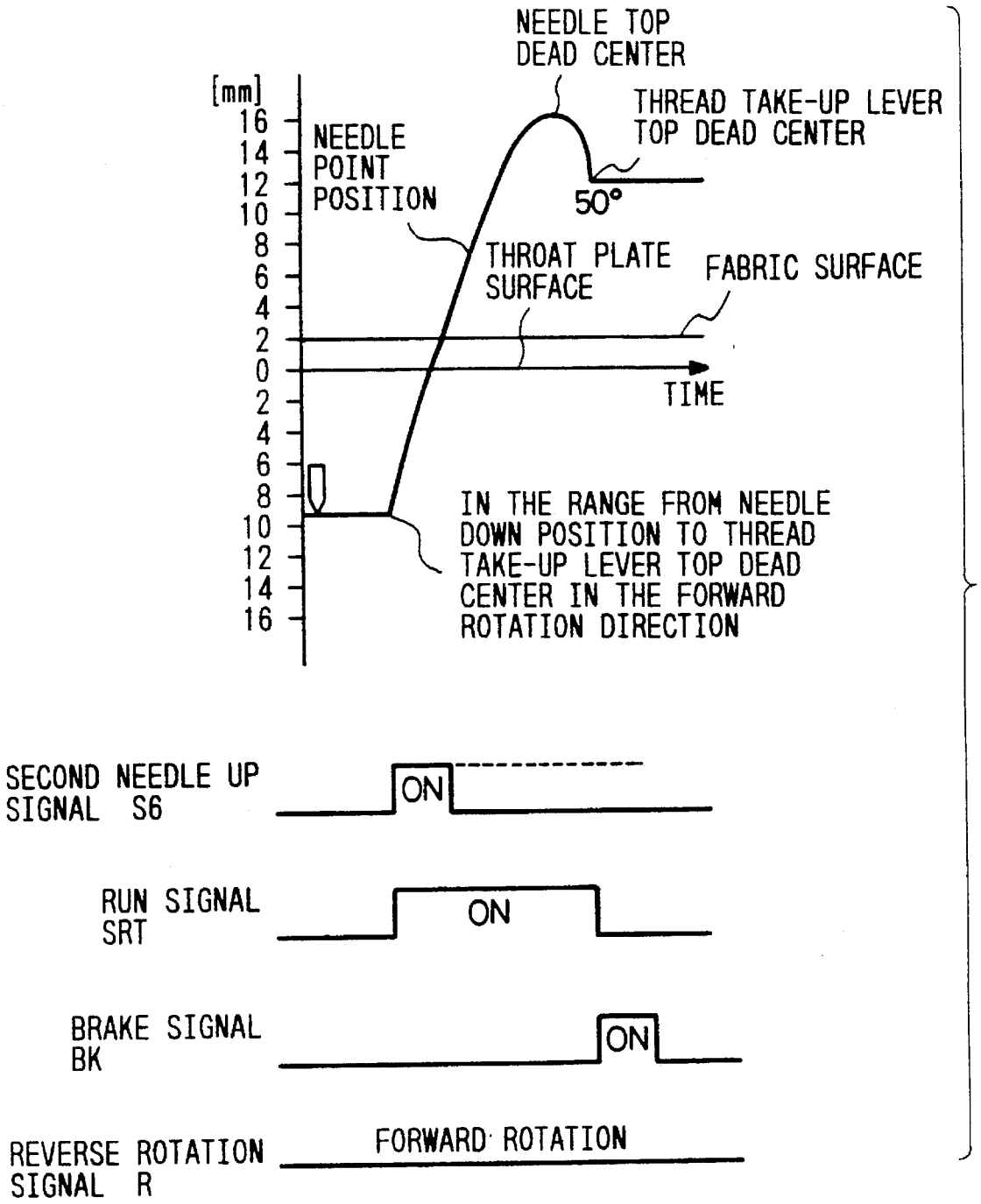
FIG. 26 is a timing chart at the time of forward-rotation needle UP in the tenth embodiment of the invention.

FIG. 25 is a timing chart at a time when the machine needle is in the range from the UP position to the DOWN position in the forward rotation direction. Namely, when the machine needle is in area A in FIG. 24, the reverse rotation signal R is switched on at step 126, whereby the machine needle is rotated in the reverse direction and stops at the UP position. FIG. 26 is a timing chart at a time when the machine needle is in the range from the DOWN position to the UP position in the forward rotation direction. Namely, when the machine needle is in area B in FIG. 24, the reverse rotation signal R is switched off at step 127, whereby the machine needle is rotated in the forward direction and stops at the UP position. When stitching, for example, is started after the machine needle has stopped at the UP position, the operator toes down the foot pedal 10 to enter the stitching start signal S1 into the sewing machine control circuit 520, and as in said conventional example, the run signal SRT is output to the motor speed control circuit 13 and the sewing machine 1 performs predetermined operation. When thread trimmer operation is required, heeling the foot pedal 10 causes the sewing machine 1 to perform the operation as in the conventional example to cut the machine threads. The apparatus in the present embodiment allows reverse rotation needle UP to be performed before the material is pierced with the machine needle and forward rotation needle UP to be performed after the material is pierced with the machine needle, thereby preventing the material from being seamed or bored.

Figure 27:
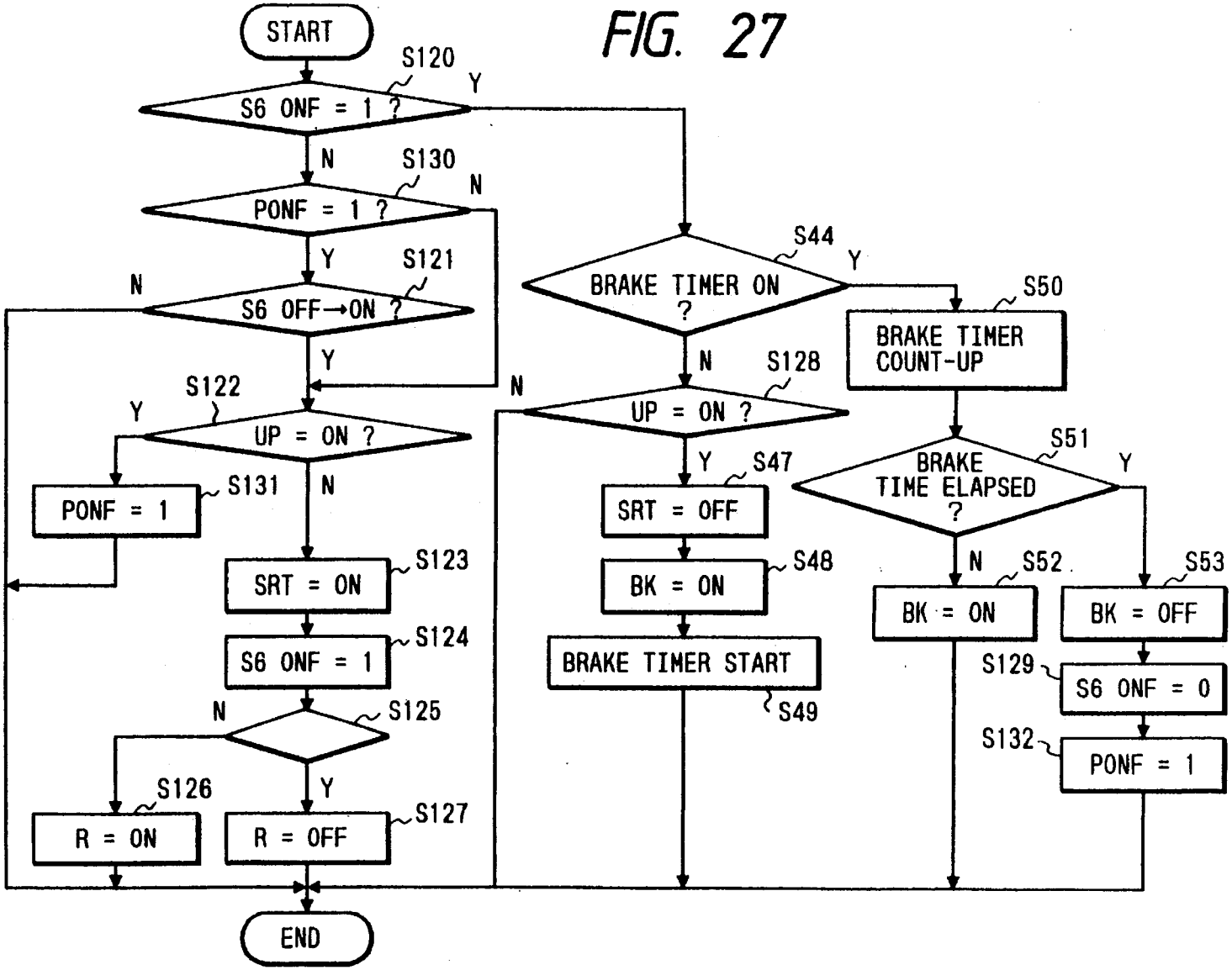
FIG. 27 is a flowchart illustrating the operation of an eleventh embodiment of the invention.

An eleventh embodiment of the invention will now be described. FIG. 27 is a software flowchart of the sewing machine control circuit 522 concerned with Embodiment 11, wherein a flag PONF which indicates whether or not needle is in the up position immediately after power-on is initialized to 0, at power-on. Since the flag PONF is initially 0 at step 130 the processing progresses to step 122, where if the needle UP position signal UP is on, the flag PONF is set to 1 at step 131, whereby needle UP processing is not performed and is regarded as complete.

When the needle is not in the UP position at step 122, the run signal SRT is switched on at step 123 and the flag S6ONF is set to 1. If the machine needle is in the range from the UP position to the DOWN position in the forward rotation direction at step 125, the reverse rotation signal R is switched on at step 126 to raise the needle in the reverse rotation direction. When the machine needle is in the range from the DOWN position to the UP position in the forward rotation direction, the reverse rotation signal R is switched off at step 127 to raise the needle in the forward rotation direction. After needle UP processing is finished, the flag PONF is set to 1 at step 132 and it is stored that the needle UP immediately after power-on is complete to accept only needle UP performed under the control of the second needle UP signal S6 thereafter.

The apparatus in the present embodiment prevents the material from being seamed or bored at power-on.

Figure 28:
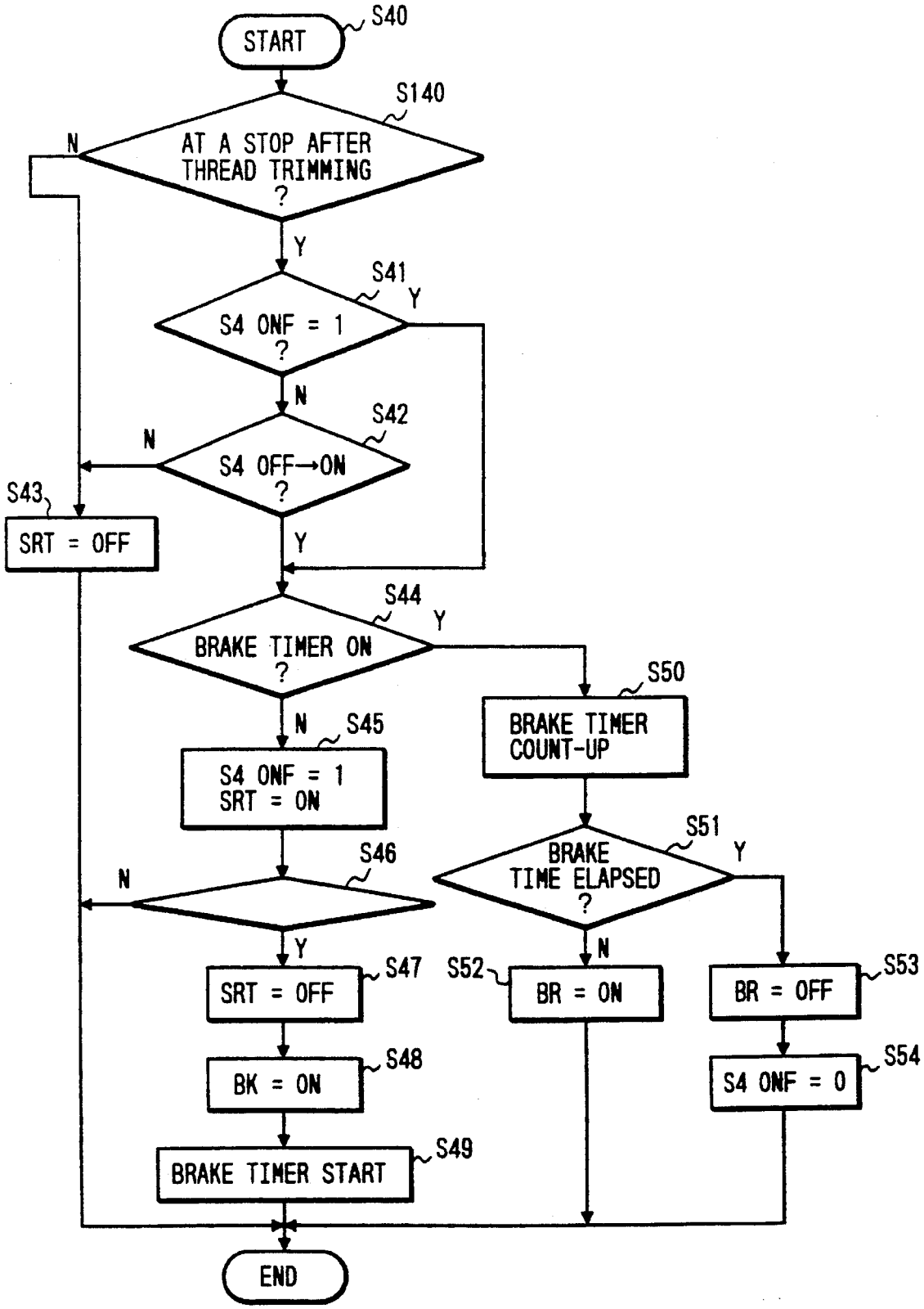
FIG. 28 is a flowchart illustrating the operation of a twelfth embodiment of the invention.

An embodiment of a twelfth invention will now be described. FIG. 28 is a software flowchart of the sewing machine control circuit 522 concerned with Embodiment 12, wherein it is judged at step 140 whether or not the sewing machine 1 has stopped after thread trimming, and the jogging signal S4 is made valid only when the sewing machine has stopped after thread trimming. The other parts are identical to those of Embodiment 1 described in FIG. 3. According to the apparatus in this embodiment, when the machine needle need not be stopped immediately before the material, the machine needle does not rotate if the jogging signal S4 switch is touched accidentally, whereby the sewing machine is not jogged carelessly.

Figure 29:
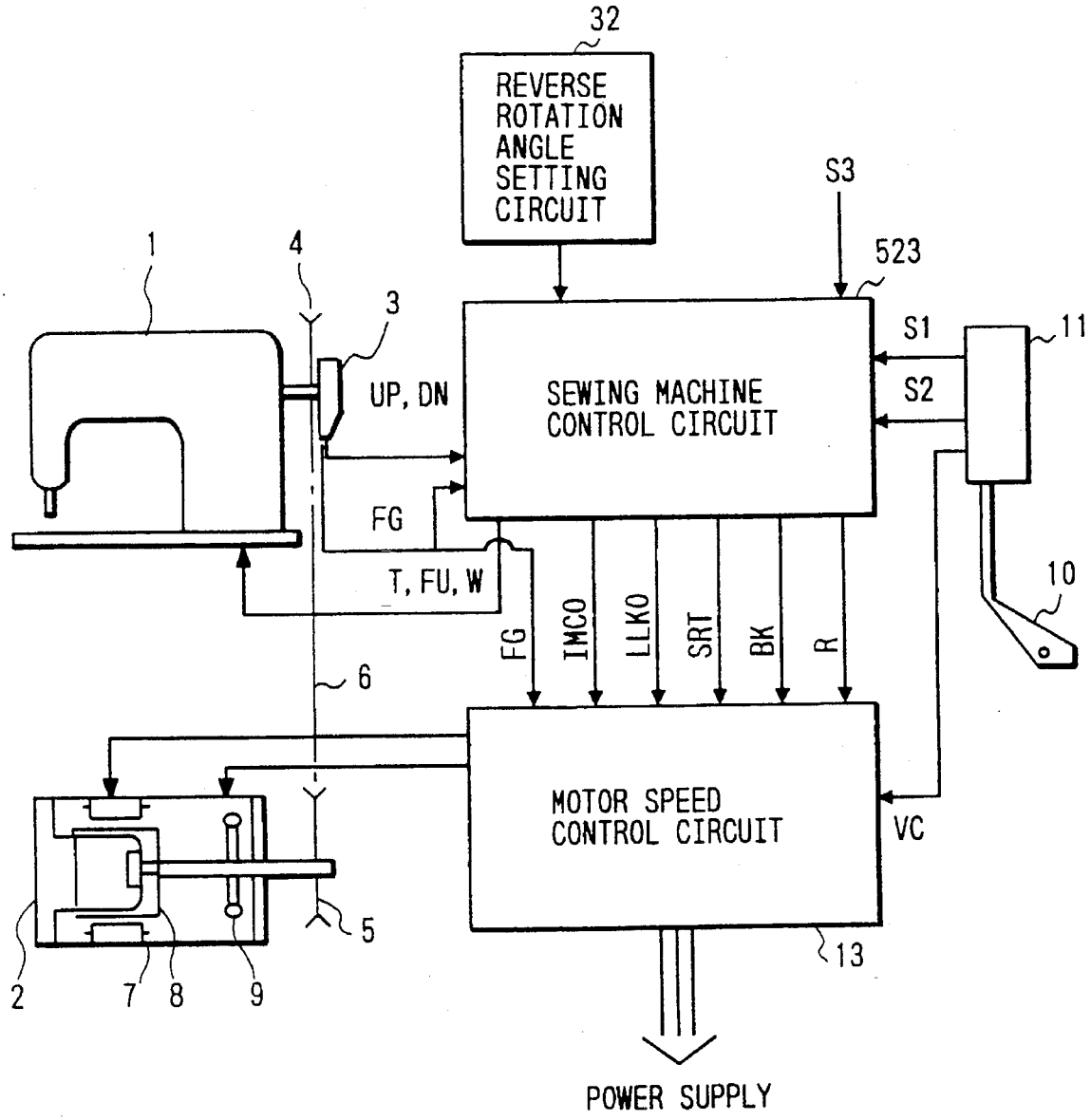
FIG. 29 is an arrangement diagram of a sewing machine controlling apparatus illustrating a thirteenth embodiment of the invention.
Figure 30:
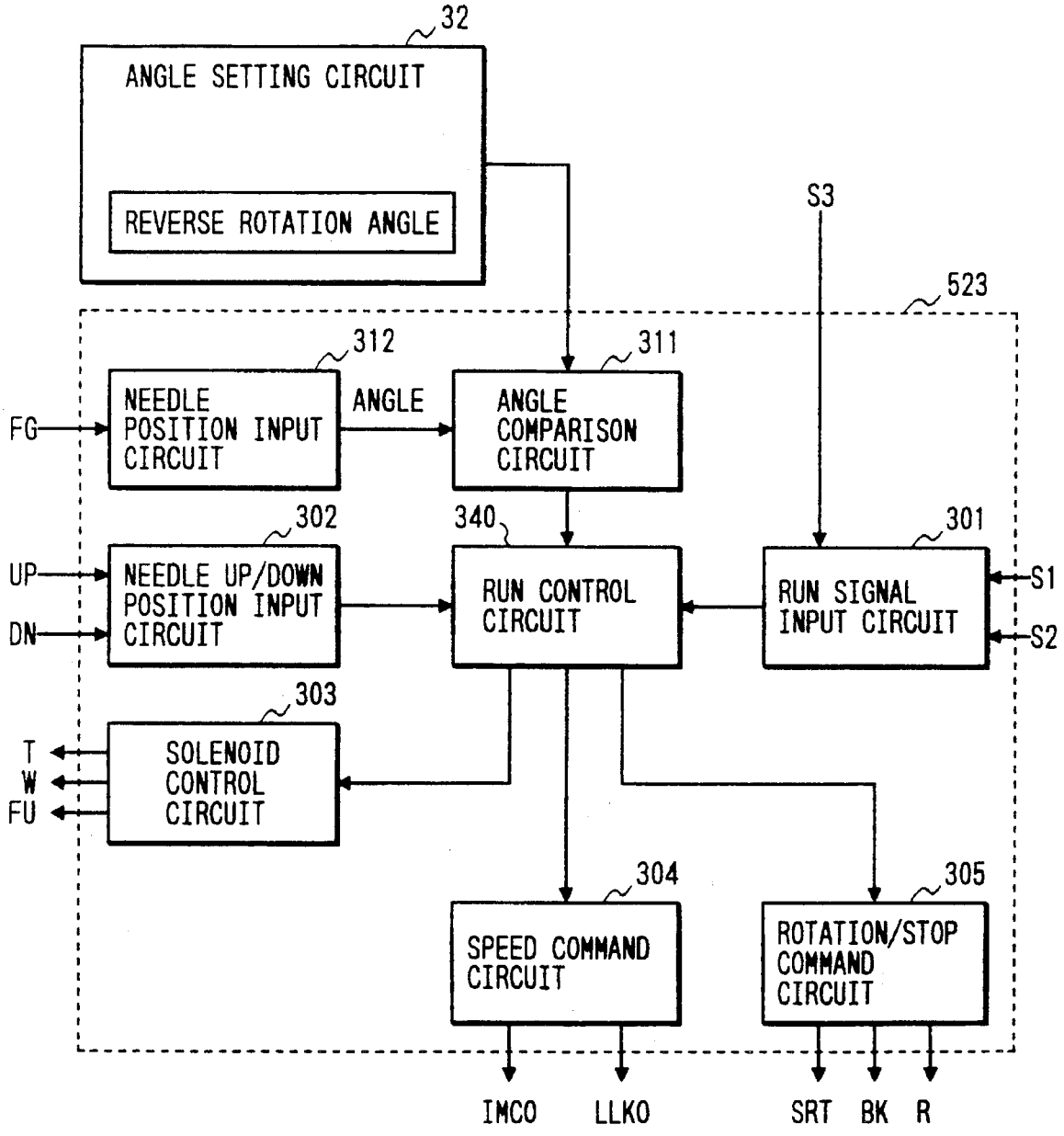
FIG. 30 is a detail drawing of a sewing machine control circuit shown in FIG. 29.

An embodiment of a thirteenth invention will now be described. FIG. 29 is an arrangement diagram of a sewing machine controlling apparatus concerned with the present embodiment, wherein 523 indicates a sewing machine control circuit which is detailed in FIG. 30. Referring to FIGS. 29 and 30, switching the stitching start signal S1 on causes the run control circuit 340 to switch the run signal SRT on and the reverse rotation signal R on via the run signal input circuit 301 to start the motor 2 running in the reverse direction. At this time, the reverse rotation angle set to the reverse rotation angle setting circuit 32 is compared by the angle comparison circuit 311 with the rotary angle of the sewing machine 1 provided by entering the position detection signal FG from the needle position detector 3 into the needle position input circuit 312. When the sewing machine has rotated the set reverse rotation angle or more in the reverse direction, the run control circuit 340 causes the rotation/stop command circuit 305 to switch the reverse rotation signal R off to switch the motor 2 to the forward rotation.

Figure 31:
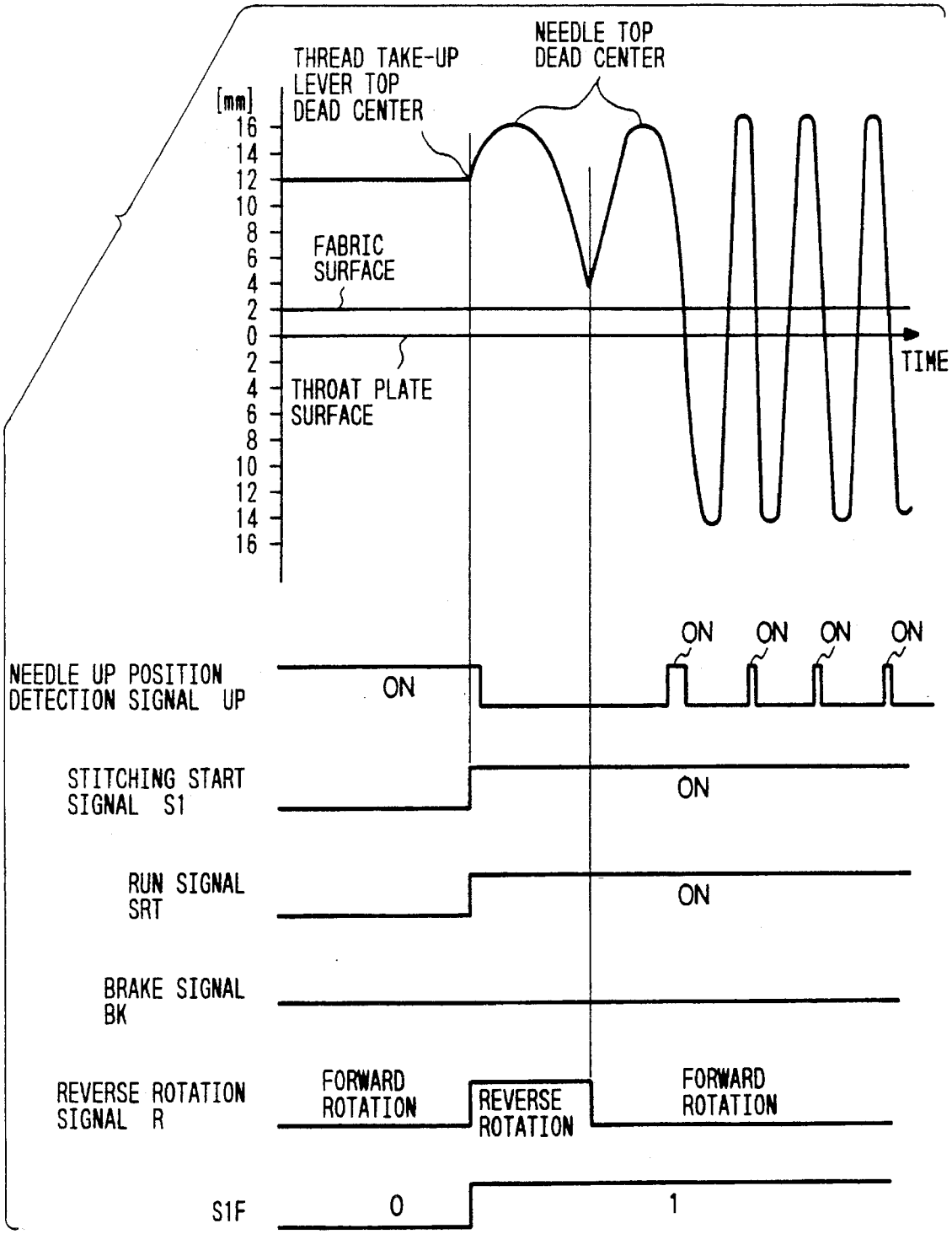
FIG. 31 is a timing chart of the thirteenth embodiment of the invention.

FIG. 31 is a timing chart of the above operation, wherein the machine needle is at a stop at 40 degrees, i.e., at the thread take-up lever top dead center. When the stitching start signal S1 is switched on at this time, the run signal SRT is switched on to start the sewing machine 1 running. At this time, the reverse rotation signal R is switched on and the sewing machine 1 makes the reverse rotation of the reverse rotation angle (e.g., 90 degrees) set to the reverse rotation angle setting circuit 32 at predetermined speed.

After the sewing machine 1 has reversed the set angle, the reverse rotation signal R is switched off and the sewing machine 1 rotates in the forward direction. The forward rotation speed at this time corresponds to the speed command signal VC proportional to the toe-down degree of the pedal 10.

Figure 32:
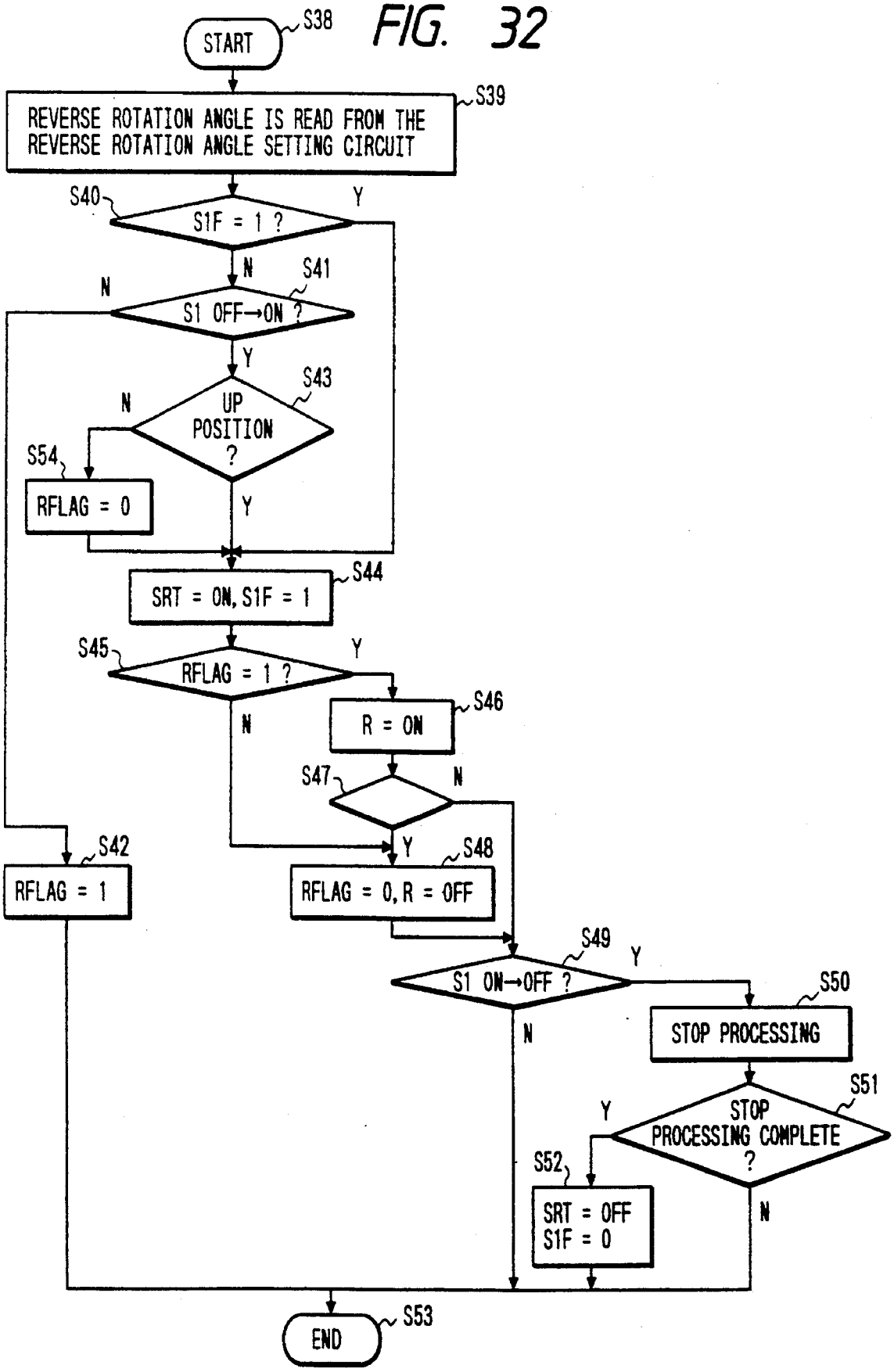
FIG. 32 is a flowchart illustrating the operation of the thirteenth embodiment of the invention.

FIG. 32 is a software flowchart of a sewing machine control circuit 523 concerned with Embodiment 13. When the sewing machine 1 is at a stop, a run flag S1F is 0. Beginning with START at step 38, the processing of this routine is started. At step 39, the reverse rotation angle is read from the reverse rotation angle setting circuit 32. If the sewing machine is at a stop at step 40, the sequence advances to step 41 since the run flag S1F is 0. At step 41, the processing waits for the stitching start signal S1 to be switched on. If it is not switched on, the reverse rotation flag RFLAG is set to 1 at step 42. When the stitching start signal S1 is switched on at step 41, the sequence proceeds to step 43. It is judged at step 43 whether or not the machine needle is at a stop at the UP position. If it is not at the UP position, the processing progresses to step 54, where the reverse rotation flag RFLAG is cleared to 0. Since the run signal SRT is switched on at step 44, the sewing machine 1 starts rotating. The run FLAG S1F is also set to 1.

Since the reverse rotation flag RFLAG is 0 at step 45, the reverse rotation signal R is switched off at step 48, whereby the sewing machine rotates in the forward direction, not in the reverse direction.

When the machine needle is at a stop a the UP position at step 43, the reverse rotation flag RFLAG is 1 at step 45, the processing moves on to step 46, where the reverse rotation signal R is switched on to rotate the sewing machine in the reverse direction. At step 47, it is judged whether the sewing machine has reversed the set reverse rotation angle or not. Until the sewing machine 1 reverses the set reverse rotation angle, the processing advances to step 49, where the sewing machine continues reverse rotation.

When the sewing machine has reversed the set reverse rotation angle at step 47, the sequence proceeds to step 48, where the reverse rotation flag RFLAG is set to 0 and the reverse rotation signal R is switched off, whereby the sewing machine 1 that was rotating in the reverse direction changes the direction to rotate in the forward direction. If the stitching start signal S1 remains on at step 49, the sewing machine 1 continues operation.

When the stitching start signal S1 is switched off at step 49, stop processing is performed at step 50, the sewing machine 1 rotates until it reaches the needle UP or DOWN position, and the sewing machine 1 reaches the needle position at step 51. When the stop processing ends, the run signal SRT is switched off and the run flag S1F is reset to 0 at step 52 to stop the sewing machine 1. This routine ends at step 53 and starts at step 38 again.

According to the apparatus of this embodiment, when the sewing machine 1 is at a stop at the needle UP position or after it has trimmed the threads, the sewing machine 1 reverses the set reverse rotation angle and then rotates in the forward direction, whereby the speed of piercing the material can be increased.

A fourteenth embodiment of the invention will now be described. An arrangement diagram concerned with a sewing machine controlling apparatus of Embodiment 14 is identical to the one in FIGS. 29 and 30 described in said Embodiment 13 and will not be described.

Figure 33:
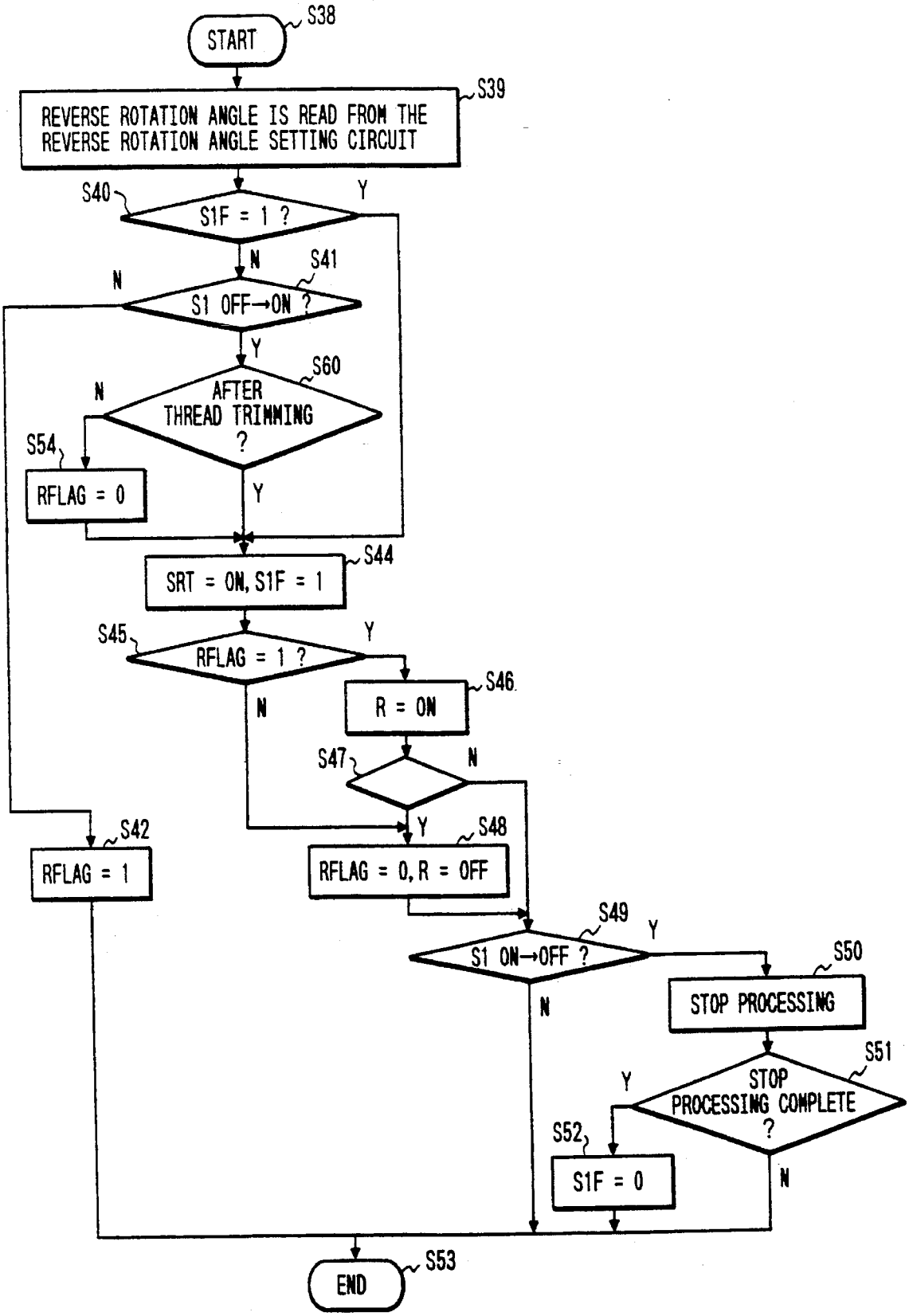
FIG. 33 is a flowchart illustrating the operation of a fourteenth embodiment of the invention.

FIG. 33 is a software flowchart of the sewing machine controlling apparatus concerned with Embodiment 14. In this drawing, while the sewing machine 1 is at a stop, the run flag S1F is 0. Beginning with START at step 38, the processing of this routine is started. At step 39, the reverse rotation angle is read from the reverse rotation angle setting circuit 32.

If the sewing machine is at a stop at step 40, the sequence advances to step 41 since the run flag S1F is 0. At step 41, the processing waits for the stitching start signal S1 to be switched on. If it is not switched on, the reverse rotation flag RFLAG is set to 1 at step 42.

When the stitching start signal S1 is switched on at step 41, the sequence proceeds to step 60.

It is judged at step 60 whether the sewing machine has trimmed the threads or not. If not, the processing progresses to step 54, where the reverse rotation flag RFLAG is cleared to 0. Since the run signal SRT is switched on at step 44, the sewing machine 1 starts rotating. The run flag S1F is also set to 1. The reverse rotation flag RFLAG is 0 at step 45 and the reverse rotation signal R is switched off at step 48, whereby the sewing machine 1 rotates in the forward direction, not in the reverse direction.

When the machine needle is at a stop at the UP position, the reverse rotation flag RFLAG is 1 at step 45, and the processing moves on to step 46, where the reverse rotation signal R is switched on to rotate the sewing machine 1 in the reverse direction.

At step 47, it is judged whether the sewing machine has reversed the set reverse rotation angle or not. Until the sewing machine 1 reverses the set reverse rotation angle, the processing advances to step 49, where the sewing machine 1 continues reverse rotation.

When the sewing machine has reversed the set reverse rotation angle at step 47, the sequence proceeds to step 48, where the reverse rotation flag RFLAG is set to 0 and the reverse rotation signal R is switched off, whereby the sewing machine 1 that was rotating in the reverse direction changes the direction to rotate in the forward direction.

If the stitching start signal S1 remains on at step 49, the sewing machine 1 continues operation. When the stitching start signal S1 is switched off at step 49, stop processing is performed at step 50, the sewing machine 1 rotates until the machine needle reaches the UP or DOWN position, and the sewing machine 1 reaches the needle UP or DOWN position at step 51. When the stop processing ends, the run signal SRT is switched off and the run flag S1F is reset to 0 at step 52 to stop the sewing machine 1. This routine ends at step 53 and restarts at step 38. The apparatus of this embodiment allows the machine needle to stop immediately before the material, whereby the machine pulley 4 need not be rotated by hand.

Figure 34:
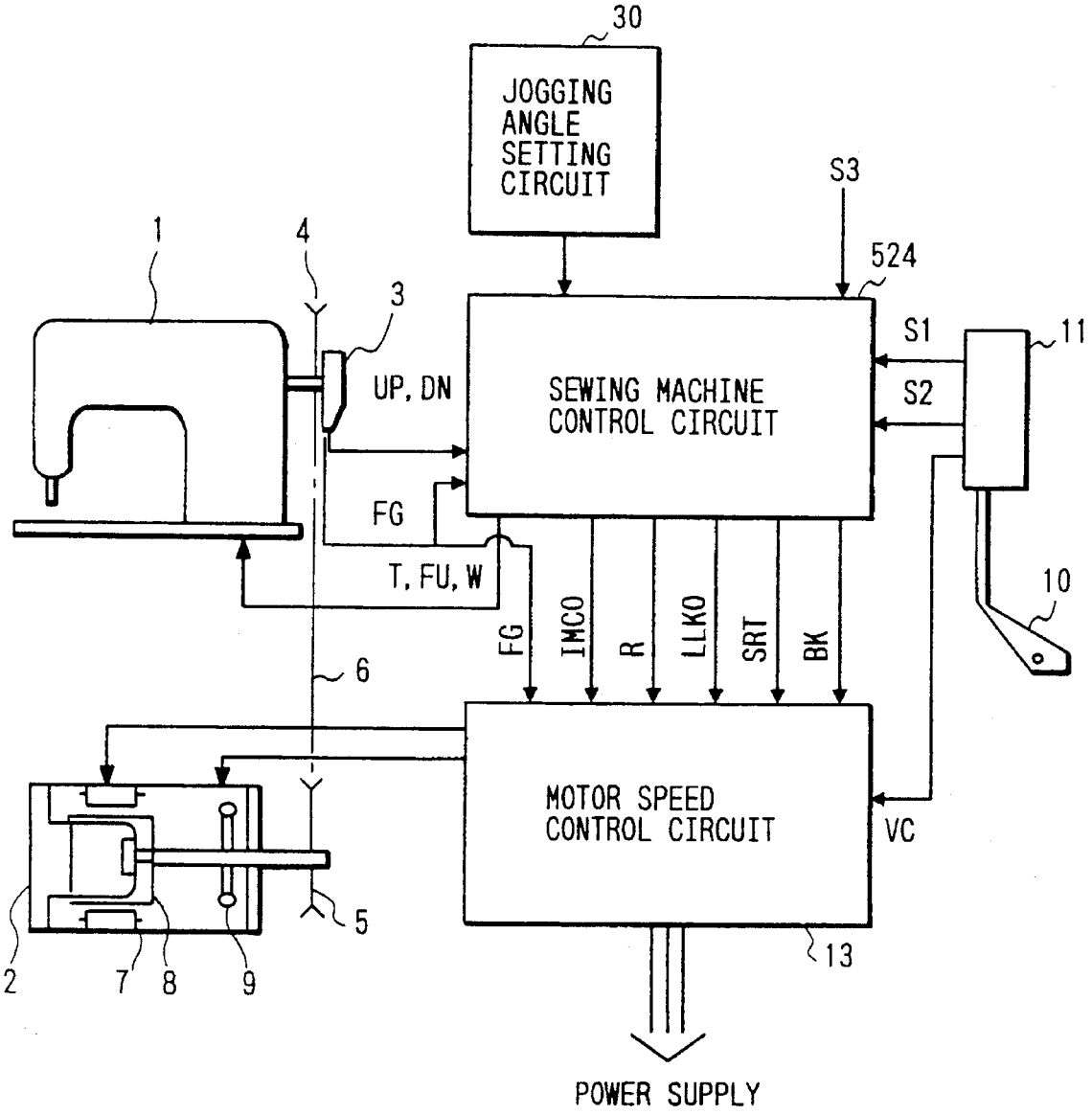
FIG. 34 is an arrangement diagram of a sewing machine controlling apparatus illustrating a fifteenth embodiment of the invention.

A fifteenth embodiment of the invention will now be described. FIG. 34 is an arrangement diagram of a sewing machine controlling apparatus concerned with this embodiment, wherein 524 indicates a sewing machine control circuit detailed in FIG. 35 and S4 denotes a jogging signal. It is to be understood that the other parts are identical to those of Embodiment 1 shown in FIG. 1 and will not be described.

Figure 35:
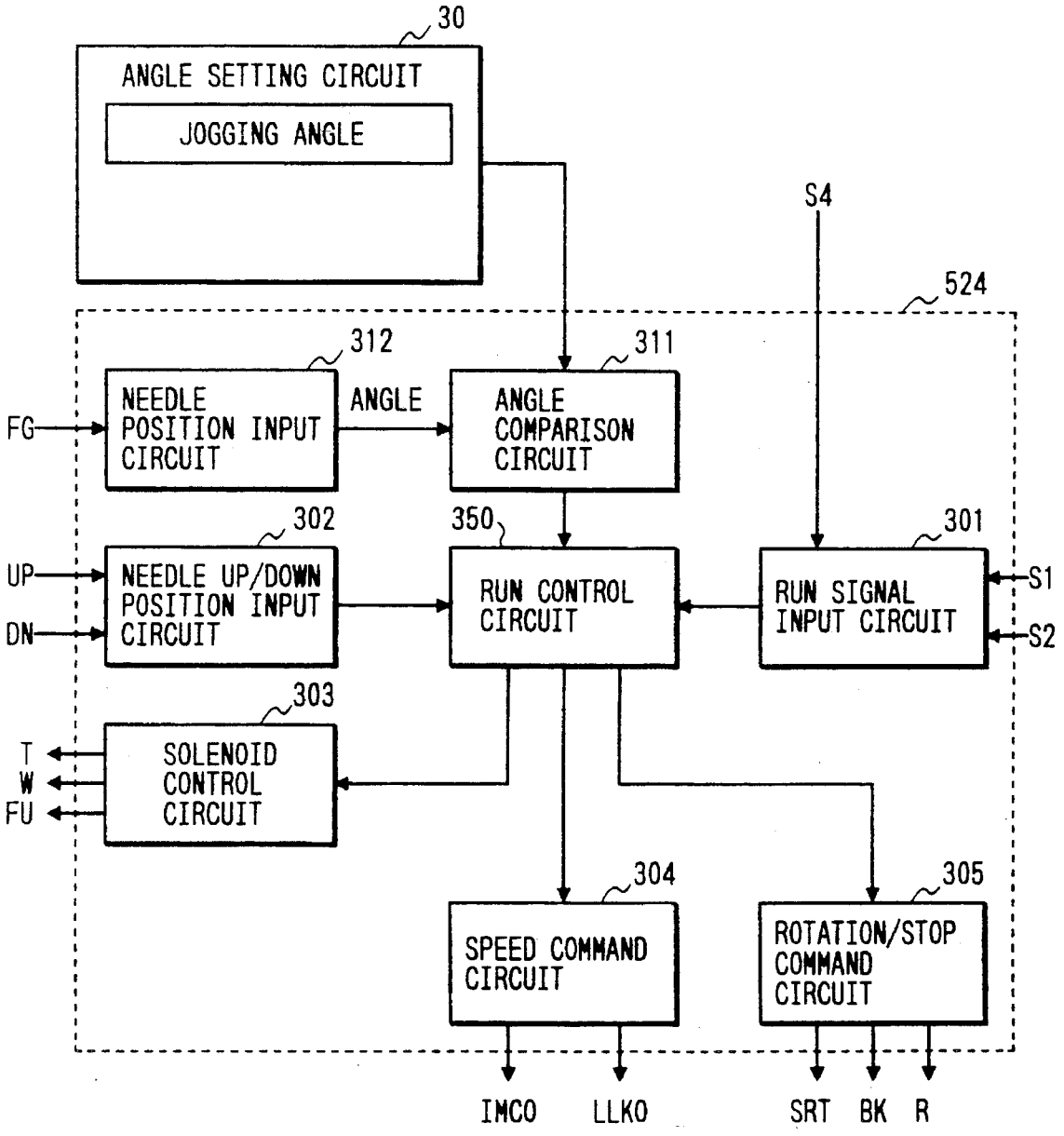
FIG. 35 is a detail drawing of a sewing machine control circuit shown in FIG. 34.

The operation of the sewing machine control circuit 524 will be described in accordance with a block diagram shown in FIG. 35. When the jogging signal S4 is switched on, the run control circuit 350 causes the run signal SRT to be switched on via the run signal input circuit 301, the sewing machine 1 to start rotating, and the thread trimmer output T to be output from the solenoid control circuit 303.

Starting at a point when the sewing machine 1 has detected the needle UP position signal UP of the needle position detector 3 from the needle UP/DOWN position input circuit 302, the jogging angle (e.g., 35 degrees) set to the angle setting circuit 30 is compared by the angle comparison circuit 311 with the rotary angle of the sewing machine 1 entered from the position detection signal FG given by the needle position detector 3 via the needle position input circuit 312. When the sewing machine 1 has reached or exceeded the set jogging angle, the run control circuit 350 causes the rotation/stop command circuit 305 to switch the run signal SRT off and the brake signal BK on to stop the sewing machine 1 at the set jogging angle.

Figure 36:
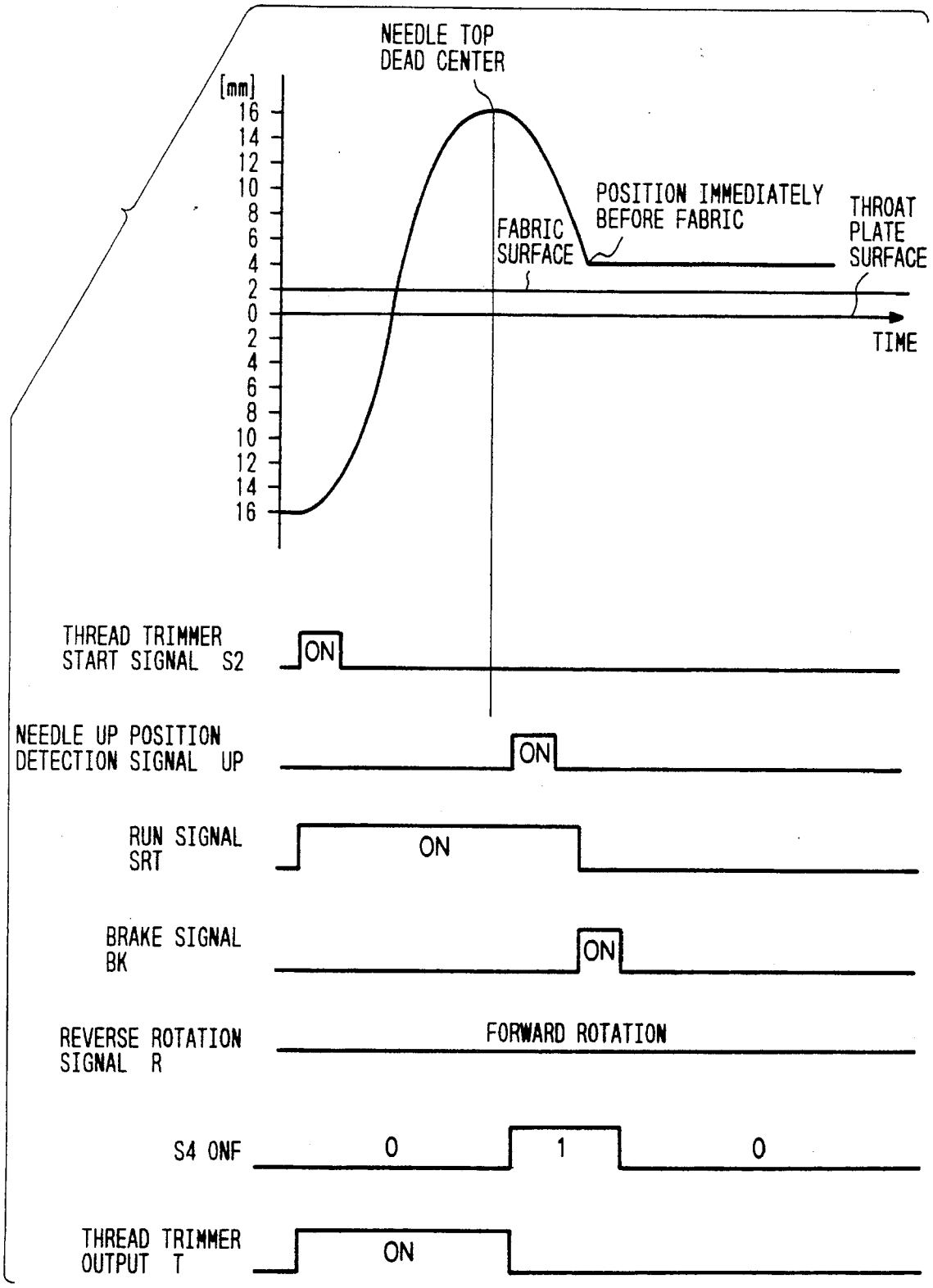
FIG. 36 is a timing chart of the fifteenth embodiment of the invention.

Operation will now be described in accordance with a timing chart in FIG. 36. When the jogging signal S4 is switched on, the run signal SRT is output to start the sewing machine 1 rotating and the thread trimmer output T is output to cut the threads. When the needle UP position signal UP is switched on, the thread trimmer output T is switched off and a jogging command flag S4ONF is set to 1 to start jogging. When the sewing machine 1 has rotated the set jogging angle, the run signal SRT is switched off and the brake signal BK is output for a certain period of time to stop the sewing machine 1, and the jogging command flag S4ONF is set to 0.

Accordingly, after thread trimming, the machine needle automatically rotates the jogging angle set to the jogging angle setting circuit 30 in the forward direction, starting at the needle UP position, and comes to a stop.

When, after the stop, the presser foot is raised, the material sewn is removed, and the material to be stitched next is inserted, where to start stitching the next materials made clear because the machine needle is immediately before the material.

Figure 37:
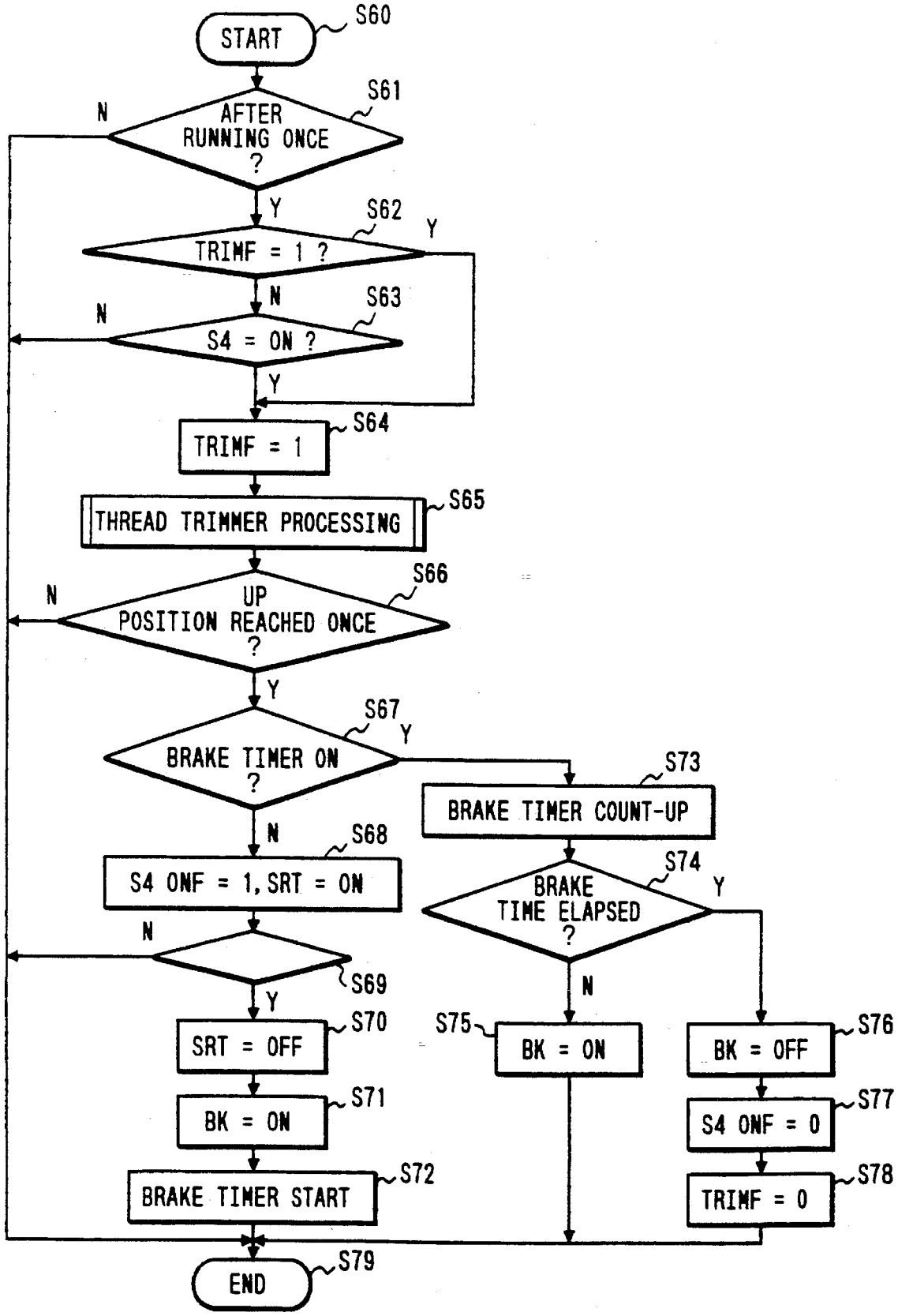
FIG. 37 is a flowchart illustrating the operation of the fifteenth embodiment of the invention.

Operation will now be described in accordance with a flowchart in FIG. 37. Beginning with step 60, it is judged at step 61 whether or not the sewing machine 1 has operated once. If not, no processing is performed at END of step 79 and the sequence is finished. If it has been judged at step 61 that the sewing machine 1 has operated once, the sequence advances to step 62. If a thread trimmer flag TRIMF is 1, the sequence proceeds to step 64. If the thread trimmer flag TRIMF is 0 at step 62, the sequence progresses to step 63, where it is judged whether or not the jogging signal S4 is on. If it is off, no operation is performed and the sequence moves on to END of step 79. If the jogging signal S4 is on, the sequence proceeds to step 64, where the thread trimmer flag TRIMF is set to 1.

At step 65, where thread trimmer processing is carried out, the thread trimmer output T is provided and the sewing machine 1 is rotated up to the needle UP position. At step 66, it is judged whether or not the machine needle has reached the UP position. If not, the thread trimmer processing is continued. If the machine needle has reached the UP position once, the sequence advances to step 67. If the brake timer is not on, the sequence proceeds to step 68, where the flag S4ONF for storing that jogging processing has initiated is set to 1.

Also, the run signal SRT is switched on to start the operation of the sewing machine 1. At step 69, it is judged whether or not the jogging angle has been reached. If not, the sewing machine keeps rotating.

If it has been judged at step 69 that the jogging angle has been rotated, the run signal SRT is switched off at step 70, the brake signal BK is switched on at step 71, and the brake timer is set for the brake output time at step 72. The sequence returns from END of step 79 to START of step 60 and shifts to step 64 since the thread trimmer flag TRIMF is now 1. Because the machine needle has reached the UP position once at step 66, the processing shifts to step 67. Since the brake timer is on at step 67, the processing shifts to step 73, where the brake timer is counted up. At step 74, it is judged whether or not the brake timer has exceeded the given time. If the brake timer has not expired, the brake signal BK is switched on at step 75. If the brake timer has expired, the brake signal BK is switched off at step 76, the flag S4ONF is cleared to 0 at step 77, and the thread trimmer flag TRIMF is cleared to 0 at step 78. It is to be understood that stitching start or thread trimmer start is made as described in said conventional example and will not be described here.

Figure 38:
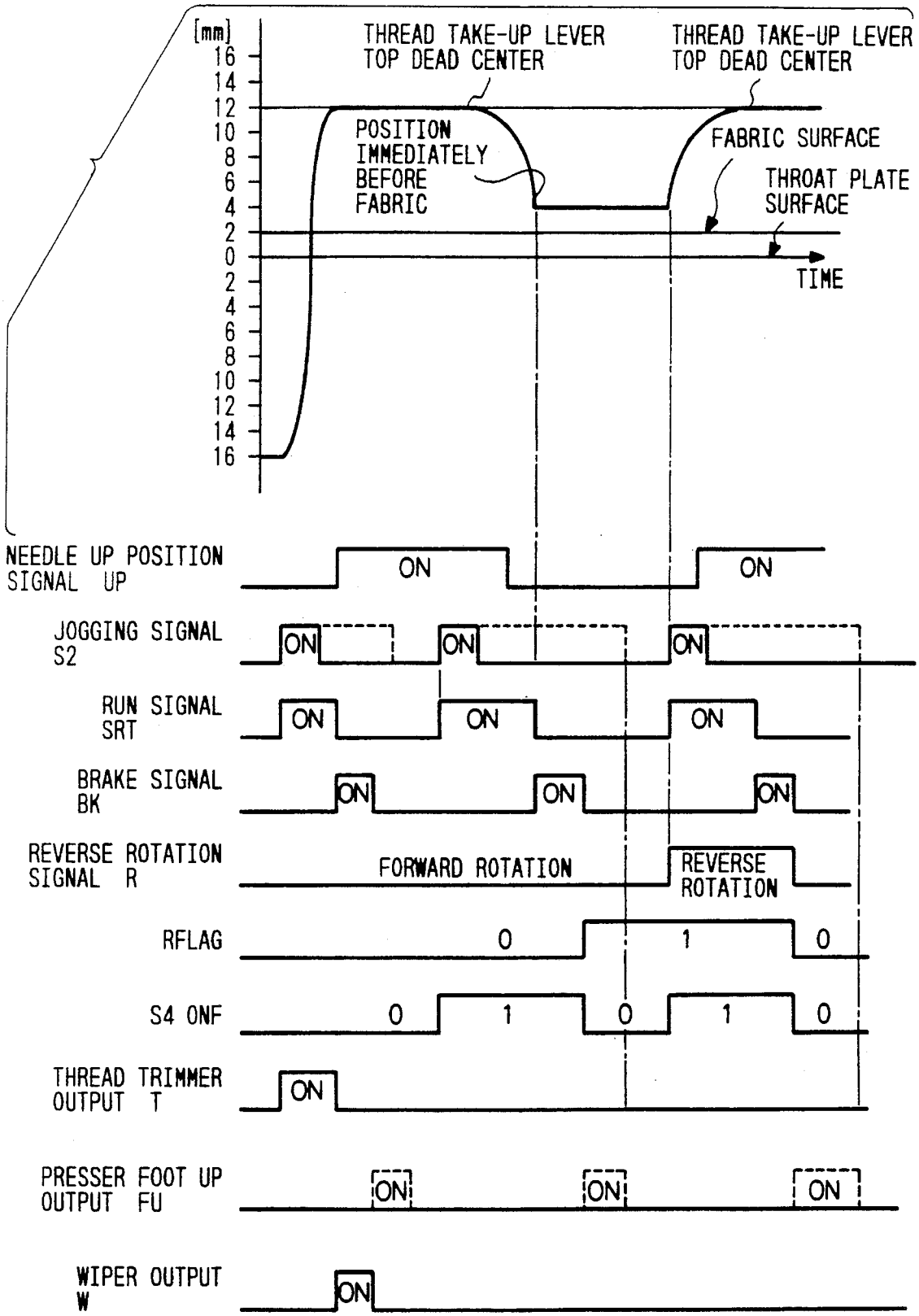
FIG. 38 is a timing chart of a sixteenth and seventeenth embodiment of the invention.

A sixteenth embodiment of the invention and a seventeenth embodiment of the invention will now be described. The arrangement of an apparatus in the present embodiment is identical to that in Embodiment 15 and will not be described. FIG. 38 illustrates the operation of a sewing machine controlling apparatus concerned with Embodiment 16, showing the operation which begins with a stop at the needle UP position after thread trimming.

When the jogging signal S4 is switched on in this status, the run signal SRT is switched on and the reverse rotation signal R is on the forward rotation side, whereby the sewing machine 1 starts forward rotation. Since the jogging command flag S4ONF is 1 at this time, the sewing machine 1 rotates by the jogging angle set in the jogging angle setting circuit 30 (e.g., 35 degrees) in the forward direction, whereby the run signal SRT is switched off, the reverse rotation flag RFLAG is inverted to 1, and the brake signal BK is switched on to stop the machine needle at a position immediately before the material. The operator moves the material at this position to set the position of the material to be pierced with the machine needle.

Further, when the jogging signal S4 is switched on again, the run signal SRT is switched on, the reverse rotation signal R is set to the reverse rotation side because the reverse rotation flag RFLAG is 1, and the sewing machine 1 starts reverse rotation. Since the jogging command flag S4ONF is 1 at this time, rotating the sewing machine 1 by the angle set to the jogging angle setting circuit 30 (90 degrees in the figure) in the reverse direction causes the run signal SRT to be switched off, the reverse rotation flag RFLAG to be inverted to 0, and the brake signal BK to be switched on, whereby the sewing machine 1 is reversed to the needle UP position and brought to a stop.

When the material is stitched in the forward rotation under the control of the stitching start signal S1 after the machine needle has been stopped immediately before the material, the distance of piercing the material is short and the speed of piercing the material is not high enough to provide the sufficient force of inertia, whereby the torque required to pierce the material is not provided and the sewing machine 1 comes to a stop. To prevent this, if the jogging signal S4 is switched on again to rotate the machine needle by the jogging angle to move away from the material once and subsequently the needle is rotated in the forward direction under the control of the stitching start signal S1, the distance of piercing the material is increased and the speed of piercing the material is increased to provide larger force of inertia, whereby the material can be pierced.

Figure 39:
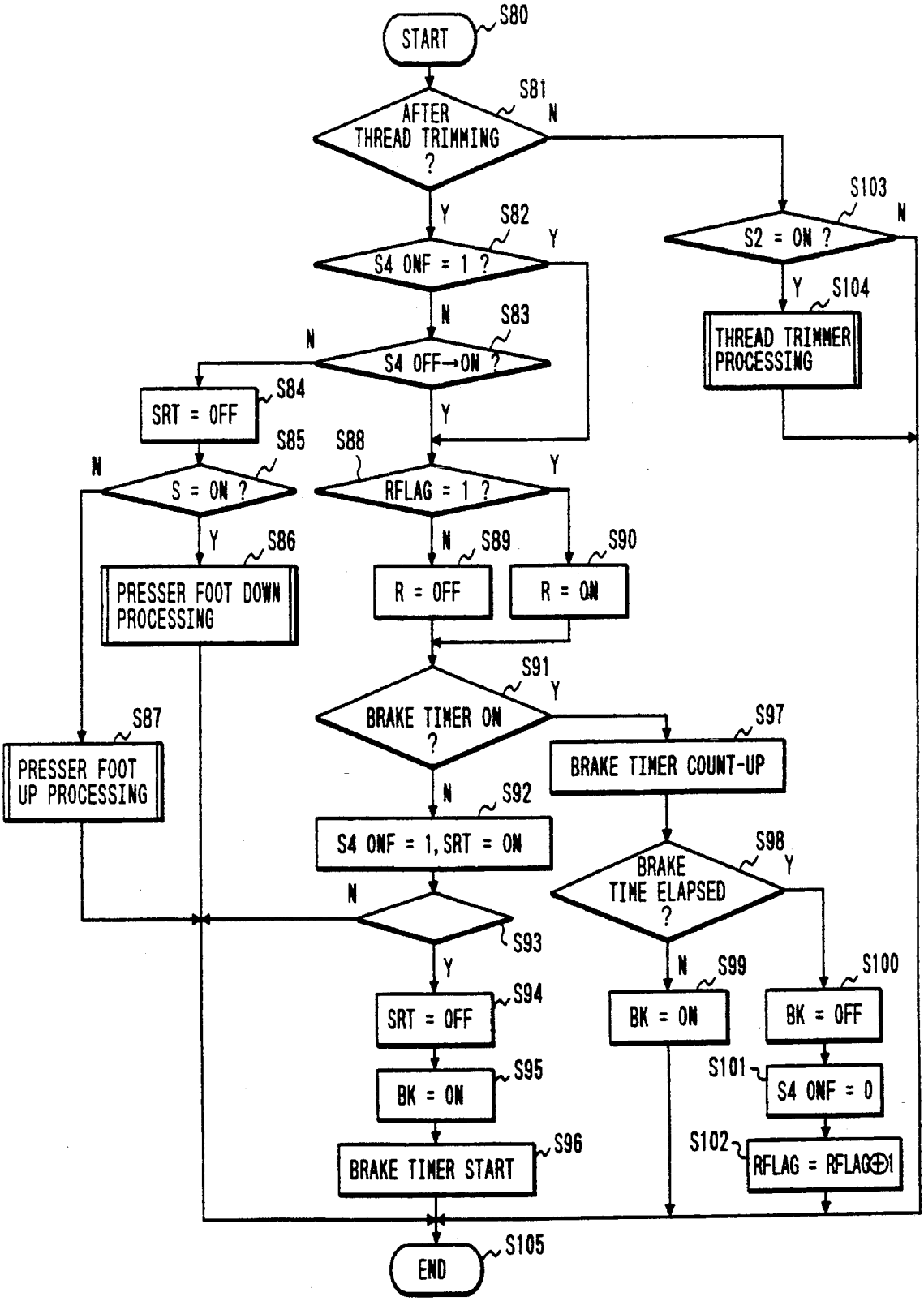
FIG. 39 is a flowchart illustrating the operation of the sixteenth and seventeenth embodiment of the invention.

The sewing machine control circuit 524 which has achieved this operation will now be described in accordance with a flowchart in FIG. 39.

At power-on or after thread trimming, the flag S4ONF for storing that the jogging processing has started is initialized to 0, the reverse rotation flag RFLAG to 0, the run signal SRT to OFF, the brake signal BK to OFF, and the reverse rotation signal R to OFF.

Starting at step 80, it is judged at step 81 whether the sewing machine 1 has done thread trimming or not. If not, the sequence proceeds to step 103. If the sewing machine 1 has already done thread trimming, the sequence progresses to step 83 because the S4ONF is still 0 at step 82. Until the jogging signal S4 turns from OFF to ON at step 83, the run signal SRT is OFF at step 84, whereby the sewing machine 1 remains stopped. If the jogging signal S4 is on at step 85, presser foot UP processing is performed at step 86. If the jogging signal S4 is off at step 85, presser foot DOWN processing is performed at step 87. If the jogging signal S4 has turned from OFF to ON at step 83, the sequence proceeds to step 88. If the reverse rotation flag RFLAG is 0, the sequence advances to step 89, where the reverse rotation signal R is set to OFF, whereby the sewing machine 1 rotates in the forward direction. If the reverse rotation flag RFLAG is 1 at step 88, the sequence moves on to step 90, where the reverse rotation signal R is set to ON, whereby the sewing machine 1 rotates in the reverse direction.

Next, the processing advances to step 91. Since the brake timer is not on, the processing moves forward to step 92, where the flag S4ONF is set to 1, and once the jogging signal S4 is entered, it is held until the sewing machine 1 finishes the rotation of the jogging angle.

Since the run signal SRT is set to ON at step 92, the sewing machine 1 starts rotating. At step 93, it is judged whether or not the sewing machine 1 has rotated the set jogging angle using the position detection signal FG of the needle position detector 3 of the sewing machine 1. If not, the sewing machine keeps rotating. If it has rotated the set jogging angle, the run signal SRT is switched off at step 94, the brake signal BK is switched on, and the brake timer is started. Thereafter, since the brake timer is on at step 91, the brake timer is counted up at step 97 and it is judged at step 98 whether the given brake time has elapsed or not. If not, the brake signal BK is kept on at step 99. After the brake time has elapsed, the brake signal BK is switched off at step 100, the flag S4ONF is set to 0 at step 101, and the sewing machine 1 stops. At this time, the reverse rotation flag RFLAG is EXCLUSIVE ORed with 1 to invert the value. After the first forward rotation is over, the reverse rotation flag RFLAG is set to 1.

Accordingly, when the jogging signal S4 is entered next, the reverse rotation flag RFLAG is 1 at step 88, whereby the reverse rotation signal R is switched on at step 90 to run the sewing machine 1 in the reverse direction. When the sewing machine 1 has reversed by the jogging angle, the run signal SRT is switched off and the brake signal BK is switched on to stop the sewing machine 1. At this time, the reverse rotation flag RFLAG is set to 0.

When the jogging signal S4 is further entered, the sewing machine 1 rotates forward because the reverse rotation flag RFLAG is 0. After a stop, the reverse rotation flag RFLAG is inverted to 1. When the jogging signal S4 is further entered, the sewing machine 1 rotates reversely because the reverse rotation flag RFLAG is 1. Therefore, every time the jogging signal S4 is entered, the sewing machine 1 alternates between forward rotation and reverse rotation. This allows the position where the material is pierced with the machine needle to be re-adjusted.

At step 103, it is judged whether the jogging signal S4 has been entered or not. If not, the sequence is terminated at END of step 105 with no further operation being performed. If the jogging signal S4 has been entered, thread trimmer processing is performed.

An eighteenth embodiment of the invention will now be described. The arrangement of the apparatus in this embodiment is identical to that of said Embodiment 16 and will not be described.

Figure 40:
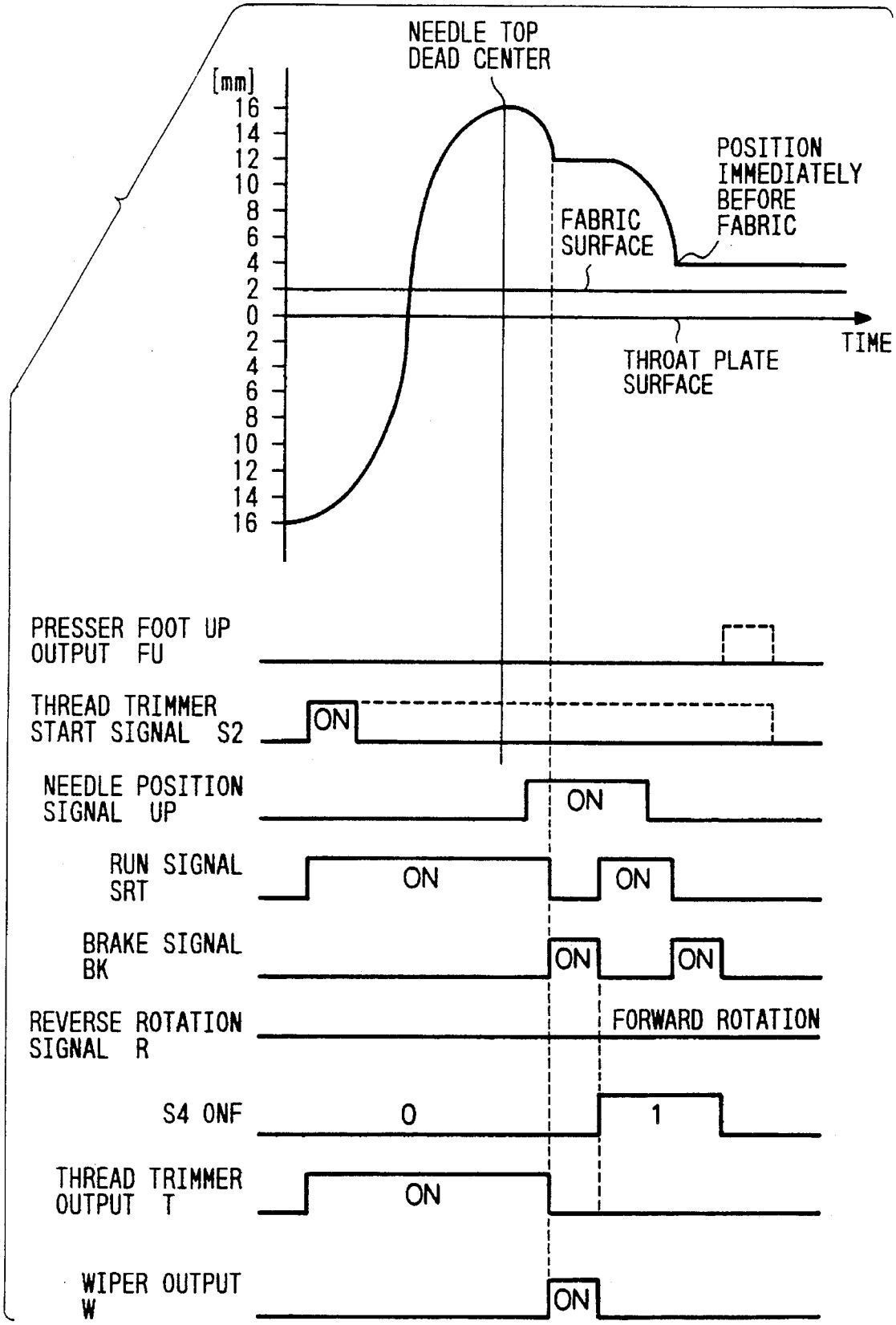
FIG. 40 is a timing chart of the eighteenth embodiment of the invention.

Assuming that the jogging angle of 35 degrees, for example, has been set to the jogging angle setting circuit 30 in FIG. 34, operation will be described in accordance with a timing chart in FIG. 40. It is to be understood that switching the thread trimmer start signal S2 on causes the run signal SRT to be output, the sewing machine 1 to start rotating, and the thread trimmer output T to be provided to cut the threads. When the needle UP position signal UP is switched on, the thread trimmer output T is switched off, the run signal SRT is switched off, the brake signal BK is output for a given length of time, and a wiper output W for thread wiping is provided for a predetermined period of time. When the brake signal BK is switched off in a given period of time, the run signal SRT is switched on and the jogging command flag S4ONF is set to 1 to start jogging. When the sewing machine has rotated by the set jogging angle, the run signal SRT is switched off and the brake signal BK is output for a predetermined length of time to make a stop, and the jogging command flag S4ONF is set to 0.

Accordingly, after thread trimming, the sewing machine 1 stops for a given time and performs wiper operation, and the machine needle automatically rotates the jogging angle set to the jogging angle setting circuit 30 in the forward direction, starting at the needle UP position, and comes to a stop.

When, after the stop, the presser foot is raised, the material sewn is removed, and the material to be stitched next is inserted, where to start stitching the material next is made clear because the machine needle is immediately before the material.

Figure 41:
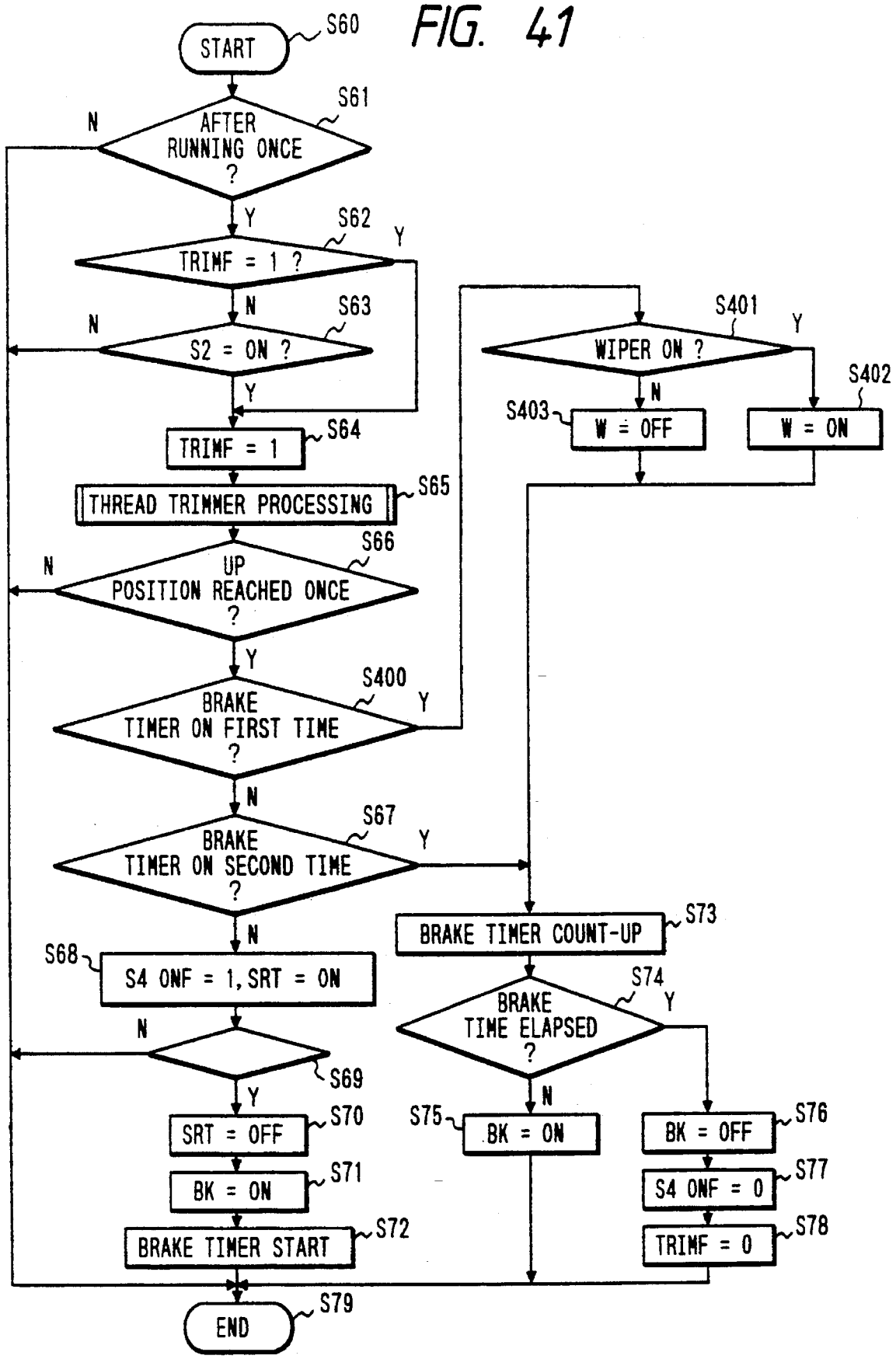
FIG. 41 is a flowchart illustrating the operation of the eighteenth embodiment of the invention.

Operation will now be described in accordance with a flowchart in FIG. 41. Beginning with step 60, it is judged at step 61 whether the sewing machine 1 has operated once. If not, no processing is performed at END of step 79 and the sequence is finished.

If it has been judged at step 61 that the sewing machine 1 has operated once, the sequence advances to step 62. If the thread trimmer flag TRIMF is 1, the sequence proceeds to step 64. If the thread trimmer flag TRIMF is 0 at step 62, the sequence progresses to step 63, where it is judged whether or not the thread trimmer start signal S2 is on. If it is off, no operation is performed and the sequence moves on to END of step 79.

If the thread trimmer start signal S2 is on, the sequence proceeds to step 64, where the thread trimmer flag TRIMF is set to 1. At step 65, thread trimmer processing is carried out, the thread trimmer output T is provided, and the sewing machine 1 is rotated up to the needle UP position. At step 66, it is judged whether or not the machine needle has reached the UP position. If not, the thread trimmer processing is continued.

If it has been judged at step 66 that the machine needle has reached the UP position once, the sequence advances to step 400, where it is judged whether or not the brake timer is on the first time. If so, the sequence proceeds to step 401, where it is judged whether the wiper is on or not. If the wiper is on, the processing progresses to step 402, where the wiper output W is switched on. If the wiper is not on, the sequence proceeds to step 403, where the wiper output is switched off and the processing moves on to step 73. When the first brake time has ended, the sequence progresses to step 67. If the brake timer is not on the second time, the sequence proceeds to step 68. Here, a flag S01ONF for storing that the jogging processing has initiated is set to 1.

Also, the run signal SRT is switched on to start the sewing machine 1 running. At step 69, it is judged whether or not the jogging angle has been reached. If not, the sewing machine 1 keeps rotating.

If it has been judged at step 69 that the jogging angle has been rotated, the run signal SRT is switched off at step 70, the brake signal BK is switched on at step 71, and the brake timer is set for the brake output time at step 72. The sequence returns from END of step 79 to START of step 60 and shifts to step 64 since the thread trimmer flag TRIMF is 1 at this time. Because the machine needle has reached the UP position once at step 66, the processing shifts to step 67. Since the brake timer is on at step 67, the processing shifts to step 73, where the brake timer is counted up. At step 74, it is judged whether or not the brake timer has exceeded the given time. If the brake timer has not expired, the brake signal BK is switched on at step 75. If the brake timer has expired, the brake signal BK is switched off at step 76, the flag S4ONF is cleared to 0 at step 77, and the thread trimmer flag TRIMF is cleared to 0 at step 78. According to the apparatus in the present embodiment, the wiper, if any, makes contact with the machine needle when the thread is wiped by the wiper after the machine needle has stopped immediately before the material, and to prevent this, the sewing machine 1 is stopped once at the needle UP position, the wiper is operated, and the sewing machine 1 is rotated by the jogging angle again to stop the machine needle at the position immediately before the material, whereby the wiper does not come into contact with the machine needle and the needle fall position for the next material can be adjusted easily.

Figure 42:
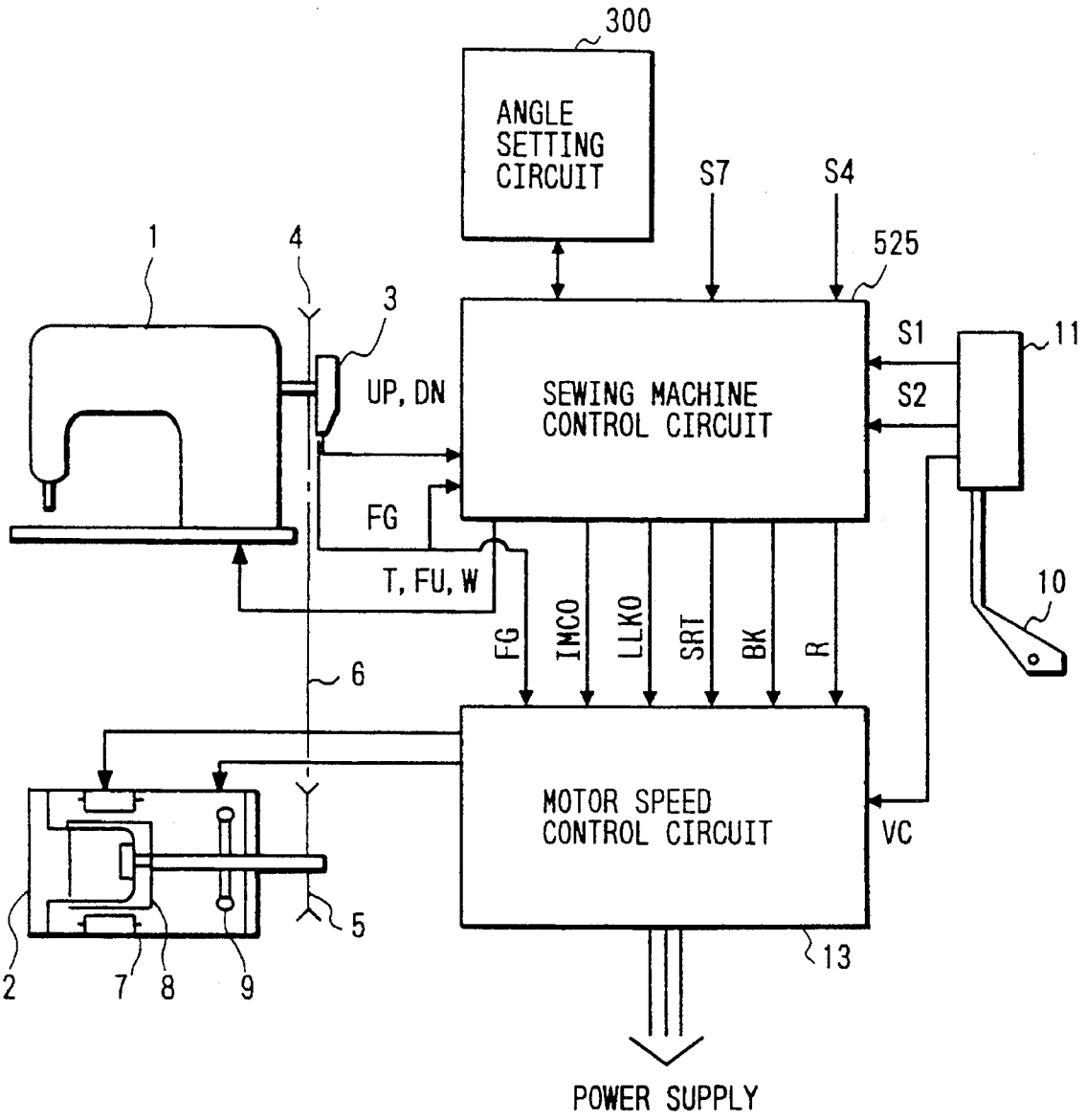
FIG. 42 is an arrangement diagram of a sewing machine controlling apparatus illustrating an nineteenth embodiment of the invention.

A nineteenth embodiment of the invention will now be described. FIG. 42 is an arrangement diagram of a sewing machine controlling apparatus concerned with the present embodiment, wherein 300 indicates an angle setting circuit acting as angle setting means, 525 represents a sewing machine control circuit, and S7 denotes an angle storage signal. It is to be understood that the other parts are identical to those in previous embodiments and will not be described.

Figure 43:
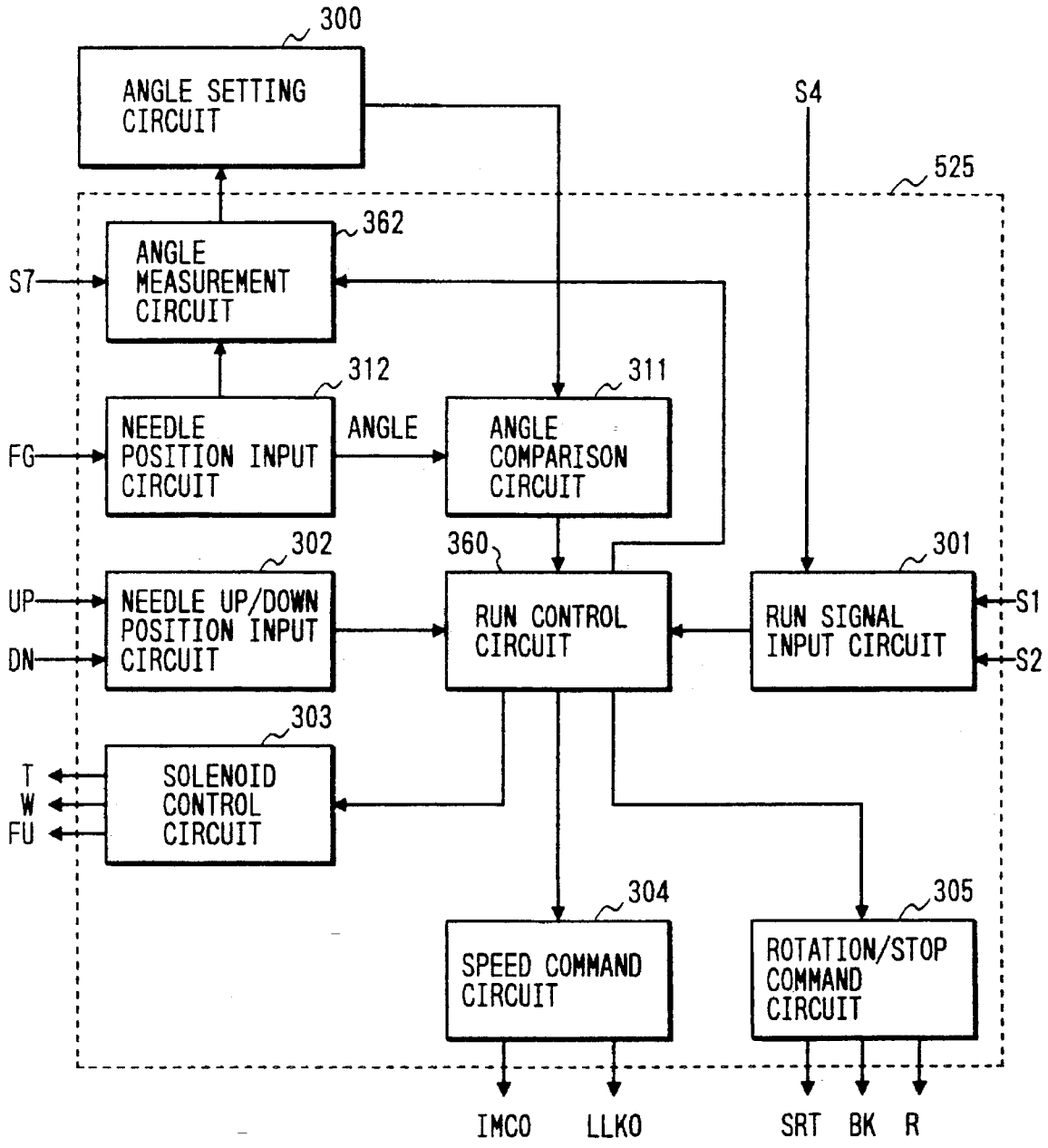
FIG. 43 is a detail drawing of a sewing machine control circuit shown in FIG. 42.
Figure 44:
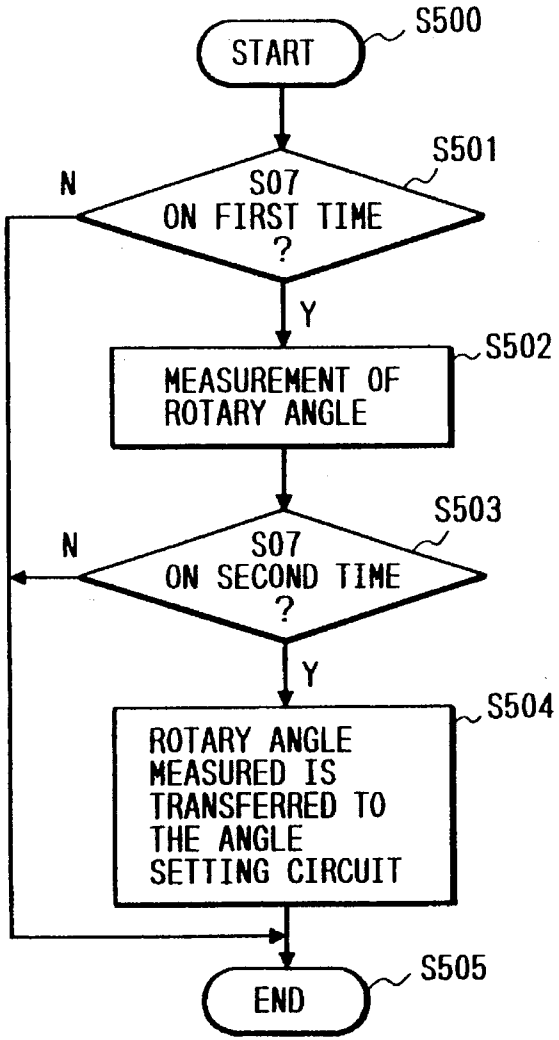
FIG. 44 is a flowchart illustrating the operation of the nineteenth embodiment of the invention.
Figure 45:
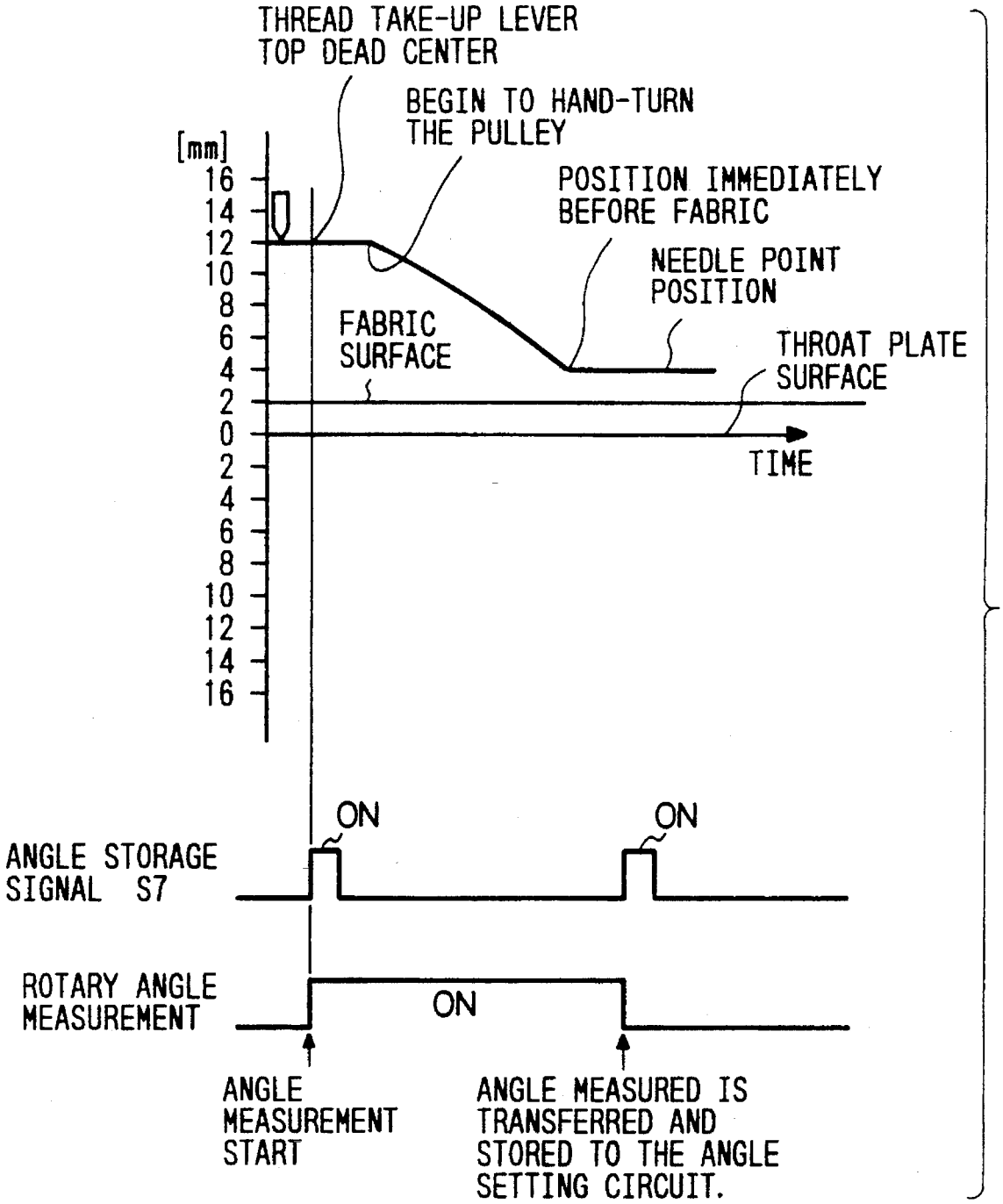
FIG. 45 is a timing chart of the nineteenth embodiment of the invention.

FIG. 43 is a block diagram showing said sewing machine control circuit 525, and FIG. 44 is a flowchart of software incorporated in the sewing machine control circuit 525. Control is exercised in accordance with this flowchart when the angle storage signal S7 is entered. It is to be understood that FIG. 45 is an operation timing chart. In this embodiment, switching on the angle storage signal S7 causes an angle measurement circuit 362 to start angle measurement, and turning the machine pulley 4 by hand counts the angle. By switching the angle storage signal S7 on again, the angle measurement is terminated and the angle measured is transferred from the angle measurement circuit 362 to the angle setting circuit 300 and is stored there.

Operation will now be described in accordance with the flowchart in FIG. 44 and the timing chart in FIG. 45.

Starting at step 500, it is judged at step 501 whether the angle storage signal S7 has switched on or not. If the signal is off, the sequence proceeds to step 505 and no operation is performed. If the angle storage signal S7 is on at step 501, the sequence progresses to step 502, where the rotary angle is measured. Further at step 503, it is judged again whether the angle storage signal S7 has switched on or not. If not on, the sequence moves on to step 505. If on, the sequence advances to step 504, where the rotary angle measured is transferred and stored to the angle setting circuit 300.

According to the apparatus in this embodiment, the machine needle rotates reversely to return upward when it is desired to change the position of the material or change the material after the machine needle has been lowered to a position immediately before the material, whereby it is easy to shift the position of the material or to change the material. It is to be noted that the stitching start or thread trimmer start operation is identical to those described in said conventional example and will not be described here.

A twentieth embodiment of the invention will now be described. The arrangement of the apparatus in this embodiment is identical to that in Embodiment 19 and will not be described.

After the threads have been trimmed by the thread trimmer start signal S2, the-sewing machine 1 enters a rotary angle measurement mode, wherein the angle of the machine pulley 4 hand-turned is measured. When the angle storage signal S7 is switched on, the rotary angle measured is transferred and stored to the angle setting circuit 300.

Figure 46:
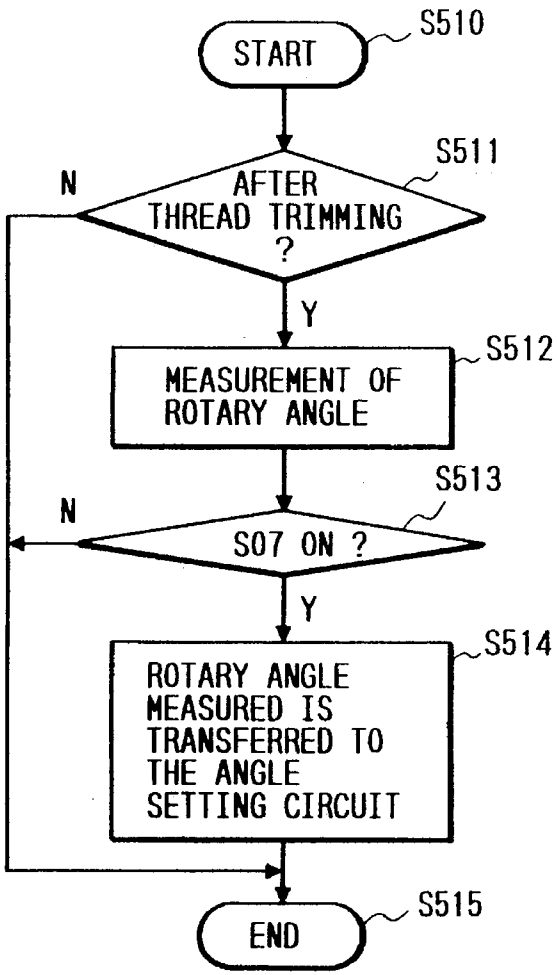
FIG. 46 is a flowchart illustrating the operation of a twentieth embodiment of the invention.
Figure 47:
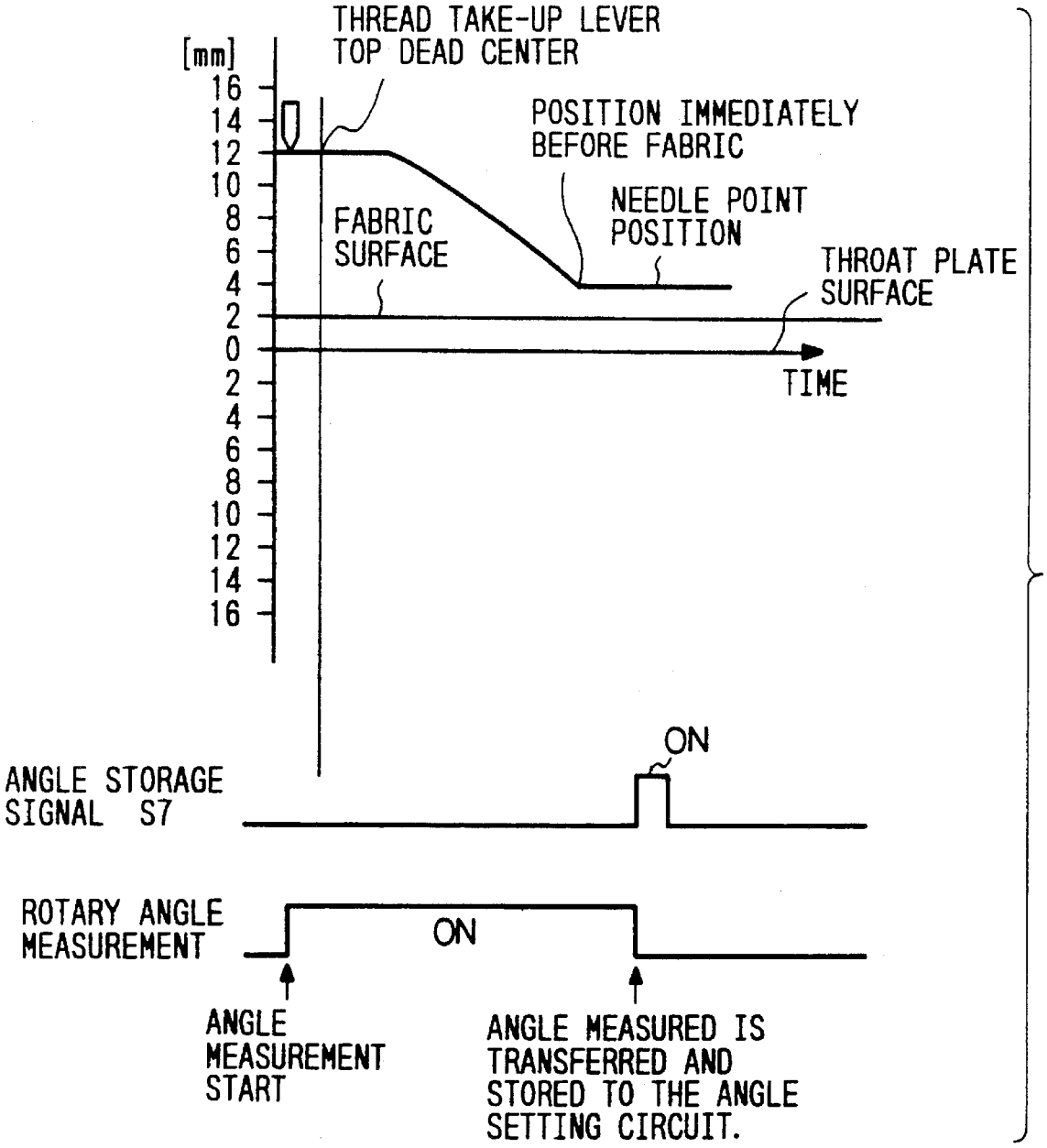
FIG. 47 is a timing chart of the twentieth embodiment of the invention.

The operation of the apparatus concerned with Embodiment 19 will now be described in accordance with a flowchart in FIG. 46 and a timing chart in FIG. 47. Starting at step 510, it is judged at step 511 whether the sewing machine 1 has finished thread trimming or not. If not, the sequence advances to END of step 515 and no further operation is performed.

If the sewing machine 1 has done thread trimming at step 511, the rotary angle is measured at step 512. If the angle storage signal S7 has switched on at step 513, the rotary angle measured is transferred and stored to the angle setting circuit 300. If the angle storage signal S7 is not on at step 513, the processing advances to step 515 and the angle is not stored.

According to the apparatus in this embodiment, the machine pulley 4 is hand-turned and the machine needle is actually brought to the stop position immediately before the material to store that position, whereby angle setting need not be repeated many times.

A twenty-first embodiment of the invention will now be described. The arrangement of the apparatus in this embodiment is also identical to that in said Embodiment 18 as in Embodiment 19 and will not be described.

After the threads have been cut under the control of the thread trimmer start signal S2 in this embodiment, the sewing machine 1 goes into a rotary angle measurement mode, wherein the angle of the machine pulley 4 hand-turned is measured. When the angle storage signal S7 is switched on, the rotary angle measured is compared with a given value. If it is less than the given value, the sewing machine 1 rotates in the forward direction by the jogging angle set by the angle setting circuit 300 and comes to a stop. If the rotary angle measured is equal to or more than the given value, it is measured and transferred and stored to the angle setting circuit 300.

Figure 48:
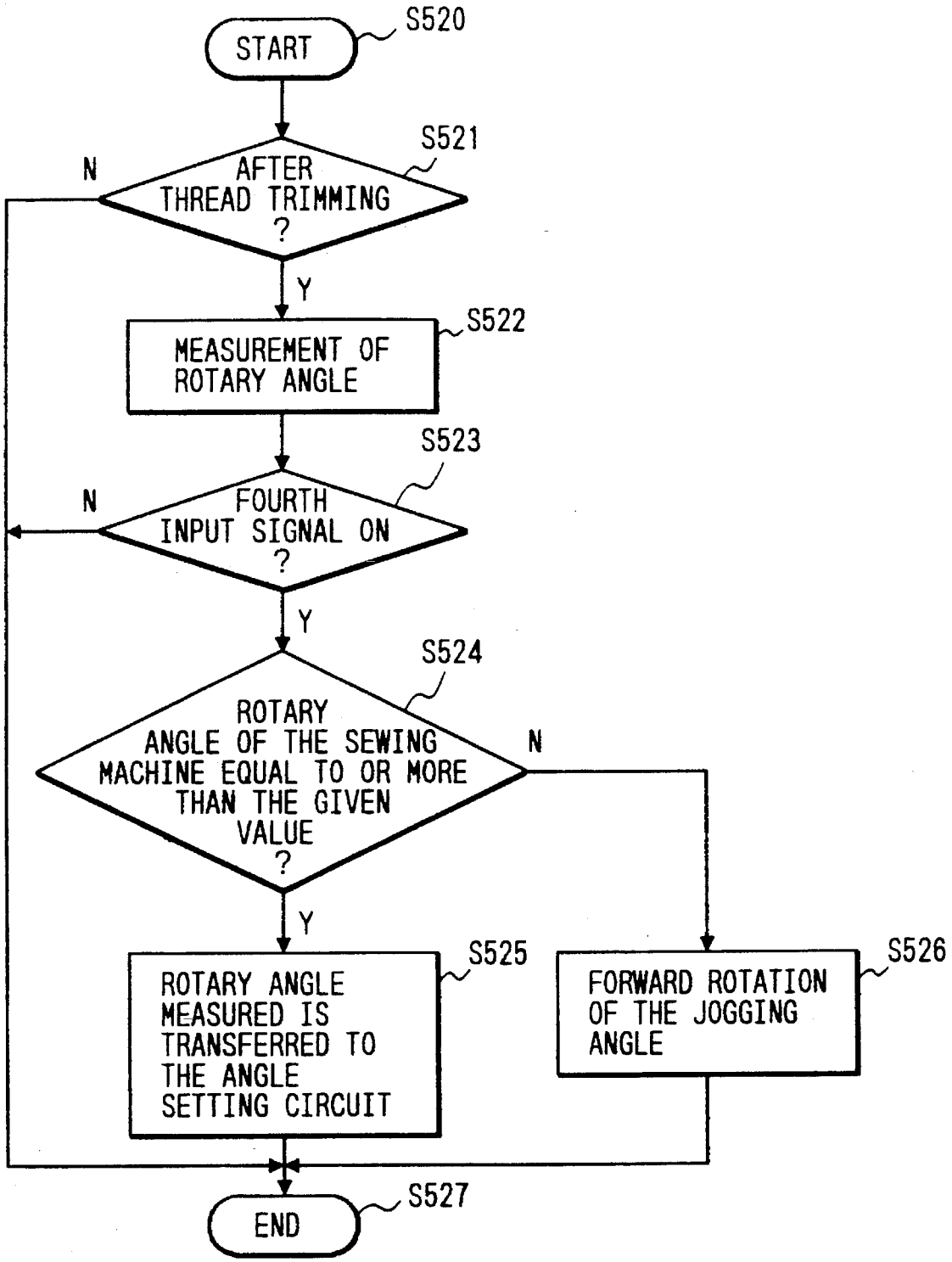
FIG. 48 is a flowchart illustrating the operation of a twenty-first embodiment of the invention.
Figure 49:
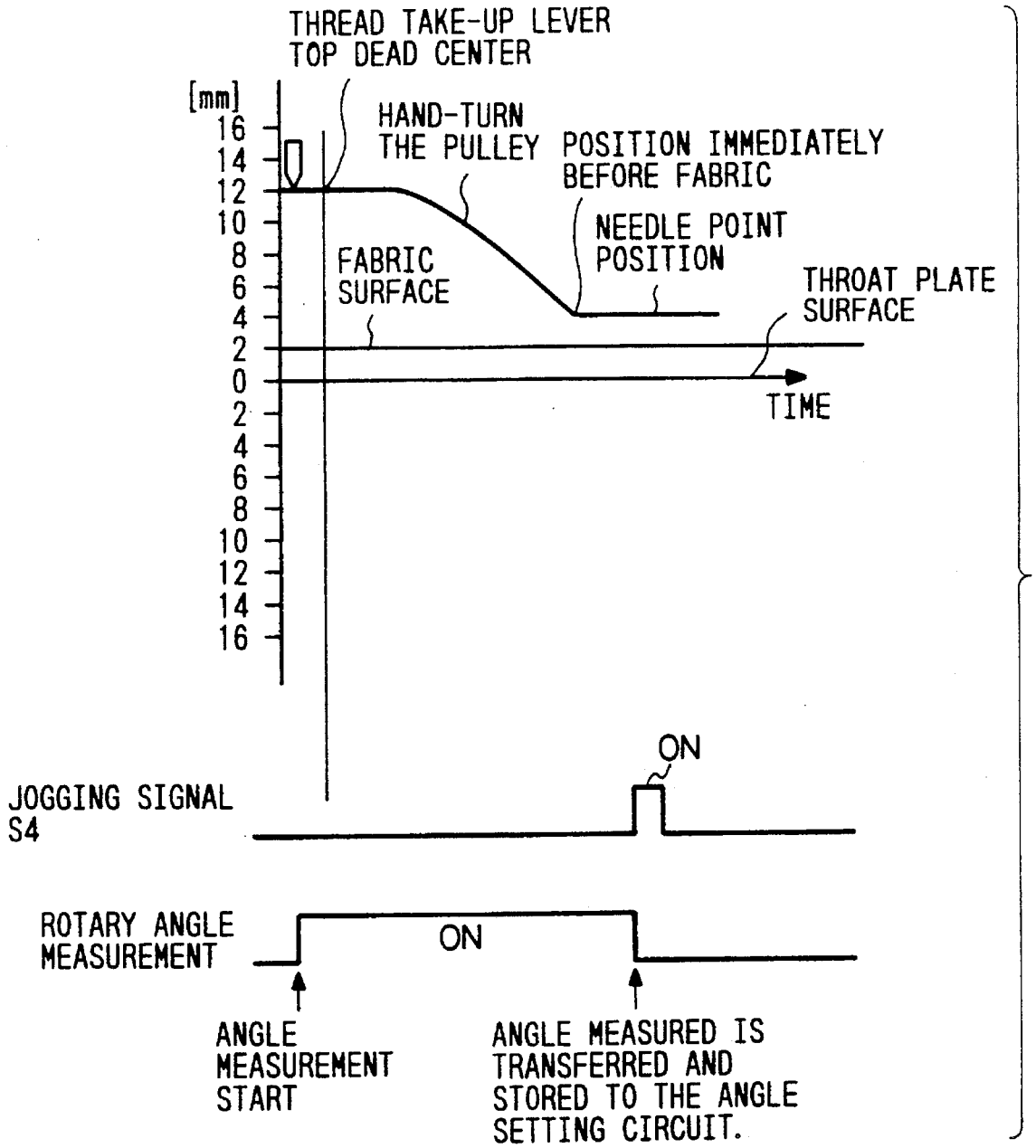
FIG. 49 is a timing chart at a time when the sewing machine pulley of the twenty-first embodiment of the invention has been rotated a given angle or more.

The operation of the apparatus concerned with this Embodiment 21 will now be described in accordance with a flowchart in FIG. 48 and timing charts in FIGS. 49 and 50.

Starting at step 520, it is judged at step 521 whether the sewing machine 1 has finished thread trimming or not. If not, the sequence advances to END of step 527 and no operation is performed.

If thread trimming has been done at step 521, the processing goes forward to step 522, where the measurement of the rotary angle is initiated. At step 523, it is judged whether the jogging signal S4 has turned on or not. If not on, the sequence progresses to END of step 527.

If the jogging signal S4 has turned on at step 523, the sequence proceeds to step 524, where it is judged whether the rotary angle of the sewing machine 1 is equal to or more than a given value. If it is less than the given value, the sequence progresses to step 526, where the sewing machine 1 rotates forward by the jogging angle set by the angle setting circuit 300 and comes to a stop as shown in the timing chart in FIG. 49.

Figure 50:
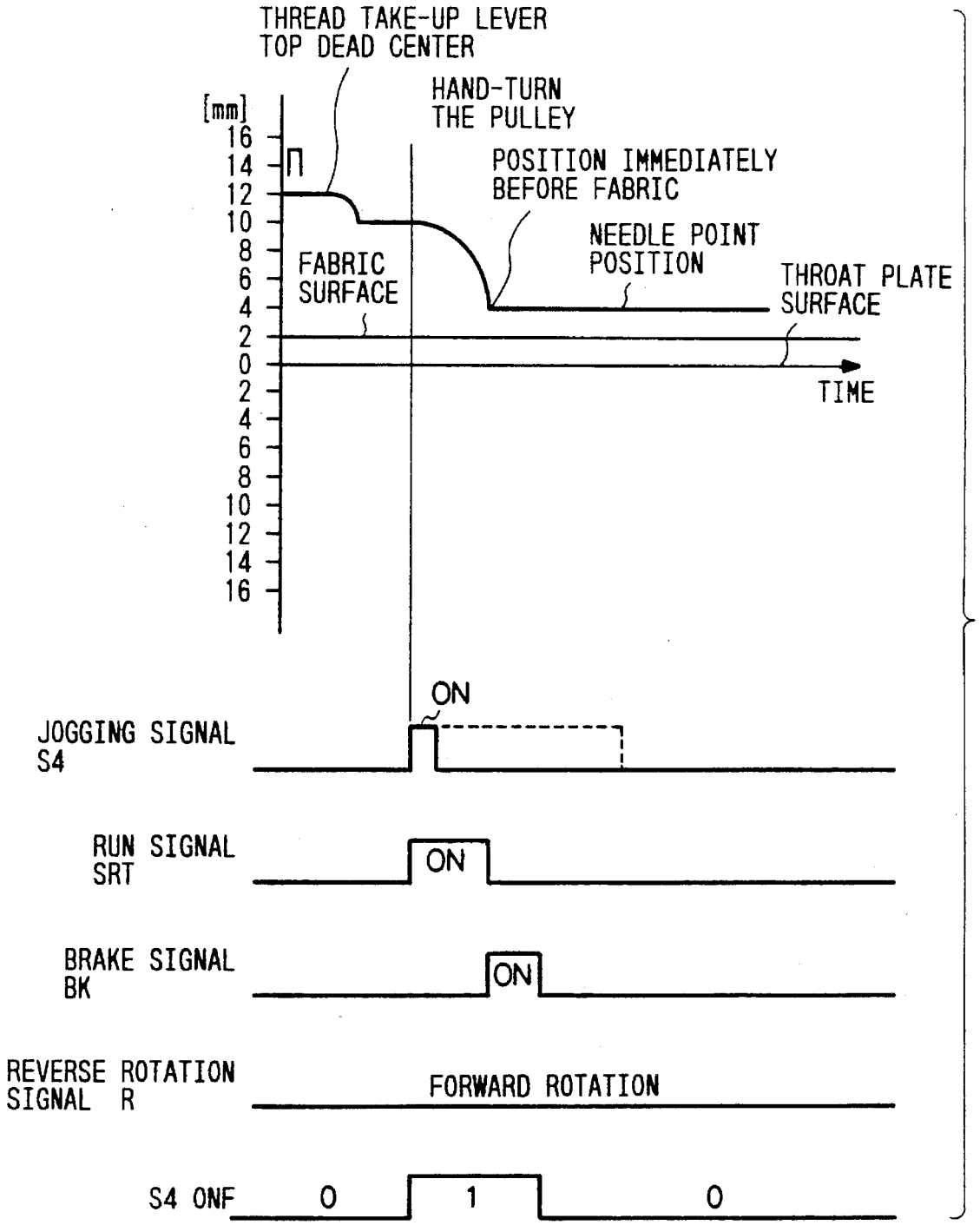
FIG. 50 is a timing chart at a time when the sewing machine pulley of the twenty-first embodiment of the invention has been rotated less than the given angle.

If that angle is not less than the given value, the sequence progresses to step 525, where the rotary angle measured is transferred and stored to the angle setting circuit 300 as shown in the timing chart in FIG. 50. The apparatus in this embodiment is lower in the number of entering the reverse rotation signals S5 and thus shorter in working time than the apparatus concerned with.

Figure 51:
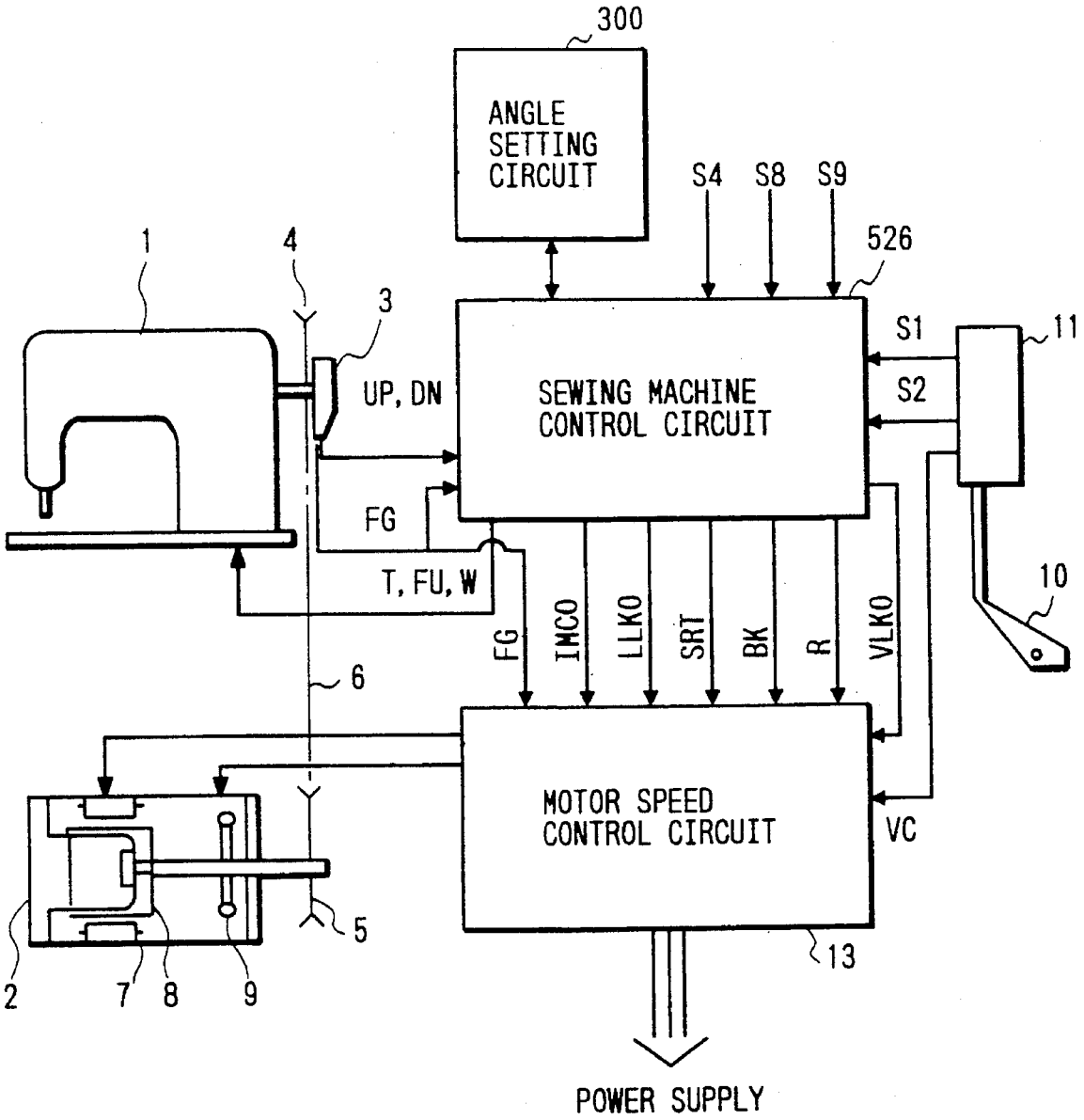
FIG. 51 is an arrangement diagram of a sewing machine controlling apparatus illustrating a twenty-second embodiment of the invention.

A twenty-second embodiment of the invention will now be described. FIG. 51 is an arrangement diagram of a sewing machine controlling apparatus according to the present embodiment, wherein 526 indicates a sewing machine control circuit detailed in FIG. 52, S8 designates an ultra-low speed input signal, and S9 denotes an ultra-low speed reverse rotation input signal.

In the present embodiment, when the ultra-low speed input signal S8 is entered in FIG. 51, the sewing machine 1 rotates forward at ultra-low speed (0.1 to 50 revolutions/second) lower than the low speed (100 to 300 revolutions/second) of the conventional sewing machine, the rotary angle is measured, and when the ultra-low speed input signal S8 is switched off, the rotary angle measured is transferred and stored to the angle setting circuit 300.

Figure 52:
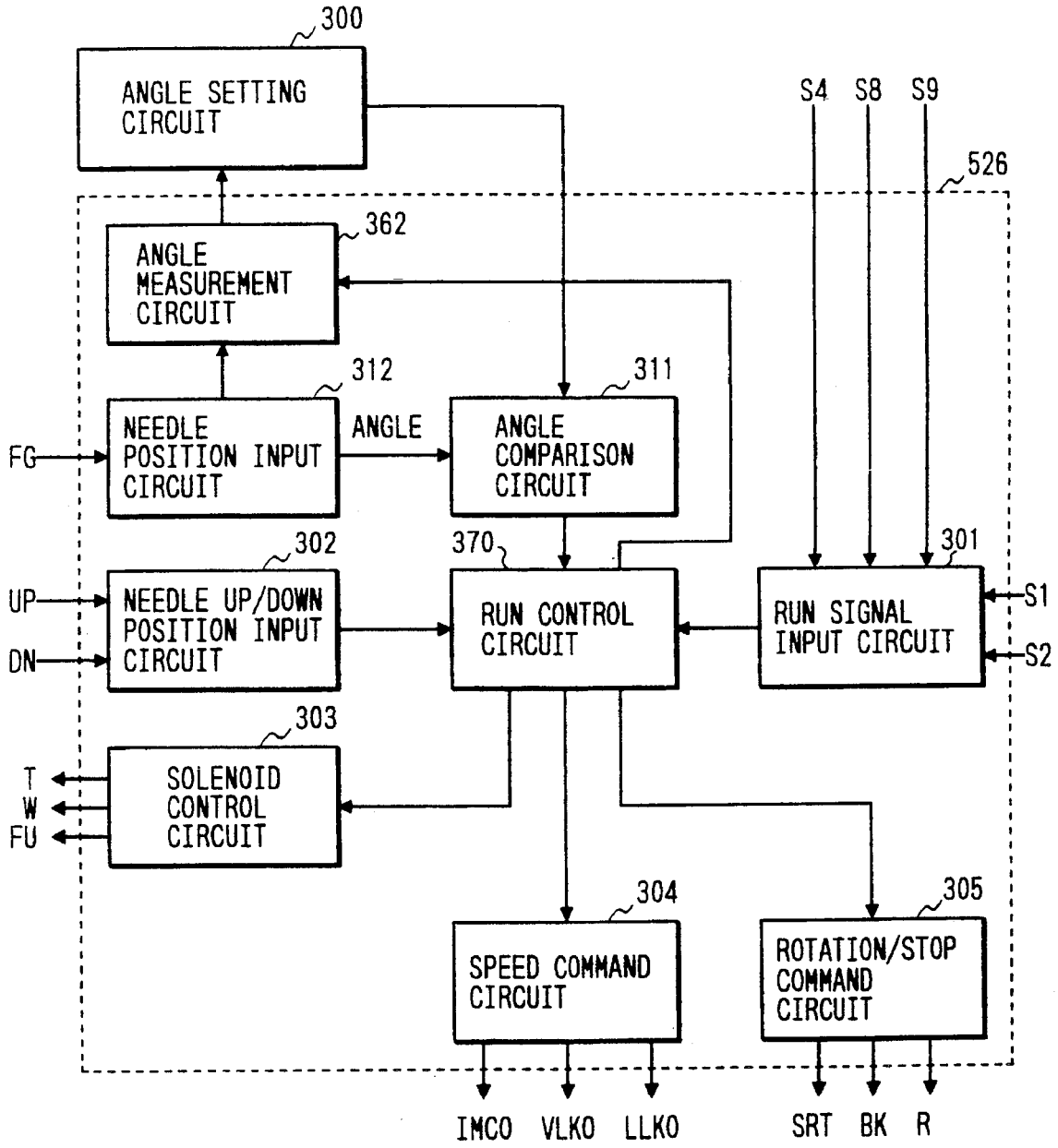
FIG. 52 is a detail drawing of a sewing machine control circuit shown in FIG. 51.

The operation of the apparatus in the present embodiment will now be described in accordance with a block diagram in FIG. 52. When the Ultra-low speed input signal S8 is entered into the run signal input circuit 301 of the sewing machine control circuit 526, an ultra-low speed command signal VLKO is output from the speed command circuit 304 via a run control circuit 370, and further the run signal SRT is output from the rotation/stop command circuit 305 to run the motor 2 at ultra-low speed. At the same time, the run control circuit 370 commands the angle measurement circuit 362 to measure the angle. This starts the measurement of the angle.

When the ultra-low speed input signal S8 is switched off, the run signal input circuit 301 commands the ultra-low speed command signal VLKO to be set to 0 by the speed command circuit 304 via the run control circuit 370 and the rotation/stop command circuit 305 switches the run signal SRT off and outputs the brake signal BK for a given time to stop the sewing machine 1. Simultaneously, the run control circuit 370 exercises control to cause the angle measurement circuit 362 to stop the measurement of the angle and transfer the angle measured to the angle setting circuit 300, whereby the jogging angle is stored to the angle setting circuit 300. Subsequently, when the stitching start signal S1 is entered, the sewing machine 1 rotates by the jogging angle stored in the angle setting circuit 300 and comes to a stop.

Figure 53:
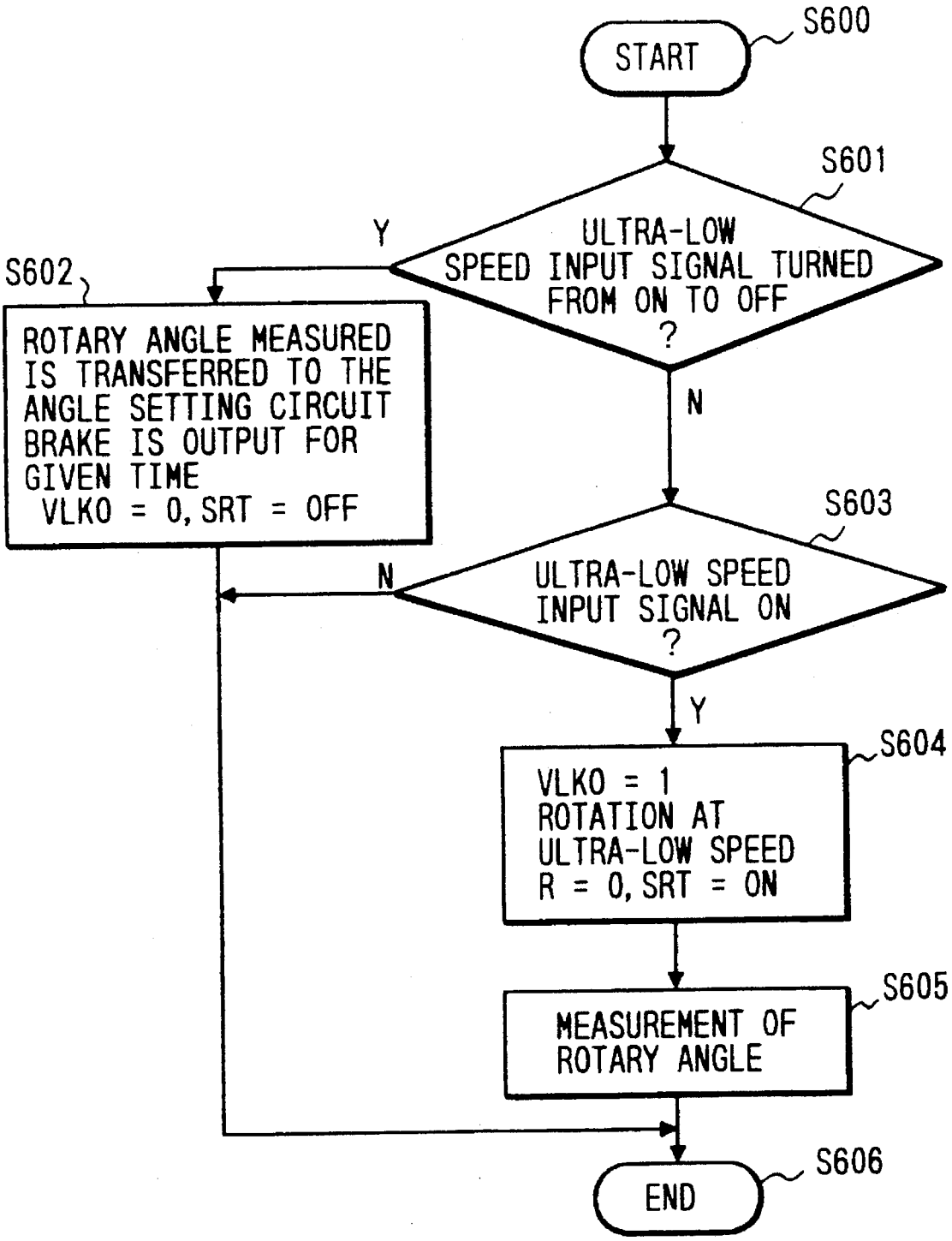
FIG. 53 is a flowchart illustrating the operation of the twenty-second embodiment of the invention.

The operation of the apparatus in the present embodiment will be described in accordance with a flowchart in FIG. 53. Starting at step 600, it is judged at step 601 whether the ultra-low speed input signal S8 has turned from ON to OFF. If not, the sequence advances to step 603, where it is judged whether the ultra-low speed input signal S8 is on or not. If the ultra-low speed input signal S8 is on, the sequence moves to step 604, where the ultra-low speed command signal VLKO is set to 1 and the run signal SRT is switched on, whereby the sewing machine 1 rotates at ultra-low speed and the rotary angle is measured at step 605.

If the ultra-low speed input signal S8 has turned from ON to OFF at step 601, the ultra-low speed command signal VLKO is set to 0, the run signal SRT is switched off, and the brake signal BK is switched on for a given time at step 602 to stop the sewing machine 1, and the rotary angle measured is transferred and stored to the angle setting circuit 300. It is to be understood that the stitching start or thread trimmer start operation is identical to that described in said conventional example and will not be described here.

Figure 54:
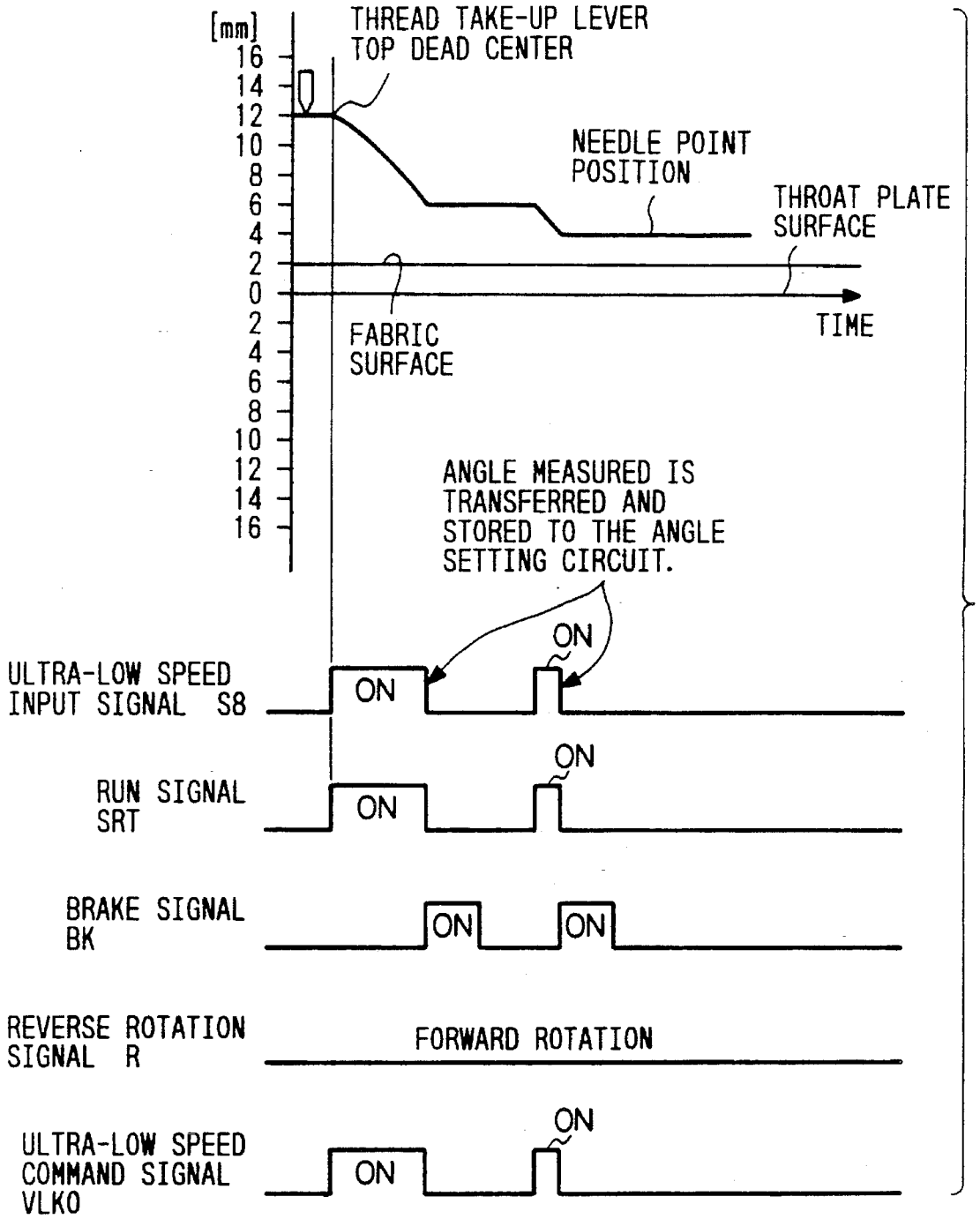
FIG. 54 is a timing chart of the twenty-second embodiment of the invention.

When the ultra-low speed input signal S8 is switched on in a timing chart in FIG. 54, the run signal SRT and the ultra-low speed command signal VLKO are output to run the sewing machine 1 at ultra-low speed and measure the rotary angle beginning with the start of operation.

When the ultra-low speed input signal S8 is switched off, the run signal SRT and the ultra-low speed command signal VLKO are switched off, the brake signal BK is switched on for a given time, and the angle measured is transferred and stored to the angle setting circuit 300. By switching the ultra-low speed input signal S8 on again when the point of the machine needle has not reached the immediately-before-the-material position which was the destination, the sewing machine 1 rotates at ultra-low speed similarly and the rotary angle is counted in addition to the previous angle. When the ultra-low speed input signal S8 is switched off, the sewing machine 1 stops and the angle measured is transferred and stored to the angle setting circuit 300 similarly. It is to be understood that the stitching start or thread trimmer start operation is identical to that described in said conventional example and will not be described here.

A sewing machine controlling apparatus concerned with a twenty-third embodiment of the invention will now be described. In this embodiment, the arrangement of the sewing machine controlling apparatus is identical to that in Embodiment 22 in FIGS. 51 and 52 and will not be described. When the ultra-low speed input signal S8 is entered in FIG. 51, the sewing machine 1 rotates forward at ultra-low speed, the rotary angle is measured, and when the ultra-low speed input signal S8 is switched off, the rotary angle measured is transferred and stored to the angle setting circuit 300. When the ultra-low speed reverse rotation input signal S9 is entered, the sewing machine 1 rotates reversely at ultra-low speed, the rotary angle is measured, and when the ultra-low speed reverse rotation input signal S9 is switched off, a difference between the forward and reverse rotation angles is calculated and the rotary angle measured is transferred and stored to the angle setting circuit 300.

The operation of the apparatus in the present embodiment will now be described in accordance with the block diagram in FIG. 52. The operation at a time when the ultra-low speed input signal S8 is entered is identical to that in Embodiment 22. When the ultra-low speed reverse rotation signal S9 is entered into the run signal input circuit 301 of the sewing machine control circuit 526, the ultra-low speed command signal VLKO is output from the speed command circuit 304 via the run control circuit 370, further the run signal SRT is output from the rotation/stop command circuit 305, and the reverse rotation signal R is switched on to run the sewing machine 1 in the reverse direction at ultra-low speed.

At the same time, the run control circuit 370 commands the angle measurement circuit 362 to measure the angle. This starts the measurement of the angle.

When the ultra-low speed reverse rotation input signal S9 is switched off, the run signal input circuit 301 commands the ultra-low speed command signal VLKO to be switched off by the speed command circuit 304 via the run control circuit 370 and the rotation/stop command circuit 305 switches off the run signal SRT and the reverse rotation signal R and outputs the brake signal BK for a given time to stop the sewing machine 1.

Simultaneously, the run control circuit 370 exercises control to cause the angle measurement circuit 362 to stop the measurement of the angle and transfer the angle measured to the angle setting circuit 300, whereby the jogging angle is stored to the angle setting circuit 300. Subsequently, when the jogging signal S4 is entered, the sewing machine 1 rotates by the jogging angle stored in the angle setting circuit 300 and comes to a stop.

Figure 55:
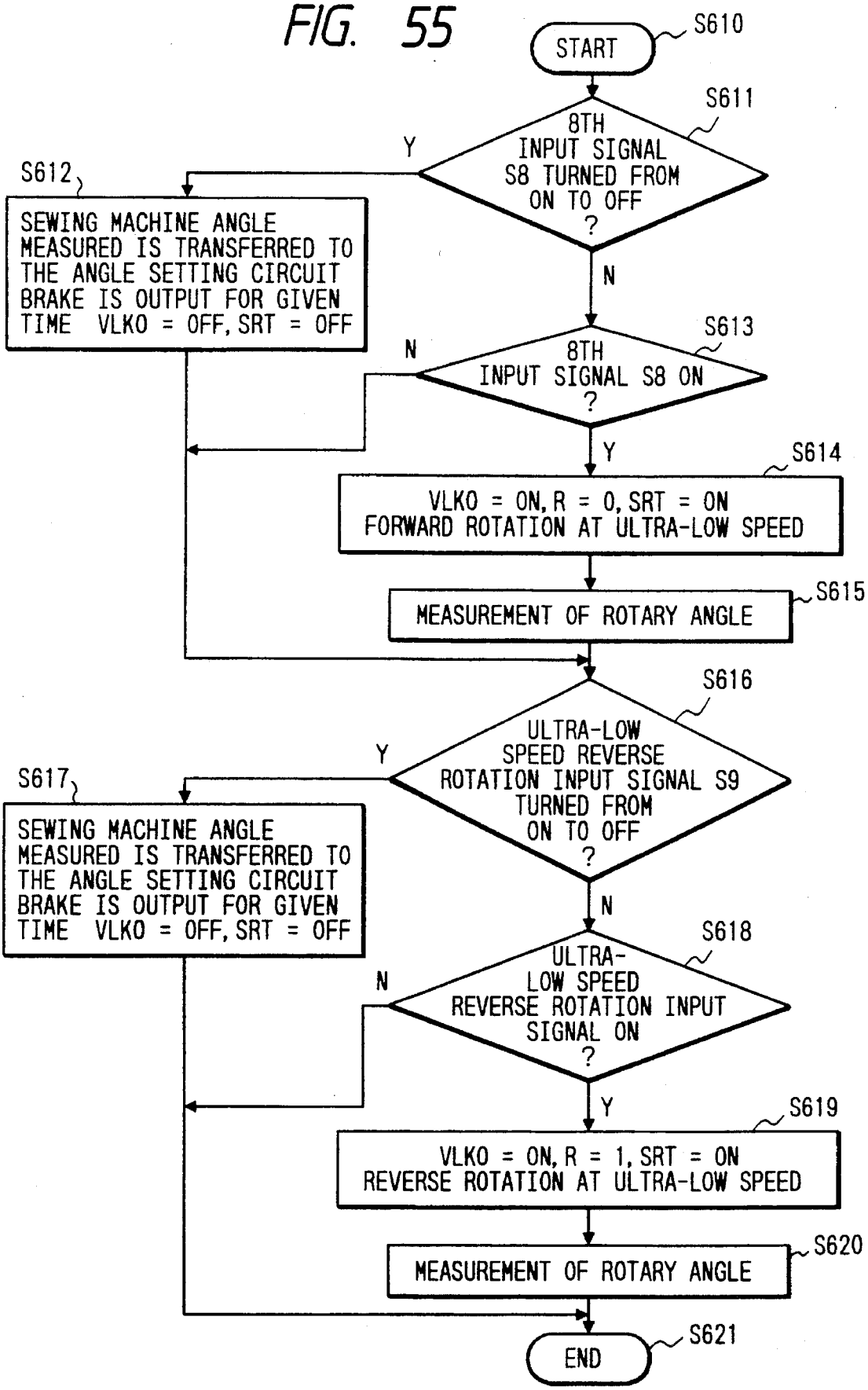
FIG. 55 is a flowchart illustrating the operation of a twenty-third embodiment of the invention.

The operation of the apparatus given in Embodiment 23 will be described in accordance with a flowchart in FIG. 55. Starting at step 610, it is judged at step 611 whether or not the ultra-low speed input signal S8 has turned from ON to OFF. If not, the sequence advances to step 613, where it is judged whether the ultra-low speed input signal S8 is on or not. If the ultra-low speed input signal S8 is on, the sequence moves to step 614, where the ultra-low speed command signal VLKO is switched on, the run signal SRT is switched on, and the reverse rotation signal R is switched off, whereby the sewing machine 1 rotates forward at ultra-low speed and the rotary angle is measured at step 615.

If the ultra-low speed input signal S8 has turned from ON to OFF at step 611, the ultra-low speed command signal VLKO is switched off, the run signal SRT is switched off, and the brake signal BK is switched on for a given time at step 612 to stop the sewing machine 1 and to transfer and store the rotary angle measured to the angle setting circuit 300.

At step 616, it is judged whether the ultra-low speed reverse rotation input signal S9 has turned from ON to OFF. If not, the sequence advances to step 618, where it is judged whether the ultra-low speed reverse rotation input signal S9 is on or not. If the ultra-low speed reverse rotation input signal S9 is on, the sequence moves to step 618, where the ultra-low speed command signal VLKO is switched on, the run signal SRT is switched on, and the reverse rotation signal R is set to 1, whereby the sewing machine 1 reverses at ultra-low speed and the rotary angle is measured at step 620.

If the ultra-low speed reverse rotation input signal S9 has turned from ON to OFF at step 616, the ultra-low speed command signal VLKO is switched off, the run signal SRT is switched off, and the brake signal BK is switched on for a give time at step 617 to stop the sewing machine 1 and to transfer and store the rotary angle measured to the angle setting circuit 300.

Figure 56:
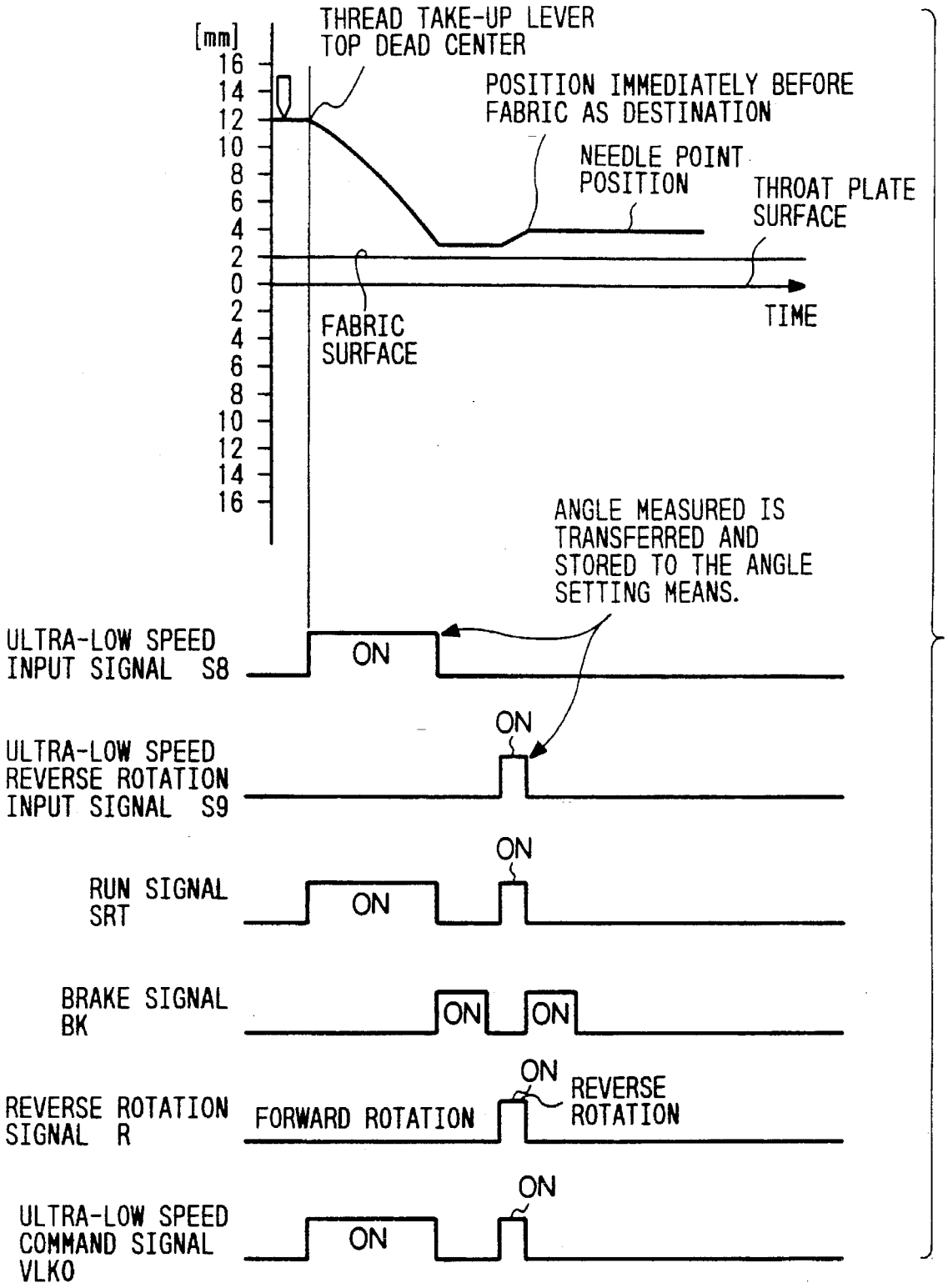
FIG. 56 is a timing chart of the twenty-third embodiment of the invention.

When the ultra-low speed input signal S8 is first switched on in a timing chart in FIG. 56, the run signal SRT and the ultra-low speed command signal VLKO are switched on and the reverse rotation signal R is switched off to run the sewing machine 1 forward at ultra-low speed and measure the rotary angle beginning with the start of operation.

When the ultra-low speed input signal S8 is switched off, the run signal SRT and the ultra-low speed command signal VLKO are switched off, the brake signal BK is switched on for a given time, and the angle measured is transferred and stored to the angle setting circuit 300. By switching on the ultra-low speed reverse rotation input signal S9 when the point of the machine needle is lower than the immediately-before-the-material position which was the destination, the sewing machine 1 reverses at ultra-low speed and the rotary angle is subtracted in addition to the previous angle. When the ultra-low speed reverse rotation input signal S9 is switched off, the sewing machine 1 stops and the angle measured is transferred and stored to the angle setting circuit 300 similarly. According to the apparatus in the present embodiment, the sewing machine 1 can be actually rotated under the control of the ultra-low speed input signal to match the point of the machine needle with the position immediately before the material, with the machine pulley 4 untouched, whereby a safe apparatus is provided.

Figure 57:
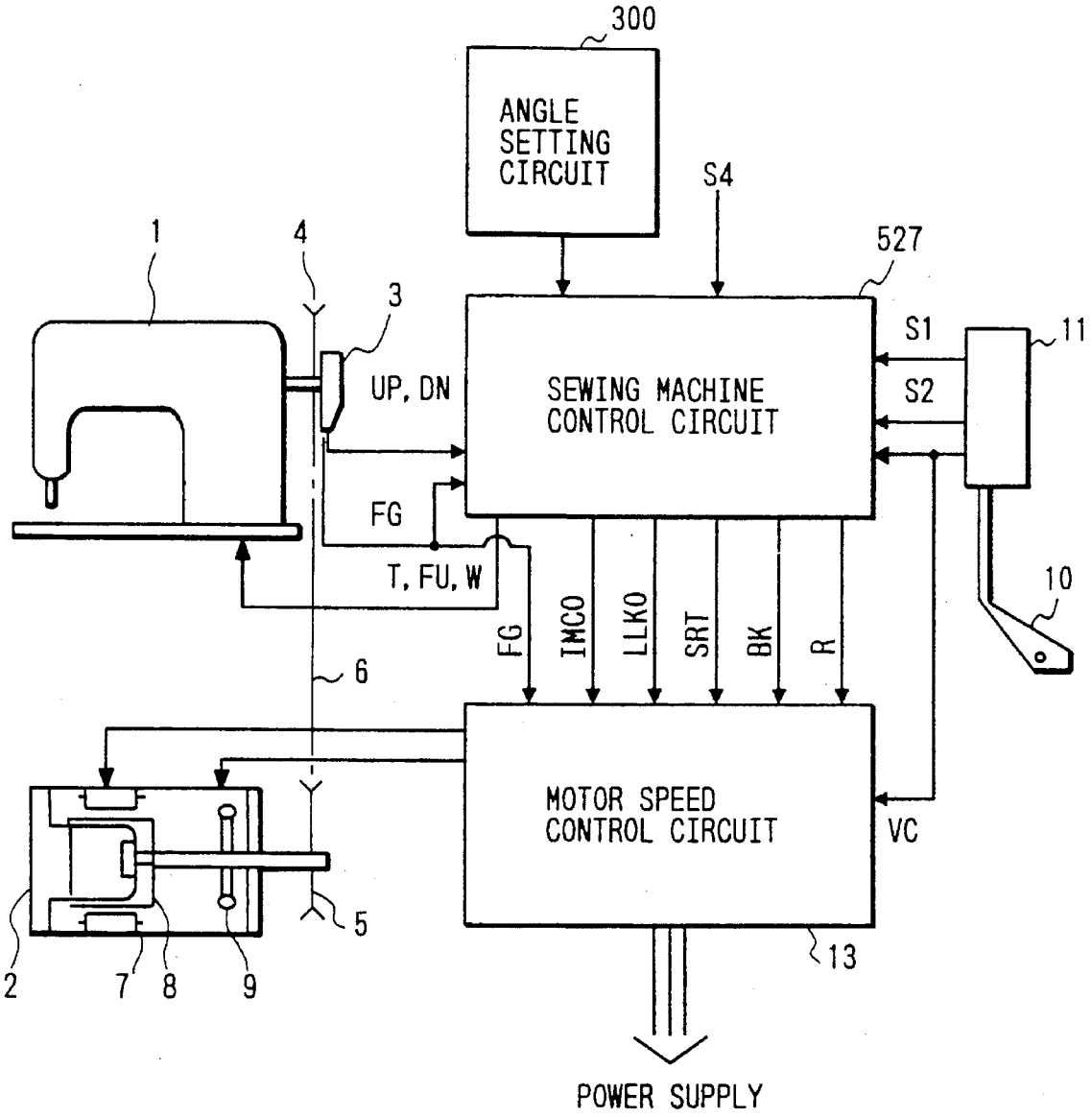
FIG. 57 is an arrangement diagram of a sewing machine controlling apparatus illustrating a twenty-fourth embodiment of the invention.

A sewing machine controlling apparatus concerned with a twenty-fourth embodiment of the invention will now be described. FIG. 57 is an arrangement diagram illustrating the sewing machine controlling apparatus concerned with the present embodiment, wherein 527 indicates a sewing machine control circuit which is detailed in FIG. 58.

Figure 58:
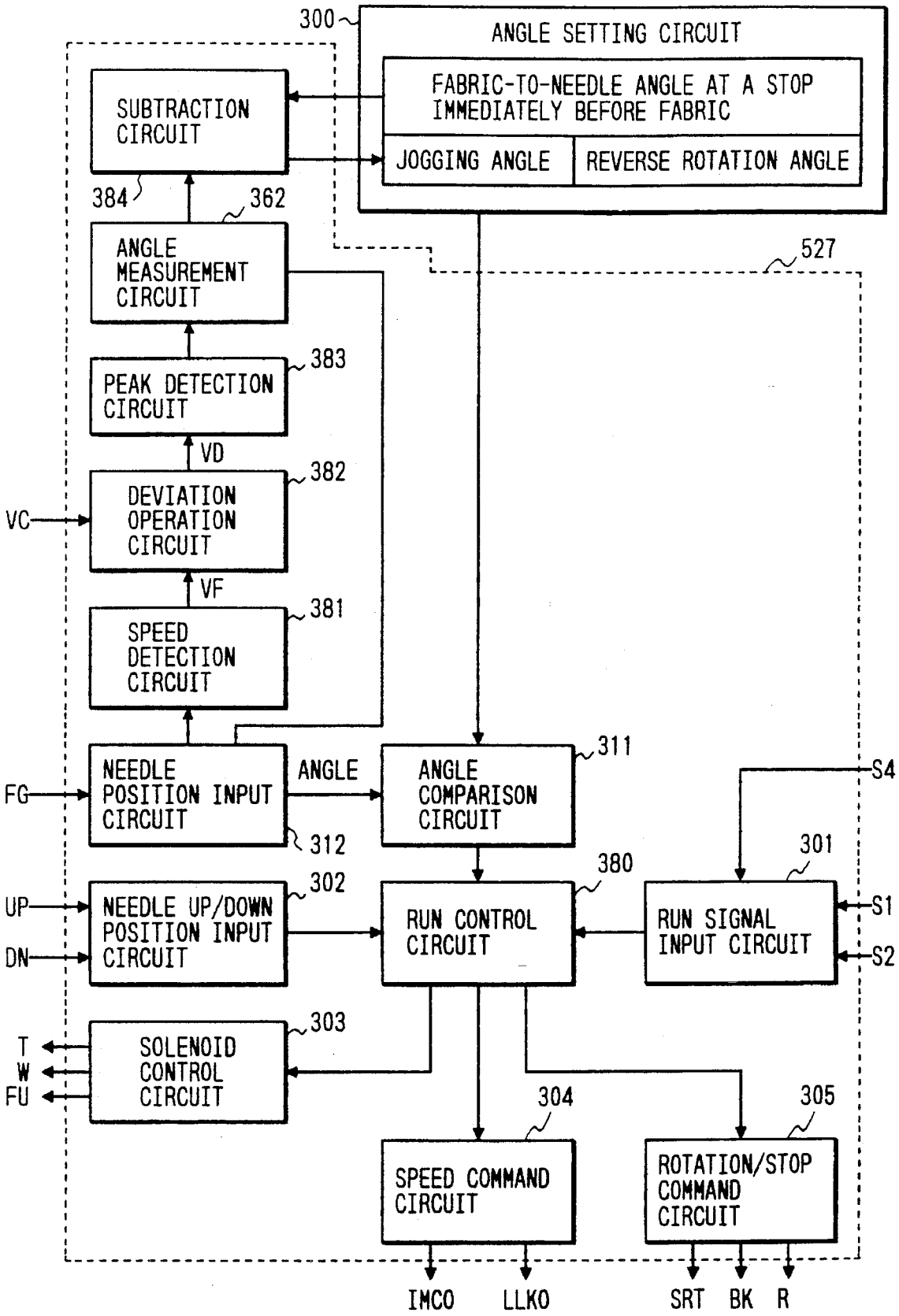
FIG. 58 is a detail drawing of a sewing machine control circuit shown in FIG. 57.

In this embodiment, when the stitching start signal S1 is entered into the run signal input circuit 301 in FIG. 58, it passes through the run control circuit 380 and reaches the rotation/stop command circuit 305, which then outputs the run signal SRT to run the sewing machine 1 at the speed under the control of the speed command signal VC according to the toe-down degree of the pedal 10.

During the rotation of the sewing machine 1, speed deviation between the speed command signal VC and the rotary speed of the sewing machine 1, which has been converted by the speed detection circuit 381 from the position detection signal FG of the needle position detector 3 entered via the needle position input circuit 312, is operated on by a deviation operation circuit 382. When the speed deviation is large, i.e., when the load of the sewing machine 1 has increased, peak torque, i.e., the time when the material is pierced, is detected by a peak detection circuit 383. When the peak torque is detected by the peak detection circuit 383, the rotary angle at which the torque peaked is measured by the angle measurement circuit 362. The material-to-machine needle angle at the time of immediately-before-the-material stop set to the angle setting circuit 300 is subtracted from the rotary angle at which the torque peaked, and the result of subtraction is stored into the jogging angle area of the angle setting circuit 300.

When the jogging signal S4 is entered after the machine needle has stopped at the UP position, the sewing machine 1 rotates the jogging angle stored and the needle point of the sewing machine 1 stops at a position immediately before the material.

Figure 59:
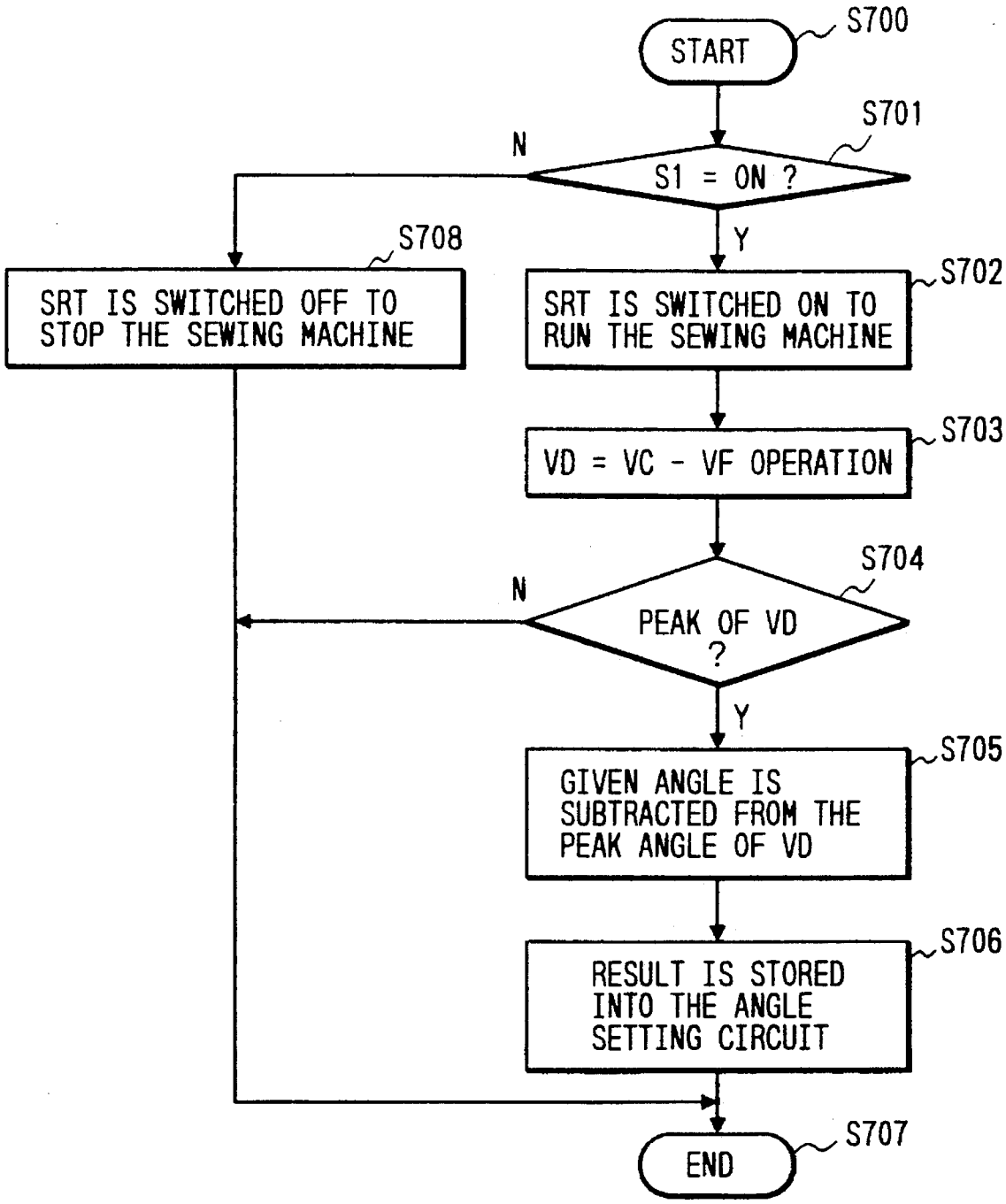
FIG. 59 is a flowchart illustrating the operation of the twenty-fourth embodiment of the invention.

FIG. 59 is an operation flowchart of the sewing machine controlling apparatus 527 according to the present embodiment.

Starting at step 700, it is judged at step 701 whether the stitching start signal S1 is on or not. If it is on, the processing advances to step 702, where the run signal SRT is switched on to start the sewing machine 1 running. At step 703, a difference between the speed command signal VC and a speed feedback signal VF, i.e., speed deviation VD, is operated on.

At step 704, the peak of the speed deviation VD is detected. When the torque peaks, the material-to-machine needle angle at the time of immediately-before-the-material stop is subtracted from the rotary speed of the sewing machine 1 at which the torque peaks, i.e., the angle at a time when the material is pierced, at step 705. At step 706, the result of subtraction is transferred and stored to the angle setting circuit 300.

If the stitching start signal S1 is not on at step 701, the run signal SRT is switched off to stop the sewing machine 1.

Figure 60:
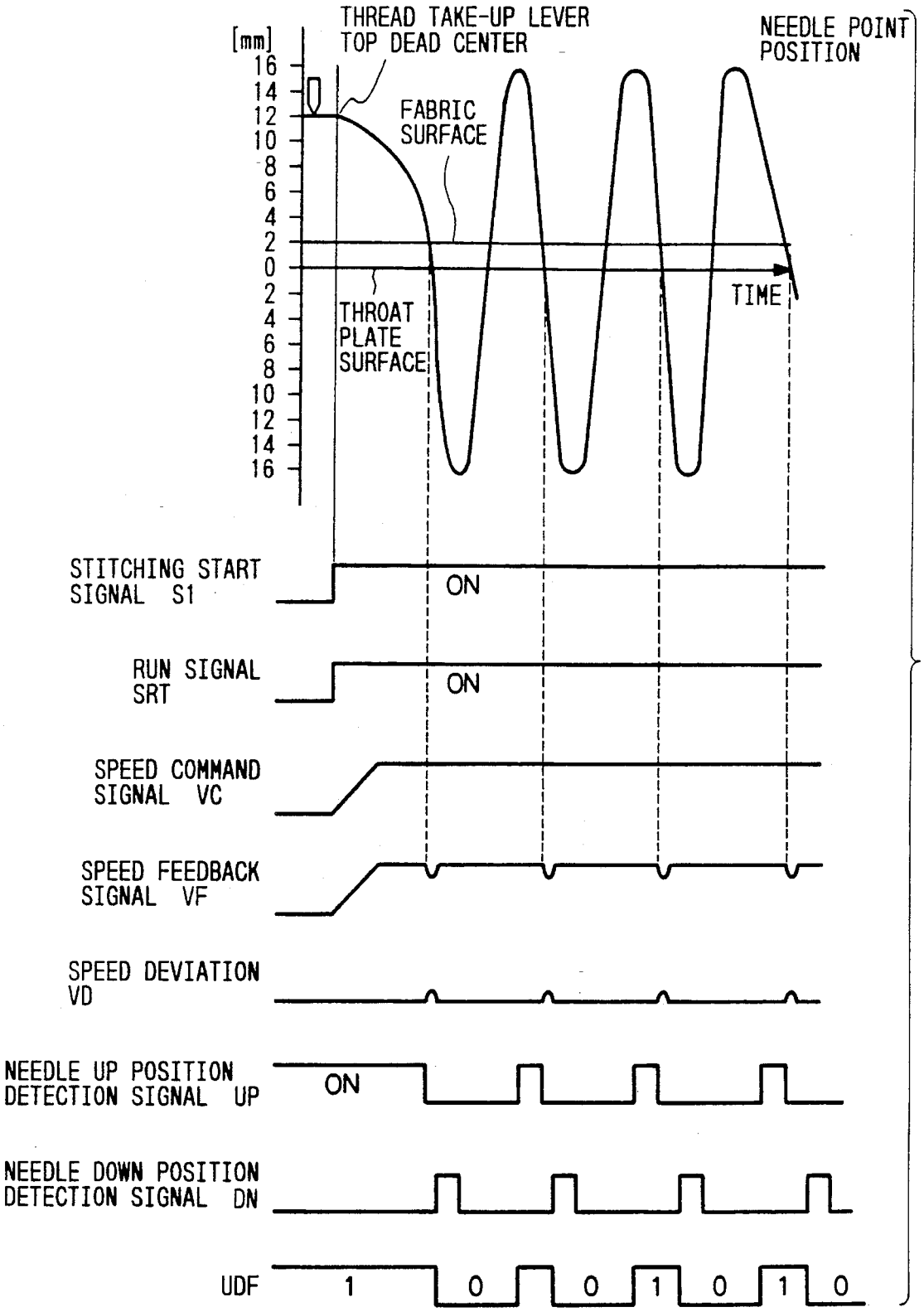
FIG. 60 is a timing chart of a twenty-fifth embodiment of the invention.

FIG. 60 is an operation timing chart. When the pedal 10 is toed down, the stitching start signal S1 is switched on. As the speed command signal VC increases according to the toe-down degree of the pedal 10, the speed control circuit 13 runs the motor 2 to exercise feedback control so that the speed of the sewing machine 1 matches the speed command signal VC.

When the machine needle point has reached the surface of the material, the peak torque is generated and the speed feedback signal VF reduces slightly. The speed deviation VD between this reduced speed feedback signal VF and the speed command signal VC peaks when the material is pierced with the machine needle. The material-to-machine needle angle at the time of immediately-before-the-material stop in the angle setting circuit 300 is subtracted from the angle at the time of piercing the material from the angle measurement circuit 362, and the result of subtraction is transferred and stored to the jogging angle area of the angle setting circuit 300. When the material-to-needle angle is preset, the apparatus according to the present embodiment does not require the immediately-before-the-material stop position to be re-adjusted if the thickness of the material changes. It is to be noted that the stitching start or thread trimmer start operation is as described in said conventional example and will not be described here.

A sewing machine controlling apparatus concerned with a twenty-fifth embodiment of the invention will now be described. In this embodiment, the arrangement diagram of the sewing machine controlling apparatus is identical to that in FIG. 57 of Embodiment 23 and will not be described.

In this Embodiment 25, when the stitching start signal S1 is entered into the run signal input circuit 301 in FIG. 58, it passes through the run control circuit 380 and reaches the rotation/stop command circuit 305, which then outputs the run signal SRT to run the sewing machine 1 at the speed under the control of the run signal SRT according to the toe-down degree of the pedal 10.

During the rotation of the sewing machine 1, speed deviation between the speed command signal VC and the rotary speed of the sewing machine 1, which has been converted by the speed detection circuit 381 from the position detection signal FG of the needle position detector 3 entered via the needle position input circuit 312, is operated on by the deviation operation circuit 382. When the speed deviation is large, i.e., when the load of the sewing machine 1 has increased, peak torque, i.e., the time when the material is pierced, is detected by the peak detection circuit 383. When the peak torque is detected by the peak detection circuit 383 and the machine needle is in the range from the UP position to the DOWN position, the rotary angle at which the torque peaked is measured by the angle measurement circuit 362. The material-to-machine needle angle at the time of immediately-before-the-material stop set to the angle setting circuit 300 is subtracted from the rotary angle at which the torque peaked, and the result of subtraction is stored into the jogging angle area of the angle setting circuit 300.

When the jogging signal S4 is entered after the machine needle has stopped at the UP position, the sewing machine 1 rotates the jogging angle stored and the needle point of the sewing machine 1 stops at a position immediately before the material.

Figure 61:
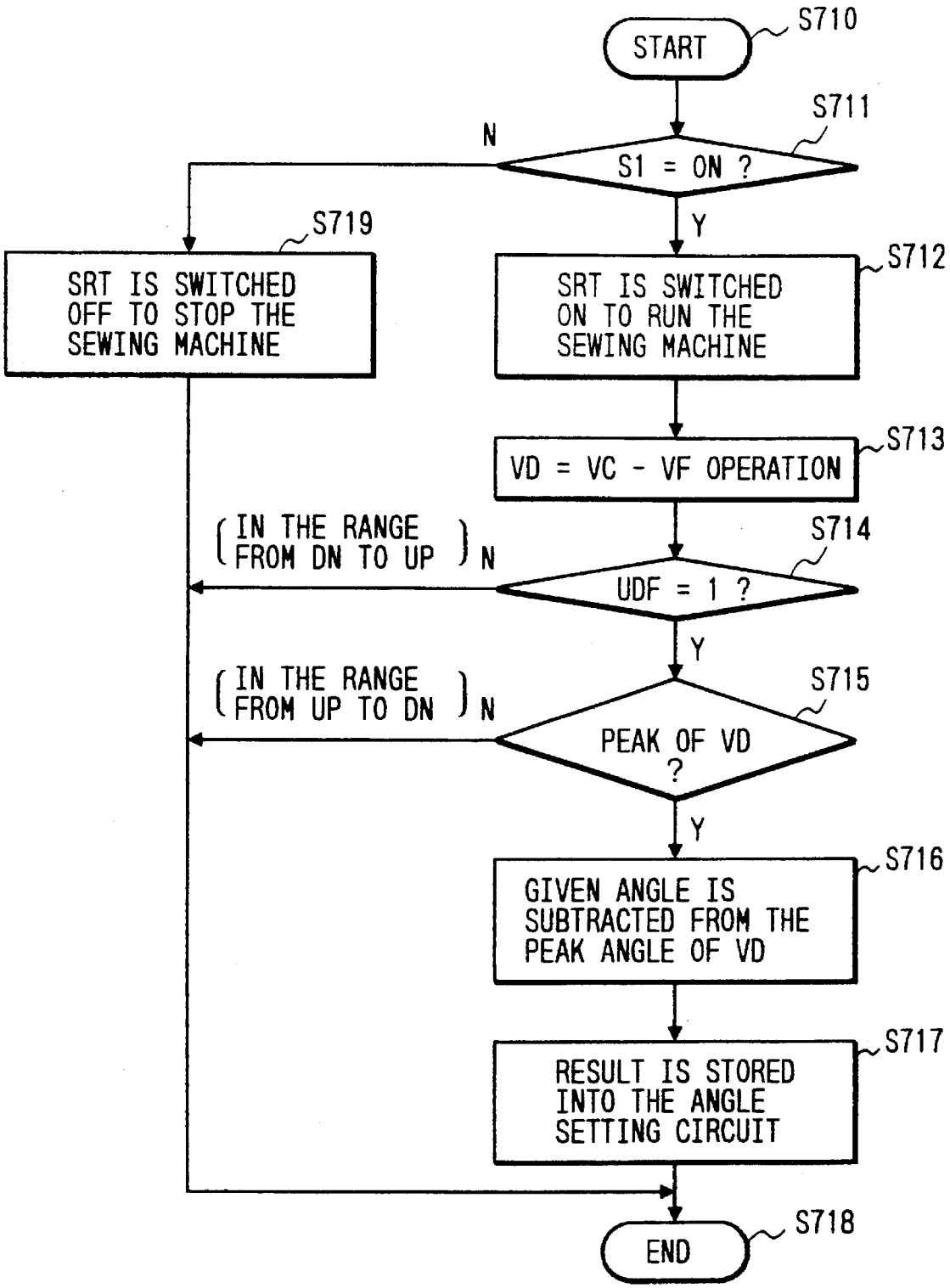
FIG. 61 is a flowchart illustrating the operation of the twenty fifth embodiment of the invention.

FIG. 61 is an operation flowchart of the sewing machine controlling apparatus 527 according to the present embodiment 23. Starting at step 710, it is judged at step 711 whether the stitching start signal S1 is on or not. If it is on, the processing advances to step 712, where the run signal SRT is switched on to start the sewing machine 1 running. At step 713, a difference between the speed command signal VC and the speed feedback signal VF, i.e., speed deviation VD, is operated on. At step 714, it is judged whether or not the machine needle is in the range from the UP position to the DOWN position. If the needle is in that range, the sequence progresses to step 715. If not, the sequence proceeds to step 718.

At step 715, the peak of the speed deviation VD is detected. When the torque peaks, the material-to-machine needle angle at the time of immediately-before-the-material stop is subtracted from the rotary speed of the sewing machine 1 at which the torque peaks, i.e., the angle at a time when the material is pierced, at step 716. At step 717, the result of subtraction is transferred and stored to the angle setting circuit 300.

If the stitching start signal S1 is not on at step 711, the run signal SRT is switched off to stop the sewing machine 1.

FIG. 60 is an operation timing chart. When the pedal 10 is toed down, the stitching start signal S1 is switched on. As the speed command signal VC increases according to the toe-down degree of the pedal 10, the speed control circuit 13 runs the motor 2 to exercise feedback control so that the speed of the sewing machine 1 matches the speed command signal VC.

When the machine needle point has reached the surface of the material, the peak torque is generated and the speed feedback signal VF reduces slightly. The speed deviation VD between this reduced speed feedback signal VF and the speed command signal VC peaks when the material is pierced with the machine needle. The material-to-machine needle angle at the time of immediately-before-the-material stop in the angle setting circuit 300 is subtracted from the angle at the time of piercing the material from the angle measurement circuit 362, and the result of subtraction is transferred and stored to the jogging angle area of the angle setting circuit 300.

To prevent the peak torque generated to pull the machine thread when the machine needle rises except when the material is pierced from being misrecognized, a flag UDF indicating that the needle is in the range from the UP position to the DOWN position is provided so that the angle at the peak torque time may only be read when the flag UDF is 1. According to the apparatus in this embodiment, the torque which peaks within the position where the material is pierced with the machine needle is removed as noise, whereby the fabric surface position can be detected reliably.

The needle position detector 3 for detecting the rotary angle of the sewing machine 1 in each of the previous embodiments is not limited to the one provided on the machine shaft and may be provided on the motor shaft, for example, to calculate the angle of the machine shaft according to the pulley ratio.

Also, the motor 2 and the sewing machine 1 designed to be driven via the belt 6 may be coupled directly. Further, the two signals, the needle UP position signal UP and the needle DOWN position signal DN, which were used for calculation, may be replaced by one signal, i.e., the position detection signal FG of the needle position detector 3. Also, the one angle of the needle bar, i.e., the jogging angle or the reverse rotation angle, may be separately provided for forward rotation and reverse rotation.

Also, in addition to the jogging angle and the reverse rotation angle set individually, another signal indicating the stop position may be provided for the needle position detector 3. Also, the reverse rotation angle set may be substituted by the needle UP position signal UP, the needle DOWN position signal DN, or the needle position signal.

The one jogging angle or one reverse rotation angle set may be two or more and selecting means may be provided to select from among those set. The jogging angle setting circuit or the reverse rotation angle setting circuit may be comprised of a seven-segment LED and a switch or may use a variable resistor.

What is claimed is:

1. A sewing machine controlling apparatus comprising:

reversible sewing machine drive means for driving a sewing machine pulley in forward and reverse directions and for moving a needle at least between UP and DOWN positions;

thread trimming means for providing a thread trimming operation;

control means for controlling said sewing machine drive means and said thread trimming operation;

needle position detection means for detecting the needle position of said sewing machine;

jogging angle setting means for setting a jogging angle of said sewing machine pulley, and means for operating said thread trimming means in response to a jogging signal, and for controlling forward rotation of said sewing machine pulley after the needle position of said sewing machine has reached an UP position, wherein said sewing machine pulley is rotated until said jogging angle set by said jogging angle setting means is reached.

2. A sewing machine controlling apparatus comprising:

sewing machine drive means for driving a sewing machine pulley;

control means responsive to a plurality of signals, including a jogging signal, for controlling said sewing machine drive means;

needle position detection means for detecting the needle position of said sewing machine;

rotary angle setting means for setting the rotary angle of said sewing machine pulley;

means for measuring the rotary angle of said sewing machine pulley in response to said needle position detection means; and means for rotating said sewing machine pulley in response to an angle storage signal entered into said control means, and when a jogging signal is entered, rotating the sewing machine pulley forward to stop at a set jogging angle if the measured rotary angle of said sewing machine pulley is less than a predetermined value and transferring said measured rotary angle of said sewing machine pulley to said rotary angle setting means if the measured rotary angle of said sewing machine pulley is equal to or more than said predetermined value.

3. A sewing machine controlling apparatus comprising:

sewing machine drive means for driving a sewing machine pulley;

control means responsive to a plurality of signals, including an ultra-low speed input signal, for controlling said sewing machine drive means;

needle position detection means for detecting the needle position of said sewing machine;

rotary angle setting means for setting the rotary angle of said sewing machine pulley; and means for measuring the rotary angle of said sewing machine pulley in response to said ultra-low speed input signal entered into said control means and transferring the measured rotary angle of said sewing machine pulley to said rotary angle setting means.

* * * * *